United States Patent [19]

Querry et al.

[11] 4,121,423

[45] Oct. 24, 1978

[54] COMPOUND INTERNAL-COMBUSTION HOT-GAS ENGINES

[75] Inventors: Marvin R. Querry, Johnson County, Kans.; William G. Reinschmidt, Clay County, Mo.

[73] Assignee: Automotive Propulsion Laboratories, Ltd., Gladstone, Mo.

[21] Appl. No.: 802,254

[22] Filed: May 31, 1977

[51] Int. Cl.[2] ..... F02B 73/00

[52] U.S. Cl. ..... 60/616; 60/620

[58] Field of Search ..... 60/616, 617, 618, 517, 60/526, 597, 614, 620, 712

[56] References Cited

U.S. PATENT DOCUMENTS

| | | | |
|---|---|---|---|
| 1,301,614 | 4/1919 | Snyder | 60/616 |
| 2,090,214 | 8/1937 | Maniscalco | 60/616 |
| 3,180,078 | 4/1965 | Liston | 60/616 |

*Primary Examiner*—Louis J. Casaregola

[57] ABSTRACT

The present invention is a compound internal-combustion hot-gas engine comprising a housing wherein there are internal-combustion means and hot-gas means which are coupled mechanically by a single crankshaft, coupled thermally by a thermal energy recuperator-transfer unit, and also coupled thermally by a circulating liquid cooling system. The compound engine has a plurality of cylinders and reciprocating pistons. The cylinders are grouped in either a linear, vee, or flat planar geometrical distribution. Preferred embodiments include a compound engine possessing three cylinders and progress continuously to engines possessing an arbitrarily large number of cylinders. The compound engine is particularly useful as a prime mover for automobiles, trucks, busses, locomotives, maritime vessels, farm implements, and stationary power sources, but is not limited to such uses.

9 Claims, 71 Drawing Figures

COMPOUND INTERNAL-COMBUSTION HOT-GAS ENGINES

REFERENCES

1. Charles F. Taylor, *The Internal-Combustion Engine in Theory and Practice:* "Thermodynamics, Fluid Flow, Performance", Vol. 1, Second Edition (1966): "Combustion, Fuels, Materials, Design", Vol. 2 (1968): The M.I.T. Press, Cambridge, Mass.
2. G. Walker, *Stirling-Cycle Machines,* Clarendon Press, Oxford, England, (1973).

BACKGROUND OF THE INVENTION

This invention relates to internal-combustion engines and to hot-gas engines. In particular the present invention is a series of different compound internal-combustion hot-gas engines. Each compound engine is housed in a single engine casting wherein an internal-combustion means and a hot-gas means are mechanically and dynamically connected by use of a single crankshaft. The internal-combustion means possesses one or more cylindrical combustion chambers which are made expansible by use of a reciprocating piston therein. The internal-combustion means operates in either the two-stroke or four-stroke cycle, thereby burning a fuel-air mixture and then expelling hot exhaust gases. A recuperator, usable to both said means, receives the hot exhaust gases and transfers thermal energy therefrom, and thereby thermally drives the hot-gas means. The hot-gas means possesses two or more cylindrical chambers which are made expansible by single-acting or double-acting reciprocating pistons therein. The hot-gas means operates by expansion and/or contraction of a constant mass of motivating gaseous medium, which is heated or cooled in one of the plurality of continually communicating expansible cylindrical chambers with the medium regeneratively transferable therebetween. A liquid coolant usable to both said means convectively transfers waste thermal energy from said means to a radiator which thermally communicates with the ambient environment. The cylindrical axes of said expansible cylindrical chambers within the compound engines are geometrically distributed side-by-side and parallel either: (1) in a single plane (linear engine); or (2) in two planes forming a vee with the axes all intersecting the line common to the two planes, and where the vee angle is $\pi/3$ radians, $\pi/2$ radians, or arbitrarily variable from 0 to $\pi$ radians. Although the invention is particularly useful as a prime mover for automobiles, trucks, busses, locomotives, maritime vessels, farm implements, and stationary power sources, it is not limited to such uses.

While the preferred embodiments disclosed herein typically employ hot-gas means, such as closed Stirling-cycle units, other hot-gas means may be used subjecy to the performance characteristics of such other hot-gas means. Also, while the preferred embodiments disclosed herein typically employ internal-combustion means, such as four-stroke-cycle spark-ignition or compression-ignition units, or such as two-stroke-cycle spark-ignition or compression-ignition units, other internal-combustion means may be used subject to the performance characteristics of such other internal-combustion means. Additionally, while the preferred embodiments disclosed herein are compound engines wherein expansible cylindrical chambers are distributed as described above, other geometrical distributions of expansible cylindrical chambers may be used subject to the performance characteristics of such other compound engines. Throughout the remainder of this patent application the term "cylinder" shall mean "a cylindrical chamber with a reciprocating piston therein thus making said chamber expansible".

There has been momentous activity and significant progress in the development of prior art internal-combustion engines. For example, reference is made to the host of U.S. patents in class 123. Today internal-combustion engines are produced in mass and are commercially available in a multitude of variations. The variations range nearly continuously from small single cylinder engines providing output power of a fraction of a kilowatt to very large engines providing megawatts of output power. There are, however, only two practical mechanical types of internal-combustion engines. They are (a) the rotary engine, and (b) the crankshaft engine with reciprocating pistons. The crankshaft engines have pistons operating in cylinders which are arranged in linear, vee, flat-planar, or radial geometrical distributions about the axis of the crankshaft. The crankshaft engines typically operate in either the four-stroke cycle or in the two-stroke cycle. Reference 1 provides a review of internal-combustion engines.

During the past thirty-five years there was an increase in activity and progress in the development of practical hot-gas engines. For example see all the U.S. patents in class 60/24, and as of Jan. 1976 those in class 60, subclasses 517–531. We have reviewed abstracts for all these patents at the Linda Hall Library, Kansas City, Mo. However, after corresponding with several companies that own patents or licensing agreements relating to hot-gas engines, we found hot-gas engines are now commercially available only as laboratory or lecture demonstration devices which deliver a fraction of a kilowatt of output power. Practical hot-gas engines having output power from 5 to 300 kilowatts remain, to this day, to be experimental devices which are available only through intricate licensing agreements with owners of prior art patents. There are three different basic mechanical types of the larger hot-gas engines. They are: (a) the rhombic-drive displacer-piston engine, (b) the swashplate engine with reciprocating pistons, and (c) the crankshaft engine with reciprocative pistons, all of which are described in Reference 2 and in several U.S. patents in class 60, subclasses 24 and 517–531.

We discovered through the use of classical Lagrangian mechanics that the dynamical motion of all basic moving parts of any prior art internalcombustion engine and any prior art hot-gas engine, except for free-piston hot-gas engines, can be analytically described by mathematical functions of $\alpha$ the angular position, $\alpha'$ the angular velocity, and $\alpha''$ the angular acceleration of the engine's output shaft or crankshaft. From the veiwpoint of classical Lagrangian mechanics these two classes of engines are each mechanical systems with only one degree of freedom, i.e., $\alpha$ the angular position of the crankshaft. We deduced in that manner that internal-combustion engines and hot-gas engines are compatible mechanical systems.

We also noted the following four thermodynamic features of these two classes of engines:

1. that prior art internal-combustion engines burn a fuel-air-mixture, do work (Joules), and then release hot exhaust gases to the ambient environment;
2. that prior art hot-gas engines do work by utilizing an external combustion unit which also releases hot exhaust gases to the ambient environment;

3. that both of these classes of prior art engines utilize an air- or liquid-coolant system; and
4. that the net thermodynamic hot-gas cycle and the Otto cycle for internal-combustion engines bear significant similarity. We deduced from these four points that internal-combustion engines and hot-gas engines are also thermodynamically compatible, although the basic thermodynamic principles of their cycles are different.

In prior art approaches, internal-combustion engines and hot-gas engines have been developed as separate means. The fuel conversion efficiency of practical prior art internal-combustion engines is rated from about 15 to 28 percent, and for prior art hot-gas engines is theoretically rated from about 28 to 38 percent. Internal-combustion engines lose thermal energy to the ambient environment by three processes: (a) radiation, (b) convection through the coolant, and (c) in the exhaust gases. For example, thermal energy from the exhaust gases of present automobile engines provide sufficiently high temperatures in catalytic converters to cause chemical reduction of noxious gases. Hot-gas engines possess external combustion chambers which also expel exhaust gases that cool by expanding to ambient pressure, thus doing useless work on the ambient atmosphere. Hot-gas engines also lose thermal energy to the ambient environment through radiation and through convection of the coolant. Prior art internal-combustion engines and prior art hot-gas engines both operate at efficiencies well below the maximum obtainable efficiency of an ideal Carnot engine operating between the same two absolute temperatures. The application of the present invention in achieving further thermal compatibility and thereby efficient fuel conversion is to provide compound engines wherein an internalcombustion means is the combustion unit for a hot-gas means. In our compound engines thermal energy is recuperated from the exhaust gases of the internal-combustion means and transferred by conduction or by heat pipes to the heater of the hot-gas means. The opening and closing of the exhaust and intake ports in the cylinders of the internal-combustion means can be cyclically timed to facilitate thermal and output torque balance between the internal-combustion means and hot-gas means of the compound engine.

SUMMARY OF THE INVENTION

It is the general object of this invention to provide an indeterminate number of different compound internal-combustion hot-gas engines. Each said compound engine possesses an internal-combustion means and a closed cycle hot-gas means. In the internal-combustion means one or more reciprocative pistons each move in separate cylinders wherein a gaseous fuel-air mixture is ignited by either spark, compression, or other means. In the hot-gas section reciprocative pistons each move in separate cylinders wherein they operate in either the single-acting or double-acting mode. Each reciprocative piston is attached pivotally to one end of a connecting rod. The other end of each connecting rod is attached rotatably to a single crankshaft for the compound engine. The compound engines may be of the linear, vee, flat-planar, or other configuration. Thermal energy to operate the hot-gas section is recuperated from exhaust gases issuing from the cylinders of the internal-combustion means.

Another object of this invention is to provide the relative placement of connecting-rod journals on the single crankshaft that mechanically couples the internal-combustion means and hot-gas means of a compound engine.

Another object of this invention is to provide a recuperator-thermal-transfer means that thermodynamically couples the internal-combustion means and the hot-gas means of a compound engine.

Another object of this invention is to provide compound internal-combustion hot-gas engines which operate efficiently by use of present state of the art fuels.

Another object of this invention is to provide compound internal-combustion-engine hot-gas-refrigerator means.

These and numerous other advantages of the present invention will become apparent as the following detailed description and accompanying drawings are read and understood.

BRIEF DESCRIPTION OF THE DRAWINGS

In the following descriptions of FIGS. 1–71 the term "compound engine" refers to a "compound internal-combustion hot-gas engine" according to the present invention.

FIG. 31 also relates to the group composed of FIG. 30 and portions of FIGS. 11 and 14 and is thereby an end-on schematic of the configuration and corresponding direction of rotation of a crankshaft for an embodiment of a six cylinder vee compound engine.

DESCRIPTION OF THE PREFERRED EMBODIMENTS

FIRST PREFERRED EMBODIMENT

Figure 2:
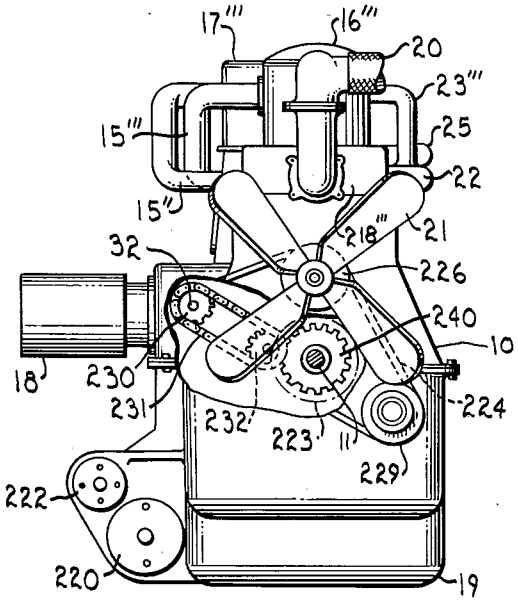
FIG. 2 relates to FIGS. 1, 3, 4, 7, 27, and 31 and is a front elevation of an embodiment of a linear compound engine including means for liquid coolant to remove waste thermal energy, cooling fan, a recuperator for extracting thermal energy from the exhaust gases issuing from the internal-combustion means of the compound engine, and heat pipes for transferring recuperated thermal energy to the hot-gas means of the compound engine.
Figure 1:
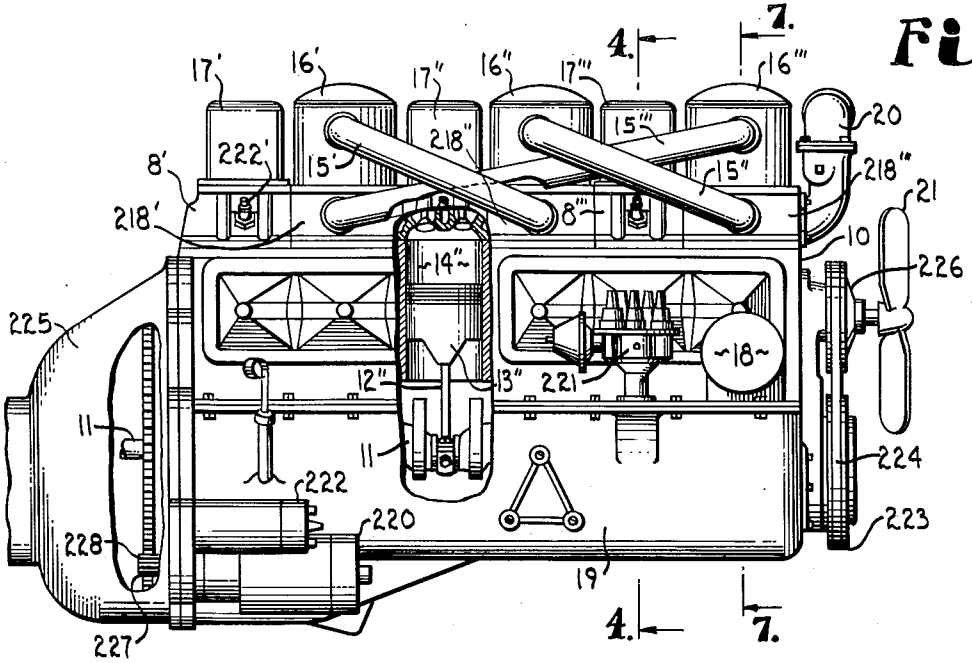
FIG. 1 relates to FIGS. 2, 3, 4, 7, 27 and 31 and is a side elevation of an embodiment of a six-cylinder linear compound engine including an engine casting in which three cylinders interconnected by regenerators contain three pistons operating in the double-acting hot-gas mode, three cylinders contain three pistons operating in the internal-combustion mode, and wherein the six pistons are connected by separate connecting rods to a single crankshaft.
Figure 3:
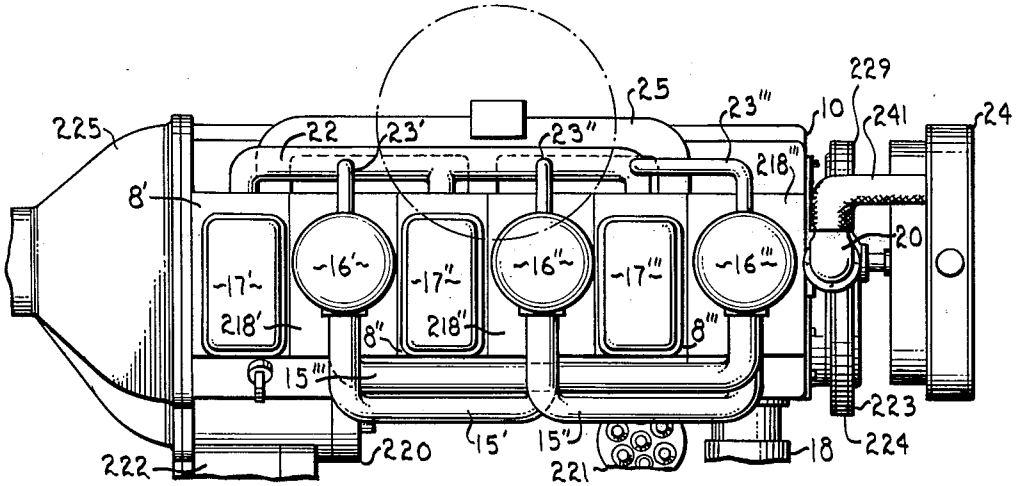
FIG. 3 related to FIGS. 1, 2, 4, 7, 27, and 31 and is a top elevation of an embodiment of a linear six-cylinder compound engine including an intake manifold for the internal-combustion means and a radiator means for the liquid coolant.
Figure 4:
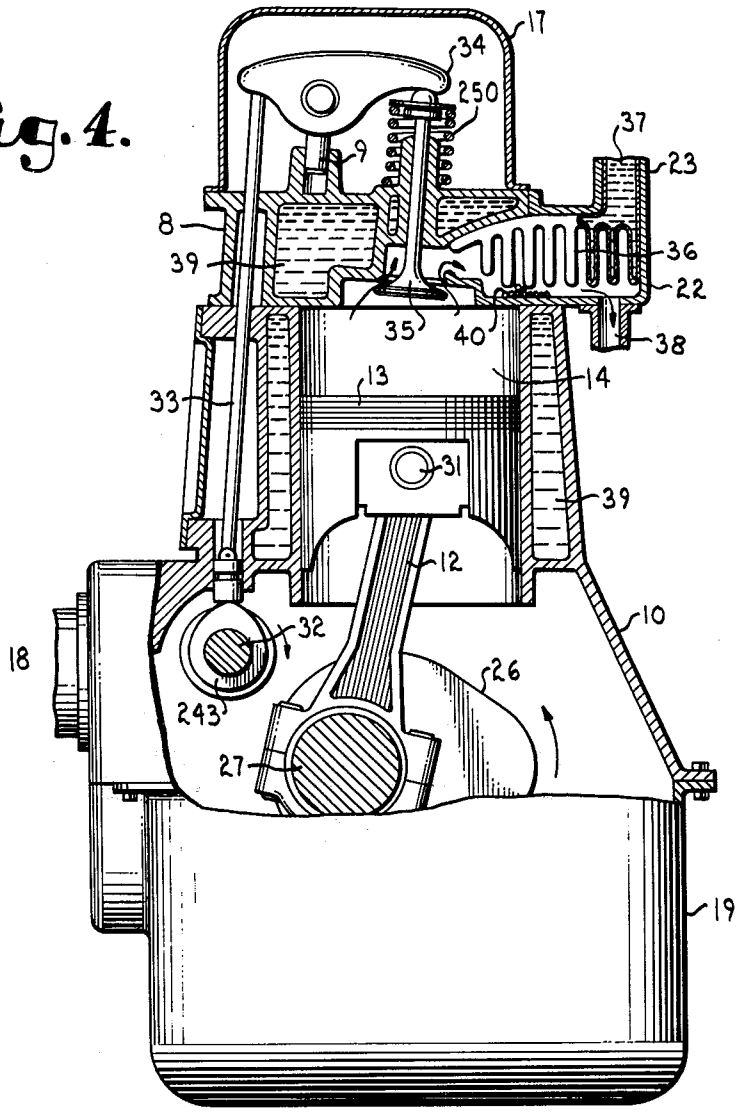
FIG. 4 relates to FIGS. 1, 2, 3, 15, 17, 21, 24, 27, 32, 34, 36, 40, 42, 44, 46, 54, 56, 58, 64, 66, 68, and 70 and is a cross sectional view of an embodiment of an internal-combustion unit for linear compound engines; included are engine casting, crankshaft lobe, connecting-rod journal of the crankshaft, connecting rod, piston pin, piston, cylinder, camshaft, push rod, rocker arm, exhaust valve, recuperator, heat pipe, exhaust outlet, and liquid coolant.
Figure 7:
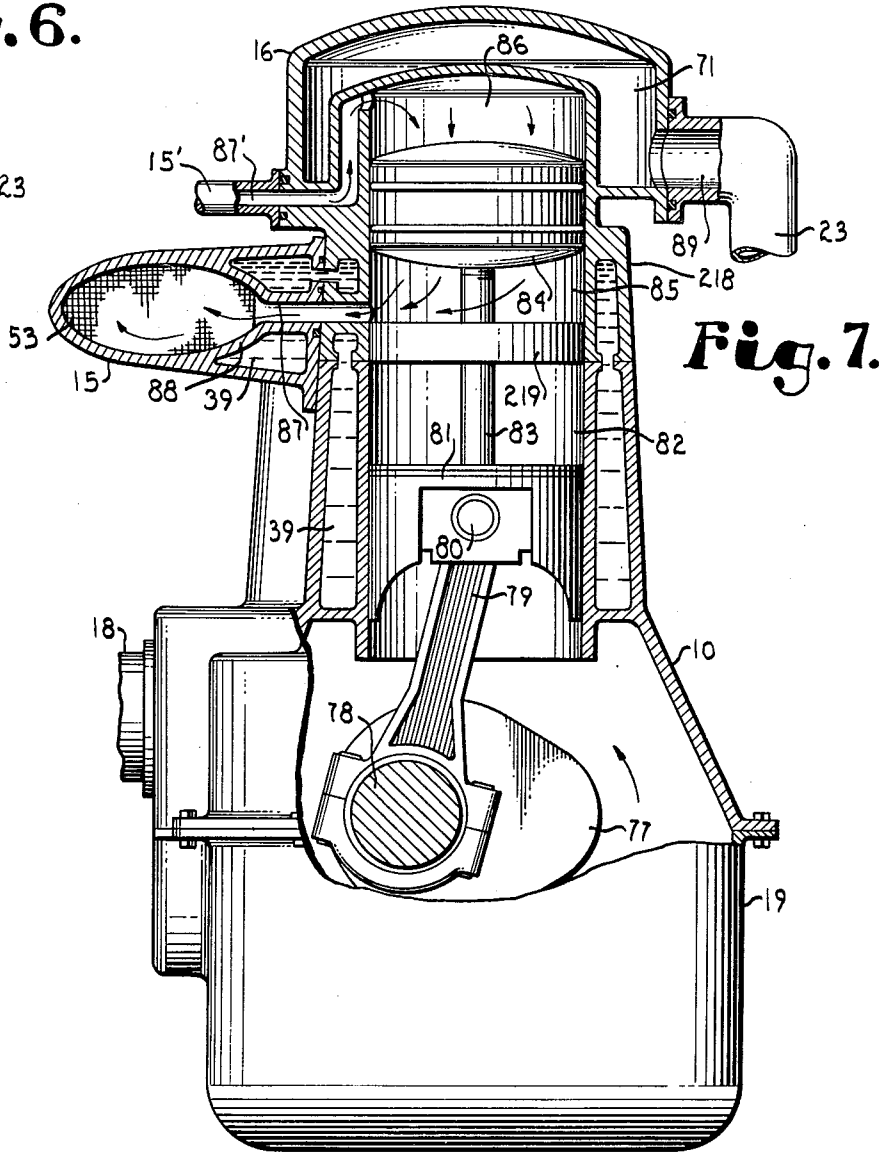
FIG. 7 relates to FIGS. 1, 2, 3, 4, 27, 36, 40, 46, 54, 56, 58, 64, 66, 68, and 70 and is a cross sectional view of an embodiment of a double-acting hot-gas unit for linear compound engines; included are engine casting, crankshaft lobe, connecting-rod journal of crankshaft, primary connecting rod, piston pin, guide member, secondary connecting rod, double-acting piston, hot-cylinder, heater, liquid coolant, regenerator, and matrix for regenerator.
Figures 24, 25, 26, 27, 28, 29, 30, 31, 32:
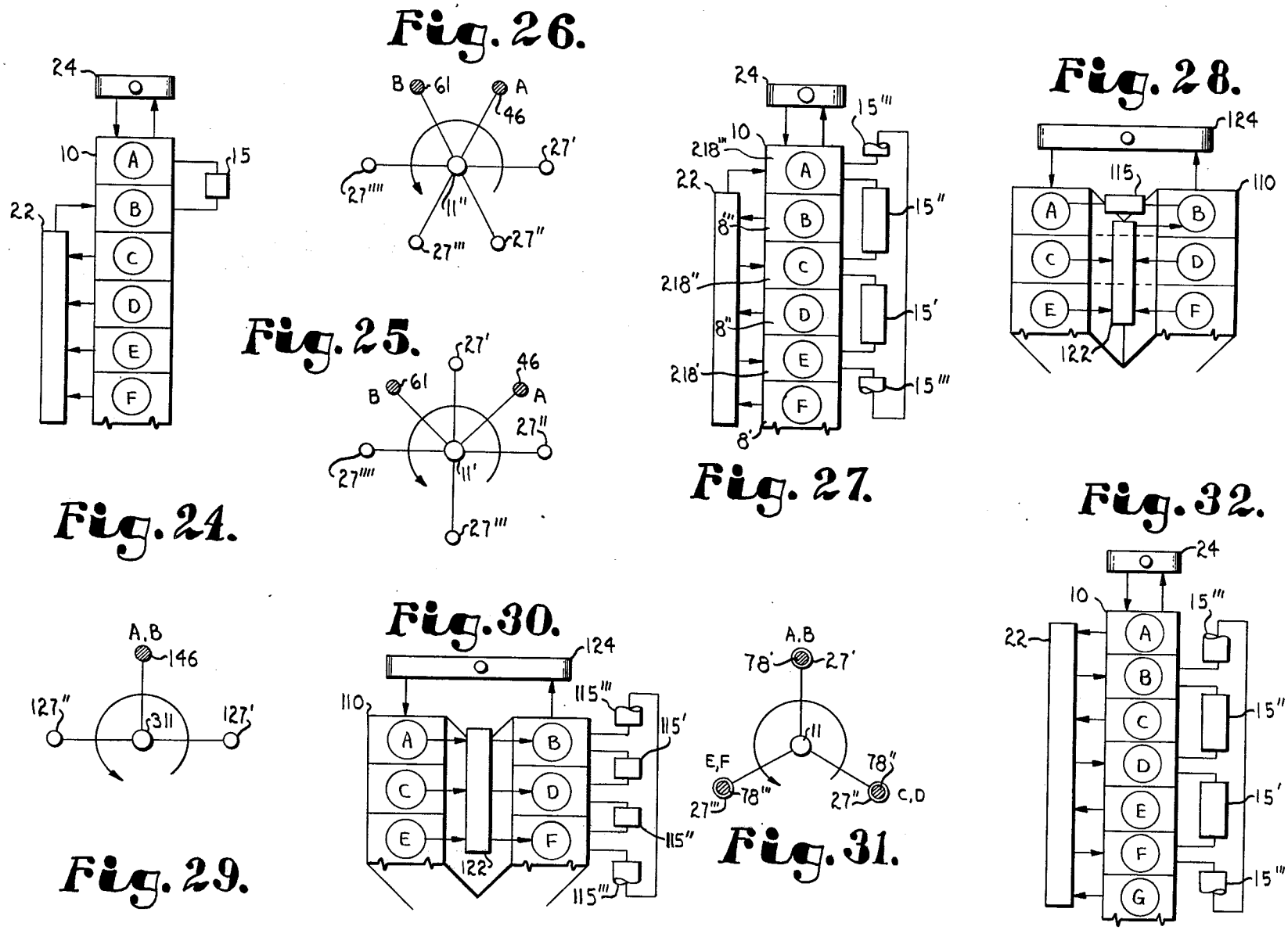
FIG. 24 relates to FIGS. 4, 5, 6, 25, and 26 and is a block diagram of an embodiment of a six cylinder linear compound engine.
FIG. 25 relates to FIGS. 4, 5, 6, and 24 and is an end-on schematic diagram of the configuration and corresponding direction of rotation of the crankshaft for an embodiment of a six cylinder linear compound engine. This configuration of the crankshaft is an alternative to that shown in FIG. 26.
FIG. 26 relates to FIGS. 4, 5, 6, and 24 and is an end-on schematic diagram of the configuration and corresponding direction of rotation of the crankshaft for an embodiment of a six cylinder linear compound engine. This configuration of the crankshaft is an alternative to that shown in FIG. 25.
FIG. 27 relates to FIGS. 1, 2, 3, 4, 7, and 31 and is a block diagram of an embodiment of a six cylinder linear compound engine.
FIG. 28 relates to FIGS. 11, 13, and 29 and is an embodiment of a six cylinder vee compound engine.
FIG. 29 relates to FIGS. 11, 13, and 28 and is an end-on schematic diagram of the configuration and corresponding direction of rotation of the crankshaft for an embodiment of a sixe cylinder vee compound engine.
FIG. 30 relates only in part to FIGS. 11 and 14 and relates to FIG. 31, and is a block diagram of an embodiment of a six cylinder vee compound engine.
FIG. 31 relates to the group composed of FIGS. 1, 2, 3, 4, 7, and 27 and is thereby an end-on schematic diagram of the configuration and corresponding direction of rotation of a crankshaft for an embodiment of a six cylinder linear compound engine.
FIG. 32 relates to FIGS. 4, 7, and 33 and is a block diagram of an embodiment of a seven cylinder linear compound engine.

Reference is made to a first basic preferred embodiment comprising a six cylinder linear compound internal-combustion hot-gas engine according to the present invention as shown in FIGS. 1, 2, 3, 4, 7, 27, and 31; wherein FIGS. 4 and 7 respectively show in cross section an internal-combustion unit and a hot-gas unit, with said units usable three times each to the side elevation of FIG. 1, to the front elevation of FIG. 2, to the top elevation of FIG. 3, and to the block diagram of FIG. 27.

Shown in FIG. 4 is an internal-combustion unit comprising:

an engine casting 10 which is a housing;

a portion 8 of an engine head mounted on the top of 10;

a crankshaft 11 (FIG. 1) mounted to rotate freely about its axis within the lower part of 10;

a countermass 26 integral to 11 and for dynamic balancing of said internal-combustion unit;

a connecting-rod journal 27 integral to 11;

a connecting rod 12 having two holes through its sides, with one of said holes at each end of 12, and with one end connected freely about 27 via use of one of said holes;

a piston pin 31 inserted freely through said hole in the other end of 12;

a piston 13 having two holes diametrically placed in its sidewalls with the ends of 31 pivotally inserted in said holes;

a cylinder 14 providing a combustion chamber for a gaseous fuel-air mixture, and in 14 piston 13 moving freely to and fro when driven by 12 from below and when driven by pressure of the burning fuel-air mixture from above;

a camshaft 32 mounted so as to rotate about its axis, and mounted within the side midsection of 10;

a cam 243 integral to 32;

a cam follower 33 free to move to and fro within 10 and with one end of 33 engaging 243;

a rocker arm 34 having a hole off-center through its side, and with the rightmost underside of 34 engaging the other end of 33;

a post-and-shaft 9 mounted in 8 and on which 34 is mounted pivotally as a lever via use of said hole off-center in 34;

an exhaust valve 35 mounted in 8, with one (stem) end of 35 engaging the leftmost underside of 34, and with the other (valve) end of 35 closing and disclosing an exhaust outlet in the top of cylinder 14;

a valve spring 250 acting on 35 so as to close the exhaust outlet in the top of 14. The internal-combustion unit shown in FIG. 4 also possesses an intake valve system, which is not explicitly shown in FIG. 4, but which is similar to the exhaust valve system. The intake valve system comrises:

another portion of camshaft 32;

a cam 243′ integral to 32;

a cam follower 33′ free to move to and from within 10 and with one end of 33′ engaging 243′;

a rocker arm 34′ having a hole off-center through its side, and with the rightmost underside of 34′ engaging the other end of 33′;

a post-and-shaft 9′ mounted in 8 and on which 34′ is mounted pivotally as a lever via use of said off-center hole in 34′;

an intake valve 35′ mounted in 8, with one (stem) end of 35′ engaging the leftmost underside of 34′, and with the other (valve) end of 35′ closing and disclosing an inlet for a fuel-air mixture to enter at the top of cylinder 14; and a valve spring 250′ acting on 35′ so as to close the inlet in the top of 14. Furthermore, the internal-combustion unit shown in FIG. 4 comprises:

a recuperator 22 mounted on 8 so as to receive hot exhaust gases issuing from 14 through the outlet disclosed by exhaust valve 35;

a series of inerconnected hollow thermally conductive metal recuperator members 36 mounted inside 22 and sealed so as to exclude the entry of hot exhaust gases into members 36;

a liquid metal 37 occupying the interconnected hollow space interior to members 36;

a thermally conductive granular matrix 40 such as aluminum, copper, or stainless steel in thermal communication with members 36, with 40 loosely filling the space inside 22 and external to members 36, and with 40 contacting hot exhaust gases and absorbing thermal energy from said exhaust gases;

a heat pipe 23 integral to 22 and usable to the hot-gas unit shown in FIG. 7, and which hot metal vapor of 37 rising convectively in 23 thus transporting thermal energy from 22 to the heater 16 (FIG. 7) of said hot-gas unit; and an outlet 38 for cooled exhaust gases. Also the internal-combustion unit comprises:

an oil filter 8 attached to 10;

an oil reservoir 19 attached to 10;

a valve cover 17 attached to 8; and a liquid coolant 39 flowing in hollow interconnected convection ways within 8 and 19, and with 39 removing waste thermal energy from the internal-combustion unit.

Shown in FIG. 7 is a hot-gas unit comprising:

an engine casting 10 which is a housing;

a portion 218 of an engine head mounted on the top of 10;

a crankshaft 11 (FIG. 1) mounted to rotate freely about its axis within the lower part of 10;

a countermass 77 integral to 11 and for dynamic balancing of moving members within said hot-gas unit;

a connecting-rod journal 78 integral to 11;

a primary connecting rod 79 having two holes through its sides, with one of said holes at each end of 79, and with one end connected freely about 78 via use of one of said holes;

a pin 80 inserted freely through said hole in the other end of 79;

a guide member 81 having two holes diametrically placed in its sidewalls with the ends of 80 pivotally inserted in said holes;

a guide cylinder 82 in which 81 moves freely to and fro when driven by 79 from below or when driven from above by another member;

a secondary connecting rod 83 attached rigidly to the top of 81;

a circular plate 219, which is mounted in the lower region of 218, and wherein 83 moves to and fro through a hole centered in 219, and with said hole sealed around 83 so as to prevent the escape of gases from the space above 219 to the space below 219;

a cylindrical double-acting piston 84 whose lower surface is rigidly attached to 83;

a cylindrical cool compression space 85 below 84, and with 84 moving to and fro within 85;

a cylindrical hot expansion space 86 above 84, and with 84 moving to and fro within 86;

a gaseous working medium such as hydrogen or helium filling spaces 85 and 86;

a duct 87 via which the gaseous working medium flows to and from 85;

a cooler 88 through which duct 87 passes;

a regenerator 15 integral to 88 with duct 87 also leading to the interior of 15;

a thermally conductive metal matrix 53 packed loosely inside 15 so as to thermally communicate with the gaseous working medium circulating about 53;

a duct 87' via which the gaseous working medium flows to and from 86;

another regenerator 15' which is not fully shown in FIG. 7 but which is similar to regenerator 15;

a heater 16 integral to 218;

a metal vapor 71 inside 16 wherein 71 condenses to liquid metal on the inner conducting walls of 16 thus surrendering its thermal energy of vaporization to said conducting walls, with said thermal energy being conducted through said conducting walls to the gaseous working medium in 86, and with said condensed liquid metal flowing gravitationally to the lowermost space within 16;

a heat pipe 23 attached to 16, with metal vapor entering 16 via 23, and with 23 usable to the internal-combustion unit shown in FIG. 4 as described previously herein; and a porous wick 89 lining 23 and providing a means for capillary flow of condensed liquid metal through 23 to recuperator 22 (FIG. 4);

a liquid coolant 39 flowing in hollow interconnected convection ways within 10 and 218, with 39 removing waste thermal energy from the hot-gas unit, and with 39 also usable to the internal-combustion unit shown in FIG. 4 as described previously herein. Further interconnections of spaces 85 and 86 are described in greater detail hereinafter.

FIG. 1 is a side elevation of the first preferred embodiment of a compound internal-combustion hot-gas engine wherein are shown:

an internal combustion means comprised of three of the internal-combustion units of the type shown in FIG. 4 and previously described herein;

a hot-gas means comprised of three of the hot-gas units of the type shown in FIG. 7 and previously described herein;

an engine casting 10 which is a housing;

an engine head comprising 8', 218', 8'', 218'', and 218''' attached to the top of 10, wherein 8 and 218 respectively relate to members so designated in FIGS. 4 and 7;

three valve covers 17', 17'', and 17''' respectively mounted on 8', 8'', and 8''' of the three internal-combustion units; three heaters 16', 16'', and 16''' respectively integral to 218', 218'', and 218''' of the three hot-gas units;

a regenerator 15' connected at one end to heater 16' and at the other end to 218'', and thus via a duct 87' through 15' interconnecting a cool compression space 85'' below a double-acting piston 84'' in one hot-gas unit to a hot expansion space 85' above a double-acting piston 84' in another hot gas unit;

a regenerator 15'' connected at one end to heater 16'' and at the other end to 218''', and thus via a duct 87'' through 15'' interconnecting a cool compression space 85''' below a double-acting piston 84''' in one hot-gas unit to a hot expansion space 87'' above a double-acting piston 84'' in another hot-gas unit;

a regenerator 15''' connected at one end to heater 16''' and at the other end to 218', and thus via a duct 87''' through 15''' interconnecting a cool compression space 85' below a double-acting piston 84' in one hot-gas unit to a hot expansion space 86''' above a double-acting piston 84''' in another hot-gas unit;

a crankshaft 11 usable to the internal-combustion means and the hot-gas means;

a flywheel gear 227 centered and mounted on an end of 11 which protrudes from the rear of 10;

a housing 225 attached to 10 and covering 227;

a pulley 223 centered and mounted on the end of 11 which protrudes from the front of 10;

a belt 224 engaging 223;

a pulley 226 mounted on 10 so as to rotate and engage belt 224;

a fan 21 attached to pulley 226;

a pipe 20 for liquid coolant 39, with 20 attached to 218''';

three spark plugs inserted in 8', 8'', and 8''' one of which is denoted by the number 222';

a distributor 221 which is attached to 10 and which is connected to spark plugs via electrically conducting wires;
an ignition coil 222 attached to 10 and connected to 221 by an electrically conducting wire;
a starter motor 220 attached to 10 with 220 operated electrically;
a gear 228 attached to 220 and engaging flywheel gear 227;
an oil filter 18 attached to 10; and
an oil reservoir 19 attached to 10. Also shown in FIG. 7 is a cut-away view exposing a portion of the crankshaft 11, a connecting rod 12'', a piston 13'', and a cylinder 14'' which are all usable as previously described herein to one of the three internal-combustion units of this compound internal-combustion hot-gas engine. The relative placement of connecting-rod journals on crankshaft 11 is described hereinafter.

FIG. 2 is a front elevation of the first preferred embodiment of a compound internal-combustion hot-gas engine wherein are shown:
an engine casting 10 which is a housing;
the front 218''' of the engine head which is attached to the top of 10;
heater 16''' integral to 218''' and belonging to one of the three hot-gas units;
recuperator 22 attached to the engine head so as to receive hot exhaust gases from the internal-combustion means;
heat pipe 23''' interconnecting 16''' and 22;
regenerator 15''' connected to 16''';
regenerator 15'' connected to 218''';
valve cover 17''' attached to the engine head;
intake manifold 25 attached to the engine head so as to supply a fuel-air mixture to the internal-combustion means;
the front end of crankshaft 11;
pulley 223 centered and mounted on 11;
belt 224 engaging 223;
pulley 226 mounted on 10 so as to rotate and engage belt 224;
fan 21 attached to pulley 226;
auxiliary pulley 229 attached to 10 so as to rotate, and with 229 engaging 224 thus adjusting the tension in 224;
a gear 240 centered on and mounted on 11;
a gear 232 rotating on a mount in 10 so as to engage 240;
a chain belt 231 engaging 232;
a camshaft 32 mounted so as to rotate inside 10;
a gear 230 centered and mounted on the end of 32, which chain belt 231 engaging 230 thus causing 32 to rotate;
an oil filter 18 attached to 10;
an oil reservoir 19 attached to 10;
starter motor 220 attached to 10;
ignition coil 222 attached to 10; and
liquid-coolant pipe 20 attached to 218'''.

FIG. 3 is a top elevation of the first preferred embodiment of a compound internal-combustion hot-gas engine wherein are shown:
the top of an engine casting 10 which is a housing;
an engine head comprising 8', 218', 8'', 218'', 8''', and 218''' attached to the top of 10, wherein 8 and 218 relate to members so designated in FIGS. 4 and 7, respectively;
three valve covers 17', 17'', and 17''' mounted respectively on 8', 8'', and 8''' of the engine head with said valve covers usable to the internal-combustion means comprising three internal-combustion units;
three heaters 16', 16'', and 16''' integral respectively to 218', 218'', and 218''' with said heaters usable to the hot-gas means comprising three hot-gas units;
a regenerator 22 connected to 8', 8'', and 8''' so as to receive hot exhaust gases issuing from the internal-combustion means;
three heat pipes 23', 23'', and 23''' one of each being connected respectively to heaters 16', 16'', and 16''' and the other end of said heat pipes connected separately to regenerator 22 so as to transport hot metal vapor from 22 to said heaters and to transport condensed liquid metal from said heaters to 22;
a regenerator 15' connected at one end to 16' and at the other end to 218'' thus interconnecting via a duct 87' through 15' a hot expansion space 86' in one hot-gas unit to a cool compression space 85'' in another hot-gas unit;
a regenerator 15'' connected at one end to 16'' and at the other end to 218''' thus interconnecting via a duct 87'' through 15'' a hot expansion space 86'' in one hot-gas unit to a cool compression space 85''' in another hot-gas unit;
a regenerator 15''' connected at one end to 16''' and at the other end to 218' thus interconnecting via a duct 87''' through 15''' a hot expansion space 86''' in one hot-gas unit to a cool compression space 85' in another hot-gas unit;
an intake manifold 25 connected to 8', 8'', and 8''' so as to supply a fuel-air mixture to the internal-combustion means;
a housing 225 attached to the rear of 10;
a pipe 20, for liquid coolant, attached to 218''';
a hose 241 connected to 20 for transport of liquid coolant;
a radiator 24 connected to hose 241 and with 24 transporting waste thermal energy from the liquid coolant 39 to the ambient environment by use of air circulated by 21;
a pulley 223 as previously described;
a belt 224 engaging 223;
a pulley 22 engaging 224;
a starter motor 229 mounted on 10 for starting the compound engine;
an ignition coil 222 mounted on 10;
a distributor mounted on 10; and
an oil filter 18 mounted on 10.

FIG. 27 is a block diagram of a compound engine according to the first preferred embodiment. Block units A, C and E each represent a double-acting hot-gas unit of the type shown in FIG. 7; thus the hot-gas means is also designated ACE. Block units B, D, and F each represent an internal-combustion unit of the type shown in FIG. 4; thus the internal-combustion means is also designated BDF. As previously described herein; block units 15', 15'', and 15'' represent regenerators, block unit 22 represents the recuperator, and block unit 24 represents the radiator. The notation 8', 218', 8'', 218'', 8''', and 218''' in FIG. 27 refer to members so designated in FIGS. 1, 2, 3, 4, and 7. The two arrows between 10 and 24 in FIG. 27 represent the flow of liquid coolant 39 to and from the compound engine and its radiator 24. The other arrows in FIG. 27 designate the direction of flow of thermal energy from exhaust gases issuing from internal-combustion means BDF to recuperator 22, and then via heat pipes or conduction thermal energy flows to hot-gas means ACE.

FIG. 31 is a end-on schematic diagram of the relative placement of the six connecting-rod journals on a crankshaft 11 usable to the first embodiment of a compound engine. Notations A, B, C, D, E, and F in FIG. 31 relate dirctly to similar notations on block units in FIG. 27. The unshaded circle 11 central to FIG. 31 relates to an axial shaft of crankshaft 11. The three unshaded circles 27', 27'', and 27''' each designate a separate connecting-rod journal 27 of an internal-combustion unit of the type shown in FIG. 4. The three shaded circles 78', 78'', and 7''' each designate a separate connecting-rod journal 78 of a hot-gas unit of the type shown in FIG. 7. The circular arrow in FIG. 31 coincides with similar shorter arrow adjacent to 26 in FIG. 4 and 77 in FIG. 7, and designates the counter clockwise rotation of 11. Connecting-rod journals 27', 27'', 27''', or 78', 78'', 78''' on 11 are separated by an angular displacement of $2\pi/3$ radians.

Each hot expansion space 86 above a double-acting piston 84 of a hot-gas unit (FIG. 7) is interconnected via a duct 87 through heater 16, regenerator 15, and cooler 88 to only one other cool compression space 85 below a double-acting piston 84 in another hot-gas unit. Referring to the block diagram in FIG. 27, the interconnections for a compound engine according to the first embodiment are:

- cool space 85''' of A interconnected via 15'' to hot space 86'' of C,
- cool space 85'' of C interconnected via 15' to hot space 86' of E, and
- cool space 85' of E interconnected via 15''' to hot space 86''' of A. Due to (*a*) the relative placement of 78', 78'', and 78''' on 11, (*b*) the direction of rotation of 11, (*c*) said interconnections of spaces of the type 85 and 86, and (*d*) an intrinsic angular phase difference of $\pi$ radians between spaces above and below 84; cyclic variations in the volume $V_e$ of a hot expansion space 86 lead those in the volume $V_c$ of an inerconnected cool compression space 85 by $\pi/3$ radians. When variations in $V_e$ lead by less than $\pi$ radians those in $V_c$, the hot-gas means operates as an engine.

The hot-gas means will also operate as a refrigerator if the hot expansion spaces 86', 86'', and 86''' are interconnected to the cool compression spaces 85', 85'', and 85''' in the following manner:

- hot space 86''' of A interconnected to cool space 85'' of C,
- hot space 86'' of C interconnected to cool space 85' of E, and
- hot space 86' of E interconnected to cool space 85''' of A;

wherein 11 rotates in the counter clockwise direction as previously described herein. Variations in $V_e$ then lag those in $V_c$ by $\pi/3$ radians. In hot-gas refrigerators heaters 16', 16'', and 16''' are replaced by coolers.

In the following paragraphs relating to the first preferred embodiment of a compound engine according to the present invention, we describe a complete cycle of operation for an internal-combustion unit and for one pair of interconnected spaces 85''' and 86'' of two hot-gas units. The full cycle of operation for the compound engine is obtained by superimposing three such cycles of the internal-combustion unit and three such cycles of a hot-gas unit, with said superimposition being made with angular phases consistent with the relative placements of 27', 27'', 27''', 78', 78'', and 78''' on 11.

As the crankshaft 11 rotates through one complete revolution the angular position $\alpha$ of each connecting-rod journal 27', 27'', 27''', 78', 78'', and 78''' changes continuously through $2\pi$ radians. As 11 rotates; the pistons 13', 13'', 13''', 84', 84'', and 84''' (FIGS. 4 and 7) are moved to and fro within their respective cylinders according to the equation $$R_{p,n} = R_{cr,n}[q_n \cos\alpha_n + \sqrt{(1 + q_n{}^2 \sin^2\alpha_n)}]: \quad (1)$$

wherein $n$ represents the $n^{th}$ connecting-rod journal ($n$ = 27', 27'', 27''', 78', 78'', or 78'''), $R_{p,n}$ is the cyclically variable perpendicular distance (meters) from the axis of 11 to the position where the piston assembly is attached to a connecting-rod whose other end is connected to the $n^{th}$ connecting-rod journal, $R_{cr,n}$ is the length of said connecting rod. $q_n$ is the ratio $(R_{cj}/R_{cr})_n$ where $R_{cj}$ is the perpendicular distance from the axis of 11 to the axial center of the $n^{th}$ connecting-rod journal, and $\alpha_n$ is the angular position of the $n^{th}$ connecting-rod journal. Throughout this patent application we arbitrarily choose $\alpha_n = 0$ for all $n$ when the piston associated with the $n^{th}$ connecting-rod journal is at top-dead-center (TDC) in its cylinder. As explained further hereinafter, $\alpha_n$ ranges from 0 to $2\pi$ radians in a two-stroke cycle and from 0 to $4\pi$ radians in a four-stroke cycle.

The rotational motion of the camshaft 32 in the internal-combustion means is coupled, as previously described, by gears and chain belts to the rotation of 11. In the four-stroke cycle internal-combustion means the camshaft 32 rotates in an opposite direction and at one-half the angular speed of 11. In those two-stroke cycle internal-combustion means possessing a camshaft, a camshaft rotates at the angular speed of the crankshaft. The geometrical configuration of six cams of the type 243 on 32 control the following four motions of the valves:

(1) The angular position in the cycle where the intake and/or exhaust valves open,
(2) the angular duration of the interval when the valves remain open,
(3) the angular position in the cycle when the valves close, and
(4) the angular duration of the interval when the valves remain closed.

Four-Stroke Cycle Internal-Combustion Unit: The four-stroke cycle for the internal-combustion unit shown in FIG. 4 is described as follows.

Intake Stroke: With the intake 35' (not shown) and exhaust 35 valves both disclosing openings in the top of cylinder 14, the piston 13 is drawn downward by 12 from the top of the cylinder 14 (denoted TDC or top-dead-center and corresponding to angular position $\alpha_n$ = 0 in the cycle wherein $n$ = 27). Combustible fuel-air mixture at a temperature of about 340° K is drawn into 14 through an opening disclosed by intake valve 35' and residual exhaust gases are simultaneously purged from cylinder 14 through an opening disclosed by exhaust valve 35. At $\alpha_n$ approximately equal to $\pi/18$ the exhaust valve 35 closes the exhaust outlet from 14. The gaseous fuel-air mixture, however, continues to flow into the cylinder through the opening disclosed by intake valve 35' until the piston 13 reaches the lower most extent of its stroke (denoted BDC for bottom-dead-center and corresponding to $\alpha_n = \pi$). The ideal stoichiometric portions of the combustible fuel-air mixture is about one mass unit of fuel per about 14.9 mass units of air.

Compression Stroke: With the intake valve 35' continuing to disclose the inlet to 14, the piston 13 moves upward from the BDC. At $\alpha_n$ approximately equal to $1.278\pi$ the intake valve 35' closes the inlet to 14 and the gaseous fuel-air mixture is then compressed in cylinder 14. In the angular interval $\alpha_n$ from $1.833\pi$ to $1.944\pi$ spark ignition occurs. In compression ignition internal-combustion units fuel is injected into hot compressed air in cylinder 14 and spontaneous combustion of the fuel and hot air mixture then occurs. The piston 13 continues to move upward until $\alpha_n = 2\pi$ (TDC), thus further compressing the burning fuel-air mixture. The crankshaft 11 must supply a negative torque required for the compression stroke.

Power Stroke: With the exhaust 35 and intake 35' (not shown) valves closing openings in the top of 14 and combustion in progress the piston 13 is forced from TDC ($\alpha_n = 2\pi$) by pressure of the burning fuel-air mixture toward the bottom of cylinder 14. At $\alpha_n$ approximately equal to $2.67\pi$ the exhaust valve 35 discloses the exhaust outlet in 14. The piston continues to move downward. The large pressure differential across the opening disclosed by the exhaust valve 35 forces part of the exhaust gases from the cylinder 14. The piston 13 continues moving downward to BDC ($\alpha_n = 3\pi$). A large positive torque is delivered via 12 to the crankshaft 11 during this stroke. The heat capacity $C_P$ of the exhaust gases is about 0.3 kcal/kg° K. The thermal energy $Q_{ex}$ (kcal) contained in the exhaust gases is thus $$Q_{ex} = M_{ex} C_P (T_i - T_f), \quad (2)$$

where $M_{ex}$ is the mass (*kg*) of the exhaust gases, $T_i$ is the temperature (° K) of the exhaust gases leaving the cylinder 14 and entering the recuperator 22. The temperature $T_i$ can be increased or decreased by respectively disclosing the exhaust outlet from 14 either earlier or later in the cycle, or by varying the compression ratio. The compression ratio is the ratio of maximum cylinder 14 volume (piston 13 at BDC) to minimum cylinder 14 volume (piston 13 at TDC). $T_f$ is the temperature of exhaust gases exiting from 22 through 38.

Exhaust Stroke: With the exhaust outlet remaining disclosed by valve 35 the piston 13 moves from BDC ($\alpha_n = 3\pi$) to TDC ($\alpha_n = 4\pi$), thus forcing the exhaust gases from the cylinder 14 and into the recuperator 22 where the exhaust gases contact matrix 40. At $\alpha_n$ approximately equal to $3.94\pi$ the intake to 14 is disclosed by valve 35'. The entire four-stroke cycle, which requires only 60 msec at engine speeds of 2,000 rpm, then begins another repetition.

Two-Stroke Internal-Combustion Means: The mechanical design of two-stroke internal-combustion units for compound engines according to the present invention is somewhat different from the design of the four-stroke internal-combustion units for the compound engines. The principle, however, on which the two-stroke and the four-stroke cycles operate is the same. The distinguishing feature of the two-stroke internal-combustion unit is that every downward motion of the piston is a power (expansion) stroke, and every upward motion of the piston is a compression stroke. Two-cycle internal-combustion units for the compound engine typically have exhaust and intake ports in the walls of the cylinders. The ports are closed and disclosed by the piston as it moves upward and downward, respectively. The two-stroke internal-combustion units do not possess the pumping action of the intake and exhaust strokes of the four-stroke internal-combustion units. A separate scavenging means, therefore, pumps the exhaust gases to the recuperator 22 and pumps the fuel-air mixture to the cylinders. In other two-cycle internal-combustion units for the present invention the closing and disclosing of the exhaust and inlet ports are controlled by valves driven by cams on a camshaft. The two-stroke internal-combustion unit also delivers exhaust gases containing thermal energy $Q_{ex}$ (Eq. 2) to the recuperator 22. A large portion of said thermal energy $Q_{ex}$ is then transferred by heat pipes 23 to the heater 16 of a hot-gas unit similar to that shown in FIG. 7.

The triad of interconnected double-acting hot-gas units (one said hot-gas unit is shown in FIG. 7) for this first preferred embodiment of the compound engine operate in a closed thermodynamic (Stirling) cycle. Thermal energy reaches the gaseous helium or hydrogen working medium, which is at an average gauge pressure in the range from 0 to 250 atm, of the hot-gas unit in the following manner. A large portion of the thermal energy $Q_{ex}$ in the exhaust gases from the internal-combustion unit of FIG. 4 is transferred by inelastic collisions with the matrix 40 in the recuperator 22 and then by conduction through the walls of the recuperator members 36. This thermal energy then vaporizes a liquid metal 37 such as sodium, cesium, potassium, mercury, or etc. in the lower part of the heat pipe 23. The metal vapor 71 then moves up the heat pipe 23 and condenses on the interior walls of the heater 16. During condensation the latent heat of vaporization;

975 kcal/kg for sodium at 1187° K,
122 kcal/kg for cesium at 963° K,
482 kcal/kg for potassium at 1052° K, and
69 kcal/kg for mercury at 629.7° K;

is surrendered by the gaseous metal to the walls of the heater 16 and the hotter end of the regenerator 15. The thermal energy is then transferred to the working medium by conduction through the walls of 15 and 16. The condensed liquid metal returns to the recuperator components 36 by flow, due to capillary and gravitational action, through a porous wick 89 lining the heat pipe 23 and the lower part of the heater 16.

Thermal energy is removed from the hydrogen or helium working medium of the hot-gas unit shown in FIG. 7 by the processes of (1) conduction through the walls of the compression space 85 and the walls of the cooler 88, and (2) inelastic collisions of the molecules of the gaseous working medium with the matrix 53 inside regenerator 22. Waste thermal energy is removed from the hot-gas unit and from the internal-combustion unit (FIG. 4) of the compound engine by convection of the liquid coolant 39.

The range of the angular position $\alpha_n$ of the $n^{th}$ connecting-rod journal (78) for one complete cycle of the hot-gas unit of FIG. 7 is from 0 to $2\pi$ radians, i.e., a two-stroke hot-gas cycle. The working medium occupies a cyclically variable total volume $$V_t = V_c + V_e + V_d, \quad (3)$$

wherein $V_c$ and $V_e$ are cyclically variable volumes of a cool compression space 85 and an interconnected hot expansion space 86, respectively, and $V_d$ is a fixed dead-space volume in the regenerator 15, and in duct 87 through the cooler 88 and heater 16. For the triad of interconnected hot-gas units of this first preferred embodiment of the compound engine the cyclical variations in $V_e$ lead those in an interconnected volume $V_c$ by $\pi/3$ radians.

To describe the full cycle of the hot-gas unit of the first embodiment of the compound engine, we restrict attention to the cool compression space 85''' in block unit A of FIG. 27 which is interconnected via a duct 87'' through regenerator 15'' to the hot-expansion space 86'' in block unit C of FIG. 27. We remember that block units A and C of FIG. 27 each represent a double-acting hot-gas unit of the type shown in FIG. 7. We designate the double-acting piston 84''' in unit A as "*c*" (cool compression space) and the double-acting piston 84'' in unit C as "*e*" (hot expansion space). The schematic for the relative placement of connecting-rod journals on 11 and the direction of rotation of crankshaft 11 are shown in FIG. 31. We thus note that $\alpha_c = \alpha_e + 2\pi/3$, where the subscripts *c* and *e* are as defined in the preceding sentence. When the piston associated with the $n^{th}$ connecting-rod journal is at TDC we choose $\alpha_n = 0$. Minimum and maximum total volumes $V_t$ occur when the trigonometric relation $\sin \alpha_c = \sin \alpha_e$ is satisfied; the minimum of $V_t$ thus occurs when the angular position of the crankshaft is 60 $_c = 5\pi/6$ and $\alpha_e = \pi/6$, and the maximum of $V_t$ occurs when $\alpha_c = 11\pi/6$ and $\alpha_e = 7\pi/6$.

As the crankshaft shown schematically in FIG. 31 rotates counter clockwise from $\alpha_c = 0$ and $\alpha_e = 4\pi/3$ through the first one-quarter of the cycle to $\alpha_c = \pi/2$ and $\alpha_e = 11\pi/6$, piston 84''' moves downward from TDC and piston 84'' moves upward to within $\pi/6$ of TDC. A portion of the working medium is thus forced both from the cool compression space 85''' below piston 84''' and from the hot expansion space 86'' above piston 84''. During this initial one-quarter of the cycle the working medium is being compressed into the dead space volume $V_d$ in cooler 88 and duct 87'' through the regenerator 15'' and heater 16''.

During the second one-quarter of the cycle the crankshaft 11 continues counter clockwise rotation from $\alpha_c = \pi/2$ and $\alpha_e = 11\pi/6$ to $\alpha_c = \pi$ and $\alpha_e = \pi/3$. Piston 84''' is at BDC when $\alpha_c = \pi$ and piston 84'' is at TDC when $\alpha_e = 0$ (i.e. $2\pi$). Compression of the working medium into the dead space volume $V_d$ continues as the crankshaft 11 rotates from $\alpha_c = \pi/2$ and $\alpha_e = 11\pi/6$ to $\alpha_c = 5\pi/6$ and $\alpha_e = \pi/6$ at which $V_t$ is a minimum. Expansion of the working medium into the hot expansion space 86'' above piston 84'' then occurs as the crankshaft 11 rotates from $\alpha_c = 5\pi/6$ and $\alpha_e = \pi/6$ to $\alpha_c = \pi$ and $\alpha_e = \pi/3$. The working medium acquires thermal energy from the regenerator matrix 53'' and the heater 16'' during the second quarter of the cycle.

During the third one-quarter of the cycle the crankshaft 11 rotates from $\alpha_c = \pi$ and $\alpha_e = \pi/3$ to $\alpha_c = 3\pi/2$ and $\alpha_e = 5\pi/6$. Piston 84''' moves upward from BDC at $\alpha_c = \pi$, and piston 84'' moves downward to within $\pi/6$ of BDC. The working medium expands into the cool compression space 85''' below piston 84''' and into the hot expansion space 86'' above piston 84''. During this expansion thermal energy moves to the working medium from the regenerator matrix 53'' and the heater 16'', and moves from the working medium to the cooler 88'' and then to the liquid coolant 39.

During the final one-quarter of the cycle the crankshaft 11 rotates from $\alpha_c = 3\pi/2$ and $\alpha_e = 5\pi/6$ to $\pi_c = 2\pi$ and $\alpha_e = 4\pi/3$. The working medium continues to expand as the crankshaft 11 rotates from $\alpha_c = 3\pi/2$ and $\alpha_e = 5\pi/6$ to $\alpha_c = 11\pi/6$ and $\alpha_e = 7\pi/6$ at which $V_t$ is a maximum. The working medium is compressed as the crankshaft 11 rotates from $\alpha_c = 11\pi/6$ and $\alpha_e = 7\pi/6$ to $\alpha_c = 2\pi$ and $\alpha_e = 4\pi/3$.

The net torque (Newton meter) delivered to crankshaft 11 during the entire cycle is positive provided sufficient thermal energy is supplied to the working medium by the heaters 16', 16'', and 16'''. Because the pistons 84', 84'', and 84''' of the hot-gas means are double-acting the net torque delivered by the triad of hot-gas units is always a positive constant value plus or minus an oscillatory variation about the positive constant. The continuous net positive torque output is caused by the double-acting pistons 84', 84'', and 84''' being alternately forced from both above and below by the working media above and below the pistons. Superimposed on this net torque delivered to 11 by the hot-gas means is the net positive torque delivered to 11 by the internal-combustion means.

SECOND PREFERRED EMBODIMENT

Figure 9:
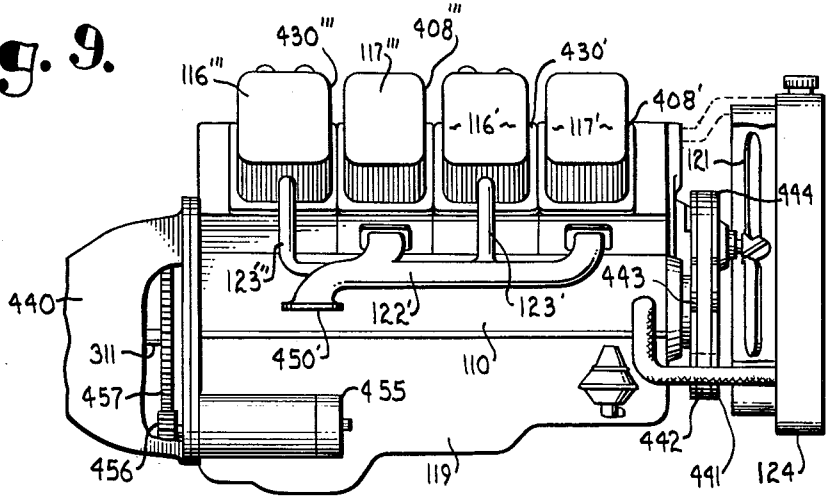
FIG. 9 relates to FIGS. 8, 19, 11, 12, 14, 38, and 39 and is a side elevation of an embodiment of an eight-cylinder vee compound engine including engine casting, recuperator, heat pipes, and exhaust gas outlet.
Figure 10:
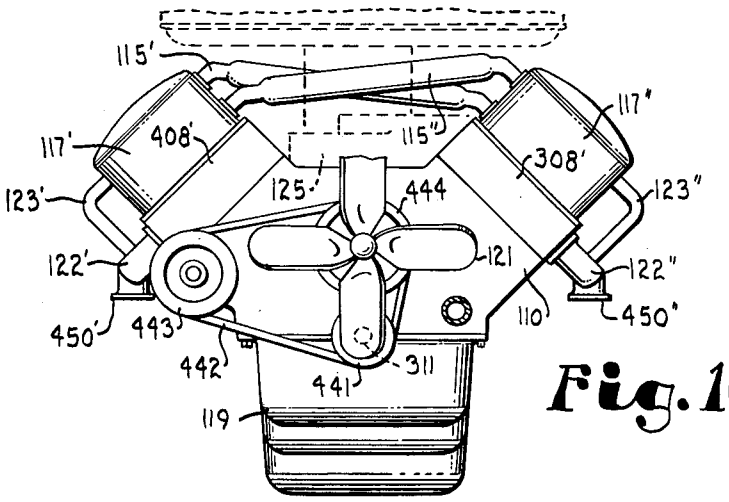
FIG. 10 relates to FIGS. 8, 9, 11, 12, 14, 38, and 39 and is a front elevation of an embodiment of an eight-cylinder vee compound engine including engine casting, an intake manifold (dashed lines), cooling fan, and an inlet for liquid coolant.
Figure 8:
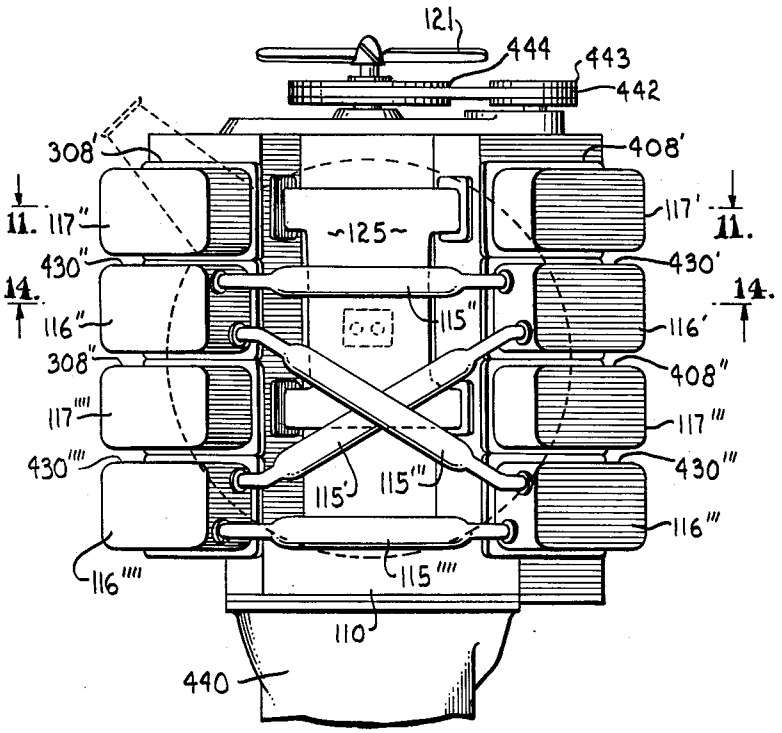
FIG. 8 relates to FIGS. 9, 10, 11, 12, 14, 38, and 39 and is a top elevation of an embodiment of an eight-cylinder vee compound engine including engine casting wherein four cylinders interconnected by regenerators each contain a piston operating in the double-acting hot-gas mode, four cylinders each contain a piston operating in the internal-combustion mode, and wherein the eight pistons are connected by separate connecting rods to a single crankshaft.
Figures 11, 12:
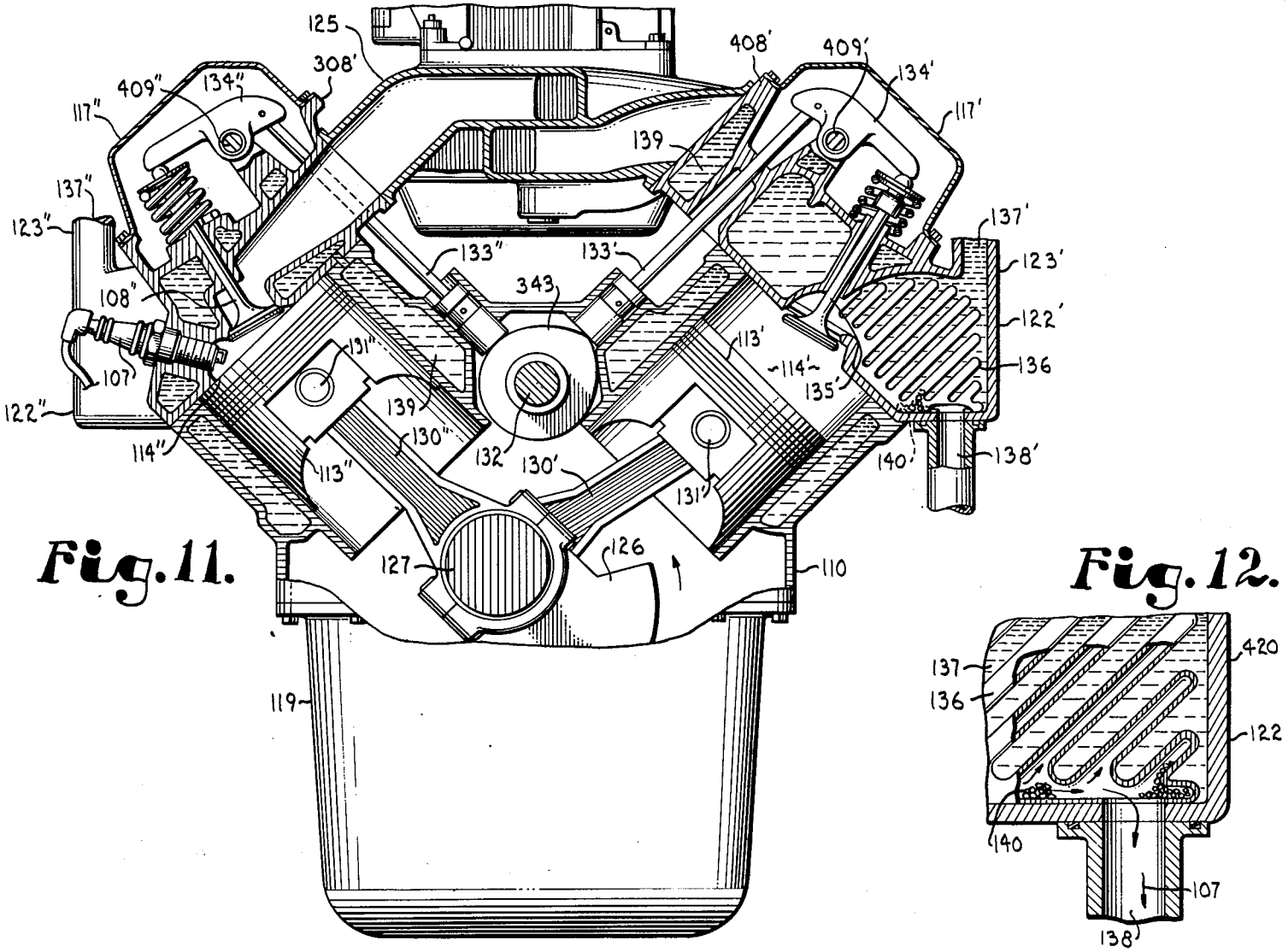
FIG. 11 relates to FIGS. 8, 9, 10, 12, 13, 14, 19, 28, 30, 38, 48, 50, 52, 60, and 62 and is a cross sectional view of an embodiment of an internal-combustion unit for vee compound engines including engine casting, crankshaft lobe, connecting-rod journal of the crankshaft common to two connecting rods, two connecting rods, two piston pins, two pistons, two cylinders, camshaft, push rods, rocker arms, exhaust valve, intake valve, intake manifold, recuperator, heat pipe, liquid metal in heat pipe, exhaust gas outlet, and liquid coolant.
FIG. 12 relates primarily to FIG. 11, but also relates to FIG. 4, and is a cross-sectional view of an embodiment of the thermal energy recuperator and heat-pipe transfer means for a compound engine including non-conducting thermal housing, liquid metal in heat pipe, hot exhaust gases interacting with highly conducting outer walls of heat pipes and highly conducting matrix inside the recuperator, and an outlet port for cooled exhaust gases.
Figure 14:
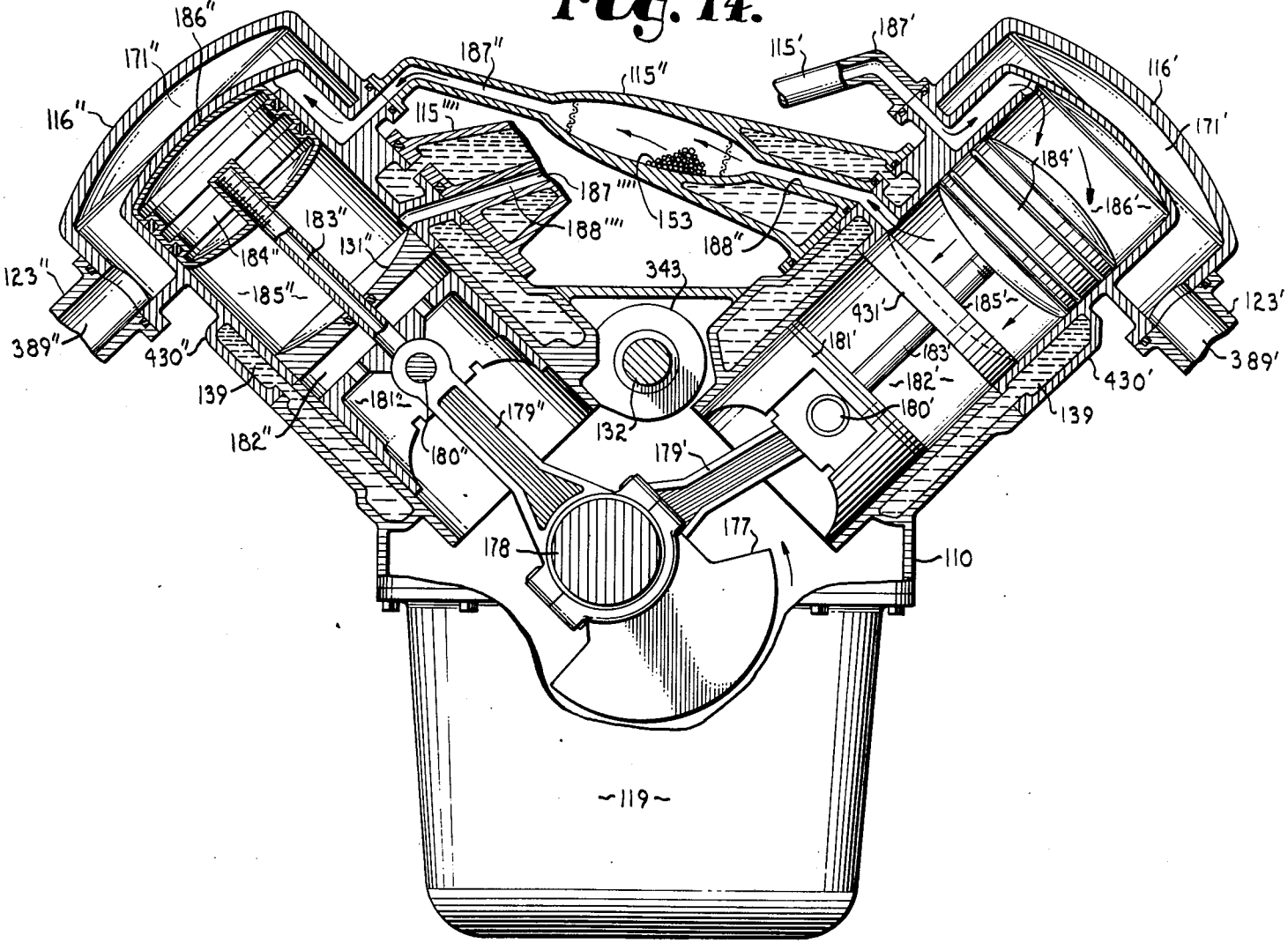
FIG. 14 relates to FIGS. 8, 9, 10, 11, 38, 52, 60, and 62 and is a cross sectional view of an embodiment of a double-acting hot-gas unit for vee compound engines including engine casting, crankshaft lobe, connecting-rod journal of the crankshaft, two primary connecting rods, two piston pins, two guide members, two secondary connecting rods, two double-acting pistons, two cylinders each with upper part as hot expansion space and lower part as cool compression space, regenerator, cooler, heaters, liquid coolant, and camshaft for the internal-combustion means of the compound engine.
Figure 38:
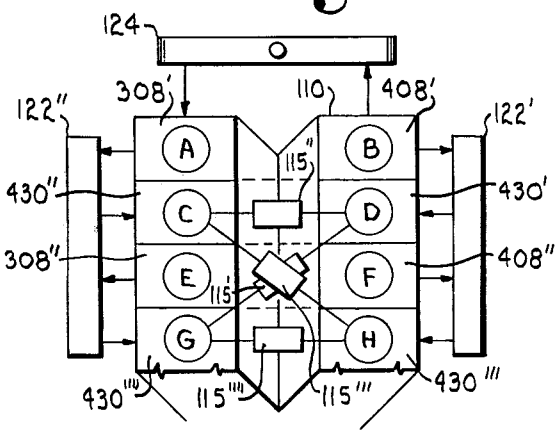
FIG. 38 relates to FIGS. 8, 9, 10, 11, 12, 14, and 39 and is a block diagram of an embodiment of an eight cylinder vee compound engine.

Reference is made to a second basic preferred embodiment comprising an eight cylinder ($\pi/2$)-radian-vee compound internal-combustion hot-gas engine according to the present invention as shown in FIGS. 8, 9, 10, 11, 12, 14, 38, and 39; wherein FIGS. 11 and 14 respectively show in cross section an internal-combustion unit and a hot-gas unit, with said units usable two times each to the top elevation shown in FIG. 8, to the side elevation shown in FIG. 9, to the front elevation shown in FIG. 10, and to the block diagram shown in FIG. 38.

Shown in FIG. 11 is a vee configured internal-combustion unit comprising: an engine casting 110 which is a housing;

- a portion 408 of an engine head mounted on 110;
- a portion 308' of another engine head mounted on 110;
- a crankshaft 311 (FIG. 10) mounted to rotate freely about its axis within the lower part of 110;
- a countermass 126 integral to 311 and for dynamic balancing of said internal-combustion unit;
- a double connecting-rod journal 127 integral to 311;
- a connecting rod 130' having two holes through its sides, with one of said
- holes at each end of 130', and with one end connected rotatably about 127 via one of said holes so as to drive 311 rotatably;
- a piston pin 131' inserted pivotally through said hole in the other end of 130';
- a reciprocative piston 113' having two holes diametrically placed in its sidewalls with the ends of 131' pivotally inserted in said holes;
- a cylinder 114' providing an expansible combustion chamber for a gaseous fuel-air mixture, and in 114' piston 113' moving to and fro when driven by 130' from below and when driven by pressure of the burning fuel-air mixture from above;
- a connecting rod 130'' having two holes through its sides, with one of said holes at each end of 130'', and with one end of 130'' connected rotatably about 127 via one of said holes so as to drive 311 rotatably;
- a piston pin 131'' inserted pivotally through said hole in the other end of 130'';
- a reciprocative piston 113'' having two holes diametrically placed in its sidewalls with the ends of 131'' pivotally inserted in said holes;

a cylinder 114'' providing another expansible combustion chamber (shown closed in FIG. 11) for a gaseous fuel-air mixture, and in 114'' piston 113'' moving to and fro when driven by 130'' from below and when driven by pressure of the burning fuel-air mixture from above;

a camshaft 132 mounted rotatably in the upper mid-section of 110;

a cam 343 integral to 132;

a cam follower 133' free to move to and fro within 110 and 408', and with the lower end of 133' engaging 343;

a rocker arm 134' having a hole off-center through its side, and with the leftmost underside of 134' engaging the upper end of 133';

a shaft 409' mounted within 408' and on which 134' is mounted pivotally, as a lever, via said hole off-center in 134';

an exhaust valve 135' mounted in 408', with one (stem) end of 135' driven by engaging the rightmost underside of 134', and with the other (valve) end of 135' alternately closing and disclosing an exhaust outlet at the top of cylinder 114';

a compression spring 410' acting on 135' so as to close the exhaust outlet at the top of 114';

a cam follower 133'' free to move to and fro within 110 and 308, and with the lower end of 133'' engaging 343;

a rocker arm 134'' having a hole off-center through its side, and with the rightmost underside of 134'' engaging the upper end of 133'';

a shaft 409'' mounted within 308 and on which 134'' is mounted pivotally, as a lever, via said hole off-center in 134'';

an intake valve 108'' mounted in 308', with one (stem) end of 108'' engaging the leftmost underside of 134', and with the other (valve) end of 108'' alternately closing and disclosing an inlet at the top of cylinder 114'';

a compression spring 410'' acting on 108'' so as to close the inlet at the top of 114'';

an intake manifold 125 attached to 308' and 408' thus providing a fuel-air mixture for the internal-combustion unit;

a spark plug 107 operated electrically for igniting the fuel-air mixture in the cylinders; and an oil reservoir 119 attached to the bottom of 110.

Furthermore, the internal-combustion unit shown in FIG. 11 has attached to it two recuperators 122' and 122'', which are mounted respectively on 408 and 308 so as to receive hot exhaust gases issuing from 114' and 114'', respectively, through outlets disclosed by the exhaust valves in the tops of 114' and 114''. An enlarged cross sectional view of a portion of a recuperator is shown in FIG. 12. The recuperator comprises:

a thermal insulated housing 420;

a series of interconnected hollow thermally conductive metal recuperator members 136 mounted inside 420 and sealed so as to exclude the entry of hot exhaust gases into members 136;

a liquid metal 137 occupying the interconnected hollow space interior to members 136;

a thermally conductive granular matrix 140 such as aluminum, copper, or stainless steel in thermal communication with members 136, with 40 loosely filling the space inside 420 and external to members 136, and with 140 contacting hot exhaust gases thus absorbing thermal energy therefrom and conducting said energy to members 136 where said energy vaporizes 137;

heat pipes 123' and 123'' respectively integral to 122' and 122'', with said heat pipes usable to the hot-gas unit shown in FIG. 14, and with hot metal vapor of 137 rising convectively in 123' and 123'' thus transporting thermal energy to the heaters 116' and 116'' of said hot-gas unit; and an outlet 138 for cooled exhaust gases.

The internal-combustion unit also comprises:

valve covers 117' and 117'' attached respectively to 408 and 308; and a liquid coolant 139 flowing in hollow interconnected convention ways within 110, 308, and 408 wherein 139 removes temperature degraded thermal energy from the internal-combustion unit.

The internal-combustion unit operates in either the two-stroke or the four-stroke cycle as described previously herein.

Shown in FIG. 14 is a vee configured double-acting hot gas unit comprising:

an engine casting 110 which is a housing;

a portion 430' of an engine head mounted on the right top of 110;

a portion 430'' of a second engine head mounted on the right top of 110;

a crankshaft 311 (FIG. 10) mounted to rotate freely about its axis within the central lower part of 110;

a countermass 177 integral to 311 and for dynamic balancing of said hot-gas unit;

a double connecting-rod journal 178 integral to 311;

a primary connecting rod 179' having two holes through its sides, with one of said holes at each end of 179', and with one end connected rotatably about 178 via one of said holes, thus driving 311 rotatably;

a pin 180' inserted pivotally through said hole in the other end of 179';

a reciprocative guide member 181' having two holes diametrically placed in its sidewalls with the ends of 180' pivotally inserted in said holes;

a guide cylinder 182' in which 181' moves to and fro when driven from below by 179' or when driven from above;

a secondary connecting rod 183' attached rigidly to the top of 181';

a circular plate 431', which is mounted in the lower region of 430', and wherein 183' moves reciprocatively through a hole centered in 431', and with said hole sealed about 183' so as to prevent the escape of gases from the space above 430' to the space below 430';

a cylindrical double-acting piston 184' whose lower surface is rigidly attached to 183';

a cylindrical cool compression space 185' below 184' and with 184' moving to and fro within 185';

a cylindrical hot expansion space 186' above 184', and with 184' moving to and fro within 186';

a gaseous working medium such as hydrogen or helium filling spaces 185' and 186';

a secondary primary connecting rod 179'' similar to 179';

a second pin 180'' similar to 180';

a second reciprocative guide member 181'' similar to 181';

a second guide cylinder 182'' similar to 182';

a second secondary connecting rod 183'' similar to 183';

a second circular plate 131'', similar to 131', mounted in 430'';

a second cylindrical double-acting piston 184'' similar to 184';

a second cylindrical cool compression space 185'', similar to 185', and below 184'';

a second cylindrical hot expansion space 86'', similar to 186', and above 184'';

a similar gaseous working medium filling spaces 185'' and 186'';

a regenerator 115'' with a duct 187'' therethrough, with 187'' interconnecting spaces 186'' and 185';

a fine granular metal matrix 153 filling 115'', and in thermal communication with the gaseous working medium;

a cooler 188'' integral to 115'' with duct 187'' continuing therethrough;

a heater 116' integral to 430';

a metal vapor 171' inside 116' wherein 171' condenses to a liquid metal on the inner conducting walls of 116' thus surrendering its thermal energy of vaporization to said conducting walls, with said thermal energy being conducted through said conducting wall to the gaseous working medium in 186', and with said condensed liquid metal flowing gravitationally to the lowermost space within 116';

a heat pipe 123' attached to 116', with metal vapor entering 116' via 123', and with 123' usable as described previously herein, to regenerator 122' of the internal-combustion unit shown in FIG. 11.

a porous wick 389' lining 123' and providing a means for capillary flow of condensed liquid metal through 123' to regenerator 122';

a liquid coolant 139 flowing in hollow interconnected convection ways within 110, 430', and 430'', with 139 removing temperature degraded thermal energy from the hot-gas unit, and with 139 also usable to the internal-combustion unit shown in FIG. 4 as described previously herein;

a second heater 116'', similar to 116', and integral to 430'';

a second metal vapor 171'', similar in composition and function to 171', and inside 116'';

a second heat pipe 123'', similar to 123', and attached to 116'' and with 123'' usable, as described previously herein, to regenerator 122'' of the internal-combustion unit shown in FIG. 11;

a second porous wick 389'', similar to 389', and lining 123''. Further interconnections of expansible spaces 185 and 186 are described in greater detail hereinafter.

FIG. 8 is a top elevation of the second preferred embodiment of a compound internal-combustion hot-gas engine wherein are shown:

an internal-combustion means comprised of two of the internal-combustion units of the type shown in FIG. 11 and previously described herein;

a hot-gas means comprised of two of the hot-gas units of the type shown in FIG. 14 and previously described herein;

an engine casting 110 which is a housing for both said means;

an engine head comprising 408', 430', 408''', and 430''' attached to the right top of 110;

a second engine head comprising 308', 430'', 308'', and 430'''' attached to the left top of 110;

four valve covers 117', 117'', 117''', and 117'''' respectively mounted on 408', 308', 408''' and 308'';

four heaters 116', 116'', 116''', and 116'''' respectively integral to 430', 430'', 430''', and 430'''' and with said heaters usable to the hot-gas means;

a first regenerator 115' attached at one end to 116' and attached at the other end to 430'''';

a second regenerator 115'' attached at one end to 116'' and attached at the other end to 430';

a third regenerator 115''' attached at one end to 116''' and attached at the other end to 430'';

a fourth regenerator 115'''' attached at one end to 116'''' and attached at the other end to 430''';

an intake manifold 125 supplying a fuel-air mixture to the internal-combustion means;

a housing 440 mounted on the rear of 110;

a pulley 443 mounted rotatably on the front of 110;

a belt 442 engaging 443;

a second pulley 444 mounted rotatably on the front of 110, and with 443 engaging belt 442; and a fan 121 mounted on 444.

Each of the four regenerators has a separate duct 187 therethrough thus interconnecting a cool compression space 185 below a double-acting piston 184 to a hot expansion space 186 above another double-acting piston.

FIG. 9 is a side elevation of the second preferred embodiment of a compound internal-combustion hot-gas engine wherein are shown:

an engine casting 110 which is a housing;

an engine head comprised of 408', 430', 408''', and 430''' mounted on 110;

two valve covers 117' and 117''' mounted respectively on 408' and 408''';

two heaters 116' and 116''' respectively integral to 430' and 430''';

a recuperator 122' attached to 408' and 408''' so as to receive hot exhaust gases from two of the four expansible cylindrical combustion chambers of the internal-combustion means;

first and third heat pipes 123' and 123''' integral at one end to 122' and attached respectively at the other end to heaters 116' and 116''', and thus transferring thermal energy from the recuperator 122' to heaters 116' and 116''';

an outlet 450' for thermally degraded exhaust gases to leave 122';

an oil reservoir 119 attached to the lower part of 110;

a housing 440 attached at the rear of 110;

a flywheel gear 457 centered on and attached to an end of crankshaft 311 which protrudes at the rear of 110 into the space enclosed by 440;

a starter 455 mounted on 110, and with 455 operated electrically;

a starter gear 456 engaging flywheel gear 457 so as to rotate 457 and 311 when satrter 455 is active;

a pulley 441 centered and mounted on the other end of 311 so as to rotate with 311;

a belt 442 engaging and being driven by 441;

a second pulley 443 mounted rotatably on the front of 110, and with 443 driven by engaging 442;

a third pulley 444 mounted rotatably on the front of 110, and with 444 driven by engaging 442;

a fan 121 mounted on 444 so as to rotate with 444;

a radiator 124 which transfers thermally degraded thermal energy from the liquid coolant to the ambient atmosphere; and two hoses 460 and 461 connecting radiator 124 with separate liquid coolant ports in 110.

FIG. 10 is a front elevation of the second preferred embodiment of a compound internal-combustion hot-gas engine wherein are shown:

an engine casting 110 which is a housing;

a first engine head comprised of 308', 430'', 308'', and 430'''' of which 308' is shown;

a second engine head comprised of 408', 430', 408''', and 430''' of which 408' is shown;

two valve covers 117' and 117'' attached respectively to 408' and 308';

two regenerators 122' and 122'' where 122'' is connected to the first engine head in a manner similar to which, as previously described, 122' is connected to the second engine head;

a second heat pipe 123'' with one end integral to 122'', and with the other end attached to heater 116'';

a fourth heat pipe 123'''' (not shown explicitly in the drawings) with one end integral to 122'', with the other end attached to heater 116'''', and with the function of 123'' and 123'''' similar to that previously described for 123' and 123''';

regenerators 115' and 115'' as described previously herein;

outlets 450' and 450'' for thermally degraded exhaust gases to leave 122' and 122'', respectively;

an oil reservoir 119 attached to the bottom of 110;

a crankshaft 311 mounted rotatably within the lowermost portion of 110 so that one end protrudes at the front of 110;

a first pulley 441 centered and mounted rigidly on the end of 311 protruding from the front of 110, and so that 441 rotates with 311;

an endless belt 442 engaging and driven by pulley 441;

a second pulley 443 mounted rotatably on the front of 110, and with 443 driven by engaging belt 442;

a third pulley 444 mounted rotatably on the front of 110, and with 444 also driven by engaging belt 442;

a fan 121 mounted on pulley 444 so that 121 rotates when 444 is driven by engaging belt 442.

The camshaft 132, of the compound engine according to this second preferred embodiment, is driven by a means similar to that described for the first embodiment of a compound engine wherein (referring to FIGS. 10 and 2) said means comprises:

a first gear 240 centered and mounted rigidly on crankshaft 311 so that 240 rotates with 311;

a second gear 223 mounted rotatably within 110 so as to engage and be driven by first gear 240;

an endless chainbelt 231 driven by engaging 232; and a third gear 230 centered and mounted rigidly on camshaft 132 so as to rotate with 132, and with 231 engaging and being driven rotatably by chainbelt 231. The means for driving camshaft 132 is not shown explicitly in the drawings related to the second preferred embodiment of a compound engine because of its similarity to that means depicted in FIG. 2 which is related to the first embodiment of a compound engine. Throughout the remainder of this patent application "a means to drive a camshaft" shall refer to a means similar to that described in this paragraph. The gear ratios may be chosen so that the camshaft rotates at either (1) one-half the angular speed of the crankshaft as required for the four-stroke internal-combustion cycle, or (2) the same angular speed of the crankshaft as required for the two-stroke internal-combustion cycle.

FIG. 38 is a block diagram of the compound internal-combustion hot-gas engine according to the second preferred embodiment. The two pairs of block units AB and EF each represent an internal-combustion unit of the type shown in cross section in FIG. 11. The internal-combustion means is thus represented by blocks ABEF. The two pairs of blocks CD and GH each represent a hot-gas unit of the type shown in cross section in FIG. 14. The hot-gas means is thus represented by blocks CDGH. Each of the eight circles represents an expansible cylinder for either the internal-combustion means (four circles ABEF) or the hot-gas means (four circles CDGH). Block units 115', 115'', 115''', and 115'''' each represent a regenerator of the type previously desccribed and so designated herein. Block units 122' and 122'' each represent a recuperator as previously described and so designated herein. The notations 408', 430', 408'', 308', 430'', 308'', and 430'''' in FIG. 38 relate to members so designated in FIGS. 8, 9, 10, 11, and 14. The two arrows between 110 and 124 in FIG. 38 represent the flow of liquid coolant 139 to and from the compound engine and its radiator 124. The other arrows in FIG. 38 designate the direction of flow of thermal energy from exhaust gases issuing from the internal-combustion means (ABEF) to recuperators 122' and 122'', and then via heat pipes (previously designated 123', 123'', 123''', and 123''''), or by conduction thermal energy is transferred to the heaters (previously designated 116', 116'', 116''', and 116'''') of the hot-gas means (CDGH).

Figure 39:
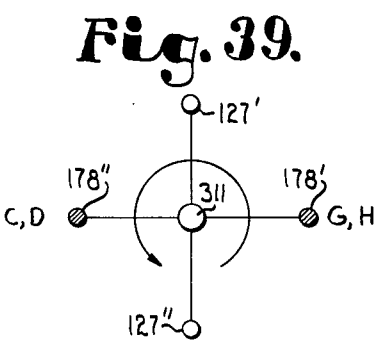
FIG. 39 relates to FIGS. 8, 9, 10, 11, 14, and 38 and is an end-on schematic diagram of the configuraion and corresponding direction of rotation of the crankshaft for an embodiment of an eight cylinder vee compound engine.

FIG. 39 is an end-on schematic diagram of the relative placement of the four connecting-rod journals on a crankshaft usable to the second preferred embodiment of a compound engine. The notations C, D, G, H in FIG. 39 relate to similar notations in FIG. 38. The unshaded circle 311 central to FIG. 39 relates to the axial shaft of crankshaft 311. The two unshaded circles 127' and 127'' each relate to a separate connecting-rod journal 127 of an internal-combustion unit of the type shown in FIG. 11. The two shaded circles 178' and 178'' each relate to a separate connecting-rod journal 178 of a hot-gas unit of the type shown in FIG. 14. The circular arrow in FIG. 39 coincides with similar shorter arrows adjacent to countermass 126 in FIG. 11 and countermass 177 in FIG. 14, and designates the counter clockwise rotation of crankshaft 311. Connecting-rod journals 127', 178', 127'', and 178'' on 311 are separated by an angular displacement of $\pi/2$radians.

Each hot expansion space 186 (FIG. 14) above a double-acting piston 184 is interconnected via a duct 187 through a heater 116, regenerator 115, and cooler 188 to only one cool compression space 185 below another double-acting piston. The gaseous helim or hydrogen working medium thus communicates between spaces 186 and 185. Referring to FIGS. 14 and 8, and to the block diagram of FIG. 38, the interconnections for a compound engine according to the second preferred embodiment are:

cool space 185' of D interconnected via 115'' to hot space 186'' of C, cool space 185'' of C interconnected via 115''' to hot space 186''' of H, cool space 185''' of H interconnected via 115'''' to hot space 186'''' of G, and cool space 185 '''' of G interconnected via 115' to hot space 186' of D. The crankshaft 311 rotates counter clockwise when viewed from the rear of the engine. Due to (a) the relative placement of 178' and 178'' on 311, (b) to said interconnections of spaces of the type 185 and 186, (c) the direction of rotation of 311, (d) an intrinsic angular phase difference of $\pi$ radians between spaces above and below a double-acting piston 184 and (e) to the $(\pi/2)$-radian vee; cyclic variations in the volume $V_e$ of a hot expansion space 186 lead those in the volume $V_c$ of an interconnected cool compression space 185 by $\pi/2$ radians. When variations in $V_e$ lead those in $V_c$ by less than $\pi$ radians the hot-gas means operates as an engine.

The hot-gas means will also operate as a refrigerator when the interconnections are the following:

hot space 186' of D interconnected via 115'' to cool space 185'' of C, hot space 186'' of C interconnected via 115''' to cool space 185''' of H, hot space 186''' of H interconnected via 115'''' to cool space 185'''' of G, and hot space 186 '''' of G interconnected via 115' to cool space 185' of D; where the crankshaft 311 rotates in the counter clockwise direction as previously described herein. Cyclic variations in $V_e$ then lag those in $V_c$ by $\pi/2$ radians. Hot-gas refrigerator means have heaters 116 replaced by coolers.

We now describe the closed thermodynamic (Stirling) cycle for the $(\pi/2)$-radian-vee double-acting hot-gas means of the second preferred embodiment of a compound engine according to the present invention. Reference is made to FIG. 14, and attention is restricted to the cool compression space 185' below the active piston 184', on the right-hand side of FIG. 14, which is interconnected by the duct 187'' through the regenerator 115'' to the hot expansion space 186'' above the active piston 184'', on the left-hand side of FIG. 14. Referring simultaneously to FIGS. 14 and 38, we are describing the cool space 185' of D that is interconnected to the hot space 186'' of C, or the cool space 185''' of H that is interconnected to the hot space 186'''' of G. A discussion similar to that which follows also applies to the other two pairs of interconnected spaces.

The description of the cycle begins herein with the crankshaft 311 in the position shown in FIG. 14. We utilize Eq. 1 and the nomenclature following thereafter, except $\alpha_c$ and $\alpha_e$ shall respectively refer to double-acting pistons 184' and 184''. The angular positions (see Eq. 1) at the beginning of the cycle are thus $\alpha_e = 0$ and $\alpha_c = \pi/2$, wherein again subscripts $e$ and $c$ refer to double-acting pistons 184'' and 184' of FIG. 14, respectively. Values for $\alpha$ are specified in radians. Eq. 3 also applies to this preferred embodiment of the compound engine. Although $\alpha_c = \alpha_e + \pi/2$, variations in the volume $V_e$ of the hot expansion space 186'' lead variations in the volume $V_c$ of the cool compression space 185' by $\pi/2$ radians, because of the intrinsic phase difference of $\pi$ radians between volumes above and below an active piston 184. During a complete cycle $\alpha_e$ and $\alpha_c$ change continuously by $2\pi$ radians. Minimum and maximum values of $V_t$ occur when $\sin \alpha_e = \sin \alpha_c$; minimum $V_t$ occurs when $\alpha_e = \pi/4$ and $\alpha_c = 3\pi/4$, and maximum $V_t$ occurs when $\alpha_e = 5\pi/4$ and $\alpha_c = 7\pi/4$.

During the initial one-quarter of the cycle the crankshaft rotates counter clockwise from $\alpha_e = 0$ and $\alpha_c = \pi/2$ and $\alpha_e = \pi$. The left piston 184'' moves downward from TDC, and the right piston 184' moves downward to BDC when $\alpha_c = \pi$. The gaseous working medium is compressed from the cool compression space 185' below the right piston 184', through the duct 187'' in the cooler 188'' and regenerator 115'', and expands into the hot expansion space 186'' above the left piston 184''. During this part of the cycle the working medium reaches a minimum $V_t$ when $\alpha_e = \pi/4$ and $\alpha_c = 3\pi/4$ and also acquires thermal energy from the matrix 153 of the regenerator 115'' and from the heater 116'' on the left.

During the second one-quarter of the cycle the crankshaft continues to rotate counter clockwise from $\alpha_e = \pi/2$ and $\alpha_c = \pi$ to $\alpha_e = \pi$ and $\alpha_c = 3\pi/2$. The left piston 184'' moves downward to BDC when $\alpha_e = \pi$. The right piston 184' moves upward from BDC to a position similar to that shown in FIG. 14. The working medium expands out of the regenerator 115'' into both the cool compression space 185' where it is cooled and into the hot expansion space 186'' where it is heated.

During the third one-quarter of the cycle the crankshaft rotates counter clockwise from $\alpha_e = \pi$ and $\alpha_c = 3\pi/2$ to $\alpha_e = 3\pi/2$ and $\alpha_c = 2\pi$. The working medium continues to expand out of the regenerator 115'' into spaces 185' and 186'' until maximum volume $V_t$ is reached when $\alpha_e = 5\pi/4$ and $\alpha_c = 7\pi/4$. Compression of the working medium is then begun as the crankshaft rotates from $\alpha_e = 5\pi/4$ and $\alpha_c = 7\pi/4$ to $\alpha_e = 3\pi/2$ and $\alpha_c = 2\pi$. The right position 184' is at TDC when $\alpha_c = 2\pi$. As the working medium is compressed it transfers thermal energy to the matrix 153 of the recuperator 115'' and to the cooler 188''. Degraded thermal energy is transferred from the cooler 188'' by the liquid coolant 139 to the radiator 124 and then to the ambient environment.

During the final one-quarter of the cycle the crankshaft rotates counter clockwise from $\alpha_e = 3\pi/2$ and $\alpha_c = 2\pi$ to $\alpha_e = 0$ and $\alpha_c = \pi/2$. The working medium is compressed into the regenerator 115'' where it again begins to acquire thermal energy from the matrix 153. The left piston 184'' is at TDC when $\alpha_e = 2\pi$. The cycle now begins another repetition.

The net torque (Newton meter) delivered to crankshaft 11 during the entire cycle is positive provided sufficient thermal energy is supplied to the working medium by the heaters 116', 116'', 116''' and 116''''. Because the pistons 184', 184'', 184''' and 184'''' of the hot-gas means are double-acting, the net torque delivered to 311 by the quartet of hot-gas pistons and their respective connecting rods is always a positive constant value plus or minus an oscillatory variation about the positive constant. The continuous net positive torque output is caused by the double-acting pistons 184', 184'', 184''' and 184'''' being alternately forced from both above and below by the working medium above and below these pistons. Superimposed on this net torque delivered to 311 by the hot-gas means is the net positive torque delivered to 311 by the internal-combustion means.

Throughout the remainder of this patent application the term "embodiment" shall refer to a "preferred embodiment" of the compound internal-combustion hot-gas engine.

THIRD PREFERRED EMBODIMENT

Figure 5:
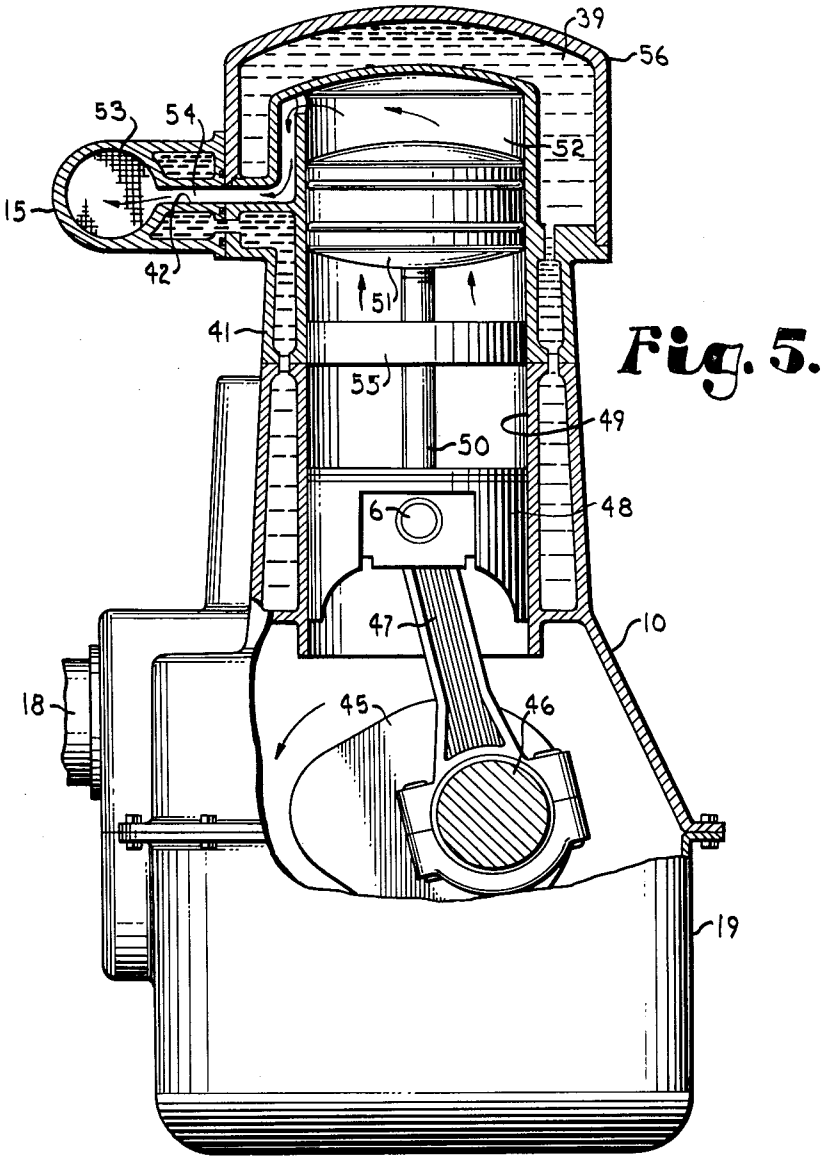
FIG. 5 relates to FIGS. 4, 6, 15, 17, 21, 24, 34, and 42 and is a cross sectional view of an embodiment of a cool-compression-cylinder single-acting hot-gas unit for linear compound engines; included are engine casting, crankshaft lobe, connecting-rod journal of the crankshaft, primary connecting rod, piston pin, guide member, secondary connecting rod, single-acting piston, cool cylinder, cooler, liquid coolant, regenerator, and matrix for regenerator.
Figure 6:
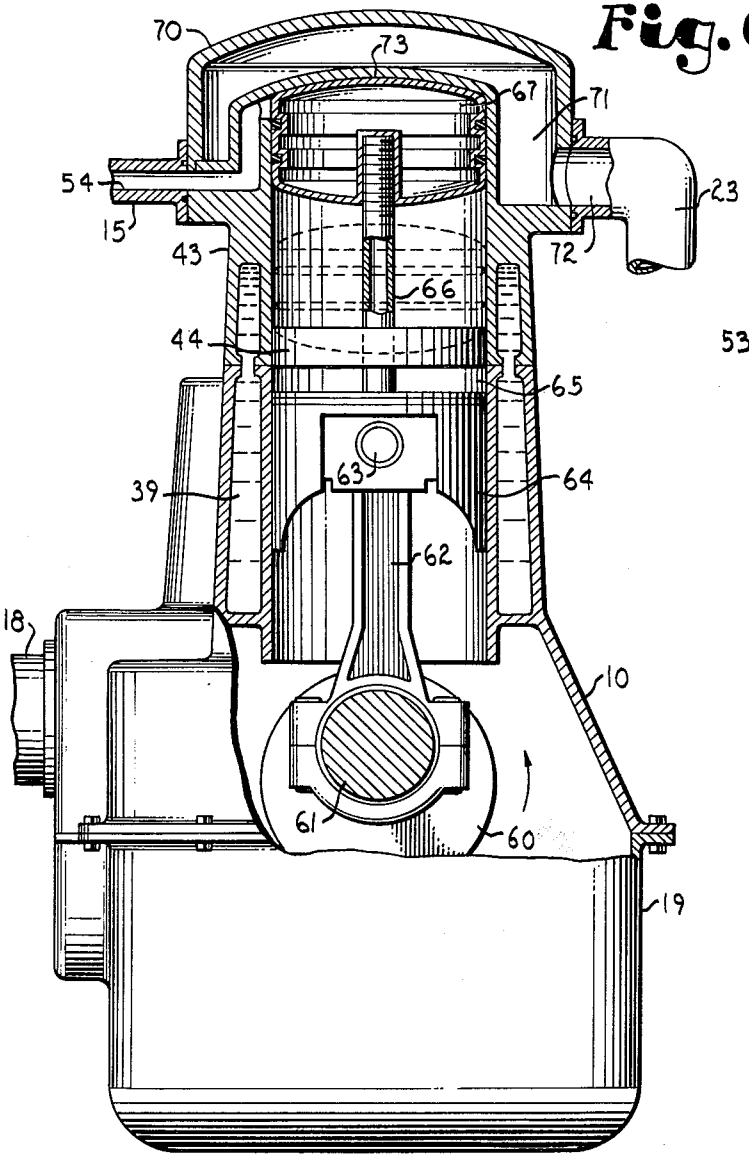
FIG. 6 relates to FIGS. 4, 5, 15, 17, 21, 24, 34, and 42 and is a cross sectional view of an embodiment of a hot-expansion-cylinder single-acting hot-gas unit for linear compound engines; included ar engine casting, crankshaft lobe, connecting-rod journal of the crankshaft, primary connecting rod, piston pin, piston pin, guide member, secondary connecting rod, single-acting piston, hot-cylinder means, heater, liquid coolant, regenerator, and matrix for regenerator.
Figure 15:
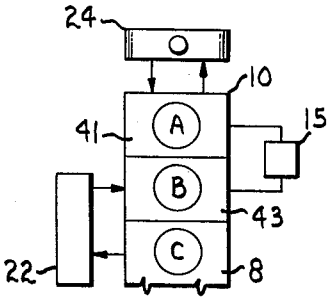
FIG. 15 relates to FIGS. 4, 5, 6, and 16 and is a block diagram of an embodiment of a three cylinder linear compound engine.
Figure 16:
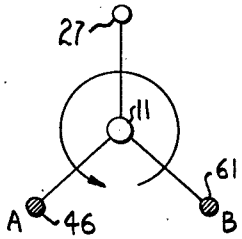
FIG. 16 relates to FIGS. 4, 5, 6, and 15 and is an end-on schematic diagram of the configuration and corresponding direction of rotation of the crankshaft for an embodiment of a three cylinder linear compound engine.

Reference is made to a third basic preferred embodiment comprising a three cylinder linear compound internal-combustion hot-gas engine according to the present invention as shown in FIGS. 4, 5, 6, 15, and 16;

wherein FIGS. 4, 5, and 6 respectively show in cross section an internal-combustion unit, a single-acting cool-space hot-gas unit, and a single-acting hot-space hot-gas unit, with said units usable once each to the block diagram of FIG. 15 and to the schematic diagram of FIG. 16.

The internal-combustion unit shown in FIG. 4, and its functions, were presented here in the description of the first preferred embodiment of a compound engine. The interconnections are the same here, except that the heat pipe 23 integral to recuperator 22 is here usable to the heater 16 of the hot-space hot-gas unit shown in FIG. 6. The internal-combustion means of this preferred embodiment is comprised of one internal-combustion unit of the type shown in FIG. 4. The internal-combustion means operates in either the two-stroke or four-stroke cycle. The two stroke cycle, however, is preferred for the third embodiment of a compound engine.

Shown in FIG. 5 is a cross sectional view of a cool-space hot-gas unit comprising:

an engine casting 10 which is a housing;

a crankshaft 11 (FIG. 16) mounted to rotate about its axis in the lower portion of 10;

a countermass 45 integral to 11, and with 45 providing dynamic balancing to said cool-space hot-gas unit;

a connecting-rod journal 46 integral to 11;

a primary connecting rod 47 having two holes through its sides, with one of said holes at each end of 47, and with one end of 47 connected rotatably about 46 via one of said holes so as to drive or be driven by 11;

a pin 6 inserted pivotally through said hole in the other end of 47;

a guide member 48 having two holes diametrically placed in its sidewalls with the ends of 6 inserted pivotally in said holes so that 48 either drives or is driven by 47;

a guide cylinder 49 in which 48 moves reciprocatively when driven from below by 47 or when driven from above by another member;

a secondary connecting rod 50 fixed rigidly at the top center of 48 and thus either driving 48 or being driven by 48;

a portion 41 of an engine head mounted on the top of 10;

a circular plate 55 mounted inside the lower part of 41, wherein 50 moves reciprocatively in a hole centered in 55, and with said hole sealed around 50 so as to prevent communication of gases above and below 55;

a cylindrical single-acting piston 51 whose lower surface is rigidly attached to 50 so that 51 either drives or is driven by 50;

a cylindrical cool compression space 52 within 41 and above 51, and with 52 made expansible by reciprocative motion of 51 within 52;

a gaseous working medium such as hydrogen or helium filling 52;

a cooler 56 with hollow walls integral to 41 and with a duct 54 isolated therethrough one side leading to space 52;

a liquid coolant 39 flowing within the hollow walls of 41 and within hollow convection ways in the walls of 10;

a regenerator 15 attached at one end to cooler 56 with duct continuing through 15, and with the other end of 15 usable to the hot-space hot-gas unit shown in FIG. 6;

a second cooler 42 integral to the end of 15 that is attached to 56, and with duct 54 continuing through 42;

a fine metal wire matrix 53 filling duct 54 within 15 and 42 so as to thermally communicate with the gaseous working medium flowing regeneratively through duct 54;

an oil reservoir 19 attached to the bottom of 10 so as to further house crankshaft 11;

an oil filter 18 attached to 10; and the liquid coolant 39 within convection ways in 41 and 10.

Shown in FIG. 6 is a cross sectional view of a hot-space hot-gas unit comprising:

an engine casting 10 which is a housing;

a crankshaft 11 (FIG. 16) mounted to rotate about its axis in the lower center portion of 10;

a countermass 60 integral to 11, and with 60 providing dynamic balance for said hot-space hot-gas unit;

a connecting-rod journal 61 integral to 11;

a primary connecting rod 62 having two holes through its sides, with one of said holes at each end of 62, and with 62 connected rotatably about 61 via one of said holes in the end of 62 so as to alternately drive or be driven by 11;

a pin 63 inserted pivotally on center through said hole at the other end of 62;

a guide member 64 having two holes diametrically placed in its sidewalls with the ends of 63 inserted pivotally in said holes so that 64 either drives or is driven by 62;

a secondary connecting rod 66 whose lower end is attached rigidly to the central upper surface of 64 so that 66 either drives or is driven by 64;

a portion 43 of an engine head mounted on the top of 10;

a circular disk 44 mounted inside the lower part of 43, and wherein 66 moves reciprocatively within a hole centered in 44, and with said hole sealed about 66 so as to prevent the communication of gases above and below 44;

a single-acting piston 67 whose lower surface is attached rigidly to the upper end of 66 so that 67 is either driven by or drives 66;

a heater 70, with hollow walls, integral to 43 and with duct 54 therethrough one side of 70;

a cylindricl hot expansion space 73 (shown closed in FIG. 6) within 43 and above 67, with 73 made expansible by reciprocative motion of 67 within 73, and with duct 54 ending in 73;

a regenerator 15 with one end attached to heater 70 with duct 54 continuing through 15, and with the other end of 15 attached and usable to the cool-space hot-gas unit shown in FIG. 5;

a metal vapor 71 inside the hollow conducting walls of 70, wherein 71 condenses to liquid metal on said conducting walls of 70 thus surrendering its thermal energy of vaporization to said conducting walls, with said thermal energy being conducted through said conducting walls to the gaseous working medium filling hot expansion space 73, and with said condensed liquid metal flowing gravitationally to the lower most space within 70;

a heat pipe 23 attached about an opening on the side of 70, with hot metal vapor entering 70 via 23, and with 23 usable to recuperator 22 of the internal-combustion unit shown in FIG. 4;

a porous wick 72 lining 23 and providing a means for capillary flow of condensed liquid metal through 23 to recuperator 22 attached to the internal-combustion unit of FIG. 4;

an oil reservoir 19 attached to the bottom of 10 thus further housing crankshaft 11;

an oil filter 18 attached to 10; and liquid coolant 39 within convection ways in 10 and 43.

FIG. 15 is a block diagram of a compound engine according to the third preferred embodiment. Block unit A represents a cool-space hot-gas unit of the type shown in FIG. 5. Block unit B represents a hot-space hot-gas unit of the type shown in FIG. 6. The hot-gas means thus comprises one each of the hot-gas units shown in FIGS. 5 and 6. Block unit C represents an internal-combustion unit of the type shown in FIG. 4 which comprises the internal-combustion means for the third preferred embodiment. Notations 8, 41, and 43 in FIG. 15 relate to portions of the engine head so noted in FIGS. 4, 5, and 6, respectively. Block unit 22 represents the recuperator. Block unit 15 represents the regenerator. Block unit 10 represents the engine casting, and block unit 24 represents the radiator. The three circles in FIG. 15 each represent a cylinder within the compound engine. The two arrows between 10 and 24 represent the flow of liquid coolant 39 from the compound engine to its radiator 24. The other two arrows represent the flow of thermal energy from exhaust gases issuing from the internal-combustion means (A) to the recuperator 22, and then said thermal energy flows via heat pipe 23 or by conduction to the hot-space hot-gas unit (B).

FIG. 16 shows an end-on schematic diagram of the relative placement of connecting-rod journals on a crankshaft 11 usable to the third embodiment of a compound engine. The unshaded circle 11 central to FIG. 16 relates to the rotational axis of crankshaft 11. The notations A and B in FIG. 16 relate to similar notations in FIG. 15. The unshaded circle 27 in FIG. 16 relates to connecting-rod journal 27 of the internal-combustion unit shown in FIG. 4. The two shaded circles 46 and 61 respectively relate to connecting-rod journals 46 and 61 of the cool-space hot-gas unit shown in FIG. 5 and the hot-space hot-gas unit shown in FIG. 6. The circular arrow in FIG. 16 relates to similar shorter arrows adjacent to countermass 45 (FIG. 5) and 60 (FIG. 6) and represent counter clockwise rotation of the crankshaft when the compound engine is viewed either from the front or from the rear. The connecting-rod journals on 11 are separated by an angular displacement of $2\pi/3$ radians.

The cool compression space 52 and the hot expansion space 73 are interconnected via duct 54 through coolers 56 and 42, and through regenerator 15 and heater 16, and thus the gaseous working medium communicates therethrough between 52 and 73. Cyclic variations in the volume $V_e$ of the hot expansion space 73 lead those of the volume $V_c$ of the cool compression space 52 by $2\pi/3$ radians due to the relative placement of connecting-rod journals on the crankshaft as shown in FIG. 16. $V_e$ and $V_c$ also refer to Eq. 3. Utilizing Eq. 1 and the nomenclature thereafter, we note that $\alpha_e = \alpha_c + 2\pi/3$, wherein subscripts c and e refer to connecting-rod journals 46 and 61 or to their respective pistons 51 and 67 within block units A and B of FIG. 15, respectively. Minimum and maximum total volumes $V_t$ of the working medium occur when $\sin \alpha_c = -\sin \alpha_e$. Therefore, the working medium is compressed to minimum volume when $\alpha_c = 5\pi/3$ and $\alpha_e = \pi/3$, and expands to maximum volume when $\alpha_c = 2\pi/3$ and $\alpha_e = 4\pi/3$, wherein $\alpha_n = 0$ when the $n^{th}$ piston is at TDC. Net positive torque is delivered by the hot-gas means to the common crankshaft when the torque is averaged over the entire repetitive cycle where $\alpha_n$ varies continuously through $2\pi$ radians.

The hot-gas means operates as a refrigerator when the crankshaft 11 rotates in the clockwise direction and when the relative placement of connecting-rod journals is maintained as shown in FIG. 16. In this case cyclic variations in the volume $V_e$ of the expansion space 73 lag those in the volume $V_c$ of the compression space 52 by $2\pi/3$ radians.

FOURTH PREFERRED EMBODIMENT

Figure 17:
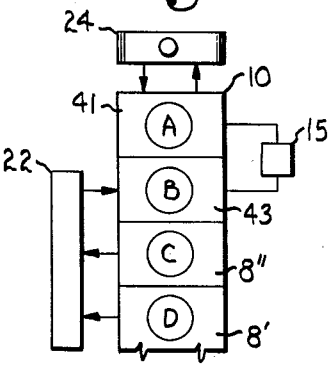
FIG. 17 relates to FIGS. 4, 5, 6, and 18 and is a block diagram of an embodiment of a four cylinder linear compound engine.
Figure 18:
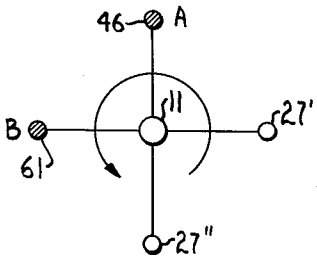
FIG. 18 relates to FIGS. 4, 5, 6, and 17 and is an end-on schematic diagram of the configuration and corresponding direction of rotation of the crankshaft for an embodiment of a four cylinder linear compound engine.

Reference is made to a fourth preferred embodiment comprising a four cylinder linear compound internal-combustion hot-gas engine according to the present invention as shown in FIGS. 4, 5, 6, 17, and 18; wherein FIG. 4 shows in cross section an internal-combustion unit, and FIGS. 5 and 6 respectively show in cross section a cool-space hot-gas unit and a hot-space hot-gas unit, with the internal-combustion unit usable twice, and with each of said hot-gas units usable once to the block diagram of FIG. 17 and the schematic diagram of FIG. 18.

A description of the internal-combustion unit shown in FIG. 4, and its function, was presented in the discussion of the first preferred embodiment of a compound engine. The interconnections for the fourth preferred embodiment are similar to those described for the third preferred embodiment. The internal-combustion means of the fourth preferred embodiment is comprised of two internal-combustion units of the type shown in FIG. 4. A single recuperator 22 receives hot exhaust gases issuing from the two cylinders of the internal-combustion means (see FIG. 17). Integral to the recuperator 22, for transport of thermal energy, is a heat pipe 23 usable to the heater 70 of the hot-space hot-gas unit shown in FIG. 6. The internal-combustion means operates in either the two-stroke or four-stroke cycle.

Descriptions of the cool-space hot-gas unit shown in FIG. 5 and the hot-space hot-gas unit shown in FIG. 6 were presented in the discussion of the third preferred embodiment. The hot-gas means for the fourth preferred embodiment comprises one cool-space hot-gas unit (FIG. 5) and one hot-space hot-gas unit (FIG. 6). The interconnections of the hot-gas means are the same as those described for the third preferred embodiment.

The internal-combustion means and the hot-gas means are housed within an engine casting 10 common to both, and both said means are mechanically interconnected via a single crankshaft 11. The internal-combustion means and the hot-gas means are thermally interconnected via (1) a recuperator 22 and heat pipe 23, and (2) a cooling system common to both said means with liquid coolant 39 circulating therein. Within the hot-gas means the cool compression space 52 and the hot expansion space 73 are interconnected via duct 54 as previously described in the third preferred embodiment.

FIG. 17 is a block diagram of a compound engine according to the fourth preferred embodiment. Block unit A represents a cool-space hot-gas unit of the type shown in FIG. 5. Block unit B represents a hot-space hot-gas unit of the type shown in FIG. 6. Block units C and D each represent an internal-combustion unit of the type shown in FIG. 4. Notations 41, 43, and 8' and 8" relate respectively to portions of the engine head so designated in FIGS. 4, 5, and 6. Block unit 22 represents the recuperator. Block unit 15 represents the regenerator. Block unit 24 represents the radiator. And 10 relates to the engine casting. The four circles in FIG. 17 each represent a cylinder within the compound engine. The two arrows between 10 and 24 represent the flow of liquid coolant 39 to and from the compound engine and its radiator. The other three arrows represent the flow of thermal energy from exhaust gases issuing from the internal-combustion means (C,D) to the recuperator 22, and then said thermal energy flows via heat pipe 23 or by conduction to heater 70 of the hot-space hot-gas unit (B).

FIG. 18 is an end-on schematic diagram of the relative placement of connecting-rod journals on a single crankshaft 11 usable to the fourth embodiment of a compound engine. The unshaded circle 11 central to FIG. 18 relates to the central rotational axis of the crankshaft 11. The two unshaded circles 27' and 27" each relate to a separate connecting-rod journal 27 of an internal-combustion unit of the type shown in FIG. 4. The two shaded circles 46 and 61 respectively relate to connecting-rod journals 46 and 61 of the cool-space hot-gas unit (FIG. 5) and the hot-space hot-gas unit (FIG. 6). The circular arrow in FIG. 18 coincides with similar shorter arrows adjacent to countermasses 26 of FIG. 4, 45 of FIG. 5, and 60 of FIG. 6, and represents the counter clockwise rotation of the crankshaft 11. The connecting-rod journals on 11 are separated by an angular displacement of $\pi/2$ radians. The notations A and B in FIG. 18 relate to A and B in FIG. 17.

The hot-gas cycle is similar to those described previously. In the hot-gas means cyclical variations in the volume $V_e$ of the hot expansion space 73 lead those in the volume $V_c$ of the cool compression space 52 by $\pi/2$ radians due to the relative placement of connecting-rod journals 46 and 61 on the crankshaft 11 as shown in FIG. 18. $V_e$ and $V_c$ also refer to Eq. 3. Utilizing Eq. 1 and the nomenclature thereafter we note that $\alpha_e = \alpha_c + \pi/2$, wherein the subscripts c and e refer to connecting-rod journals 46 and 61 associated with pistons 51 and 67 within block units A and B, respectively. Minimum and maximum values of the total volume $V_t$ of the working medium occur when $\sin \alpha_c = -\sin \alpha_e$. Therefore, the working medium is compressed to minimum volume $V_t$ when $\alpha_c = 7\pi/4$ and $\alpha_e = \pi/4$ and expands to maximum $V_t$ when $\alpha_c = 3\pi/4$ and $\alpha_e = 5\pi/4$, wherein $\alpha_n = 0$ when the $n^{th}$ piston is at TDC. Net positive torque is delivered by the hot-gas means to the crankshaft 11 during the entire repetitive cycle where $\alpha_n$ varies continuously by $2\pi$ radians.

The transfer of thermal energy by the recuperator 22 and heat pipes 23 from the exhaust gases of the internal-combustion means to the heater 70 of the hot-gas means is similar to that presented herein during the preceding description of the first preferred emobodiment of a compound engine.

The hot-gas means operates as a refrigerator when the crankshaft 11 rotates in the clockwise direction so that variations in $V_e$ lag those in $V_c$ by $\pi/2$ radians.

FIFTH PREFERRED EMBODIMENT

Figure 13:
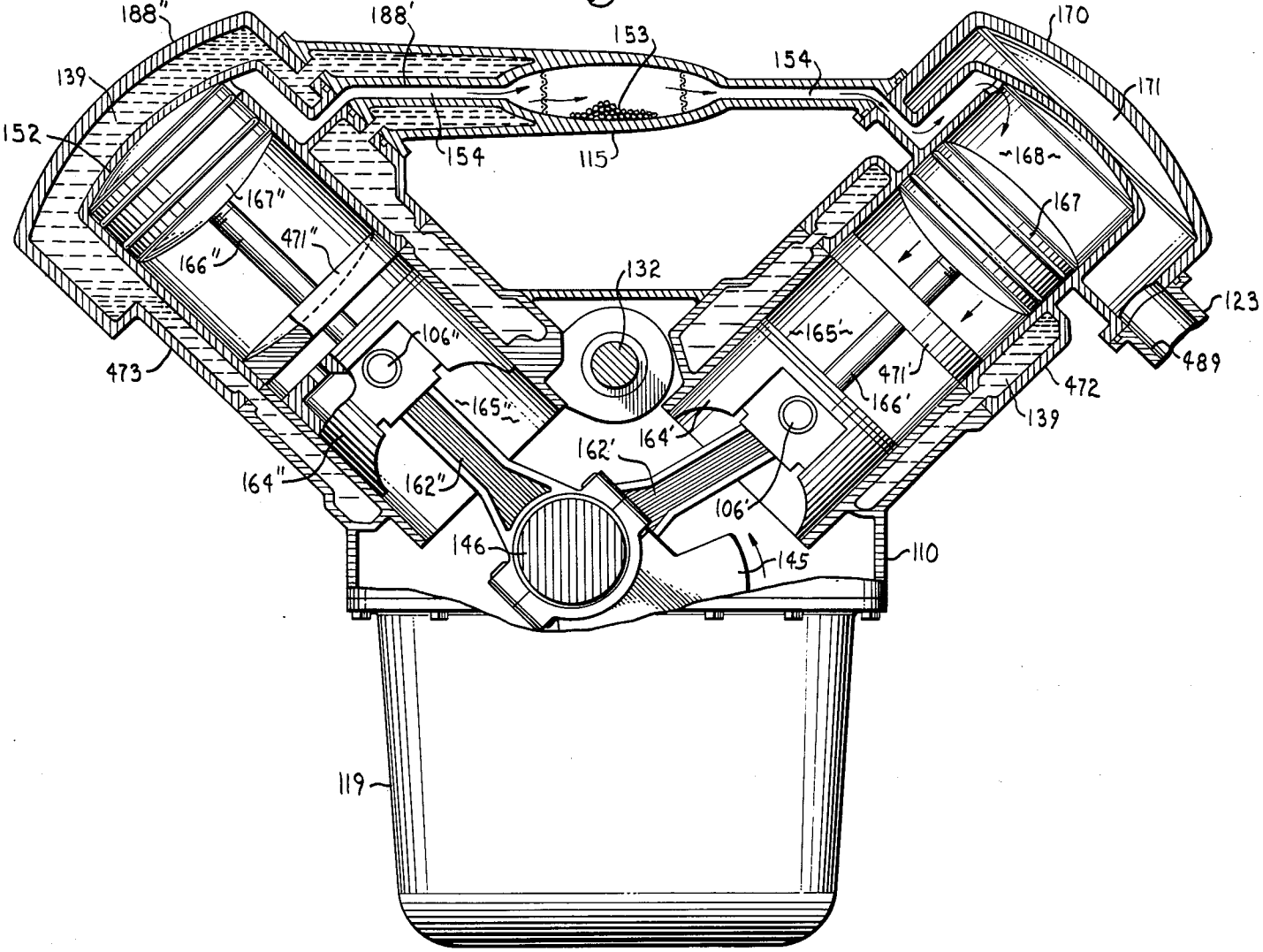
FIG. 13 relates to FIGS. 11, and 19 and is a cross sectional view of an embodiment of a single-acting hot-gas unit for vee compound engines including engine casting, crankshaft lobe, connecting-rod journal of the crankshaft, two primary connecting rods, two piston pins, two guide members, two secondary connecting rods, two single-acting pistons, a cool-compression-cylinder, interconnected by a duct through a generator a hot expansion cylinder, heater, cooler liquid coolant, and camshaft for the internal-combustion means of the compound engine.
Figure 19:
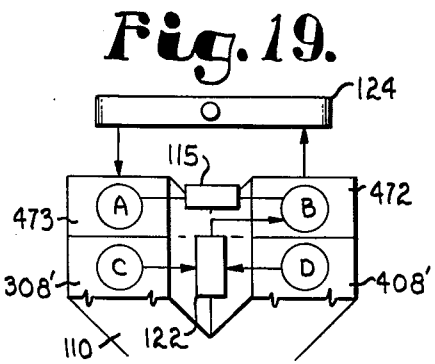
FIG. 19 relates to FIGS. 11, 13, and 20 and is a block diagram of an embodiment of a four cylinder vee compound engine.

Reference is made to a fifth basic preferred embodiment comprising a four cylinder ($\pi/2$)-radian-vee compound internal-combustion hot-gas engine according to the present invention as shown in FIGS. 11, 13, 19, and 20; wherein FIGS. 11 and 13 respectively shown in cross section an internal-combustion unit and a hot-gas unit, with said units usable once each to the block diagram of FIG. 19.

The components comprising the internal-combustion unit shown in FIG. 11, and their interconnections and/or functions, were presented here in the description of the second preferred embodiment of a compound engine. The interconnections are the same here except exhaust gases issuing from the two expansible cylindrical combustion chambers are received by a single recuperator 122 (FIG. 19) which is a bringing together of recuperators 122' and 122" (FIG.11) in the vee space between the two said combustion chambers and external to the engine casting 110. Integral to the recuperator 122 is a single heat pipe 123 usable to the hot-gas unit of FIG. 13. The internal-combustion means is thus comprised of one internal-combustion unit of the type shown in FIG. 11, modified as described, which operates in either the two-stroke or four-stroke cycle.

Shown in FIG. 13 is a cross sectional view of the ($\pi/2$)-radian-vee single-acting hot-gas unit comprising:

- an engine casting 110 which is a housing;
- a crankshaft 311 (FIG. 20) mounted rotatably about its axis in the lower part of 110;
- a countermass 145 integral to 311 and for dynamic balancing of said hot-gas unit;
- a double connecting-rod journal 146 integral to 311;
- a primary connecting rod 162' having two holes through its sides, with one of said holes at each end of 162', and with one end of 162' connected rotatably about 146 via one of said holes in 162' so as to drive or be driven by 311;
- a pin 106' inserted pivotally through said hole at the other end of 162';
- a guide member 164' having two holes diametrically placed in its sidewalls with the ends 106' pivotally inserted in said holes so that 164' either drives or is driven by 162';
- a guide cylinder 165' in which 164' moves to and fro when driven from below by 162' or when driven from above by another member;
- a secondary connecting rod 166' rigidly fixed to the top of 164' and thus either driving 164' or being driven by 164';
- a portion 472 of an engine head mounted on the right top of 110;
- a circular plate 471', which is mounted inside the lower region of 472, and wherein 166' moves to and fro through a hole centered in 471', and with said hole sealed around 166' so as to prevent communication of gases in spaces above and below 471';
- a cylindrical single-acting piston 167' whose lower surface is rigidly attached to 166' so that 167' either drives or is driven by 166';
- a cylindrical hot expansion space 168 above piston 167', and with 168 made expansible by 167' moving to and fro within 168;
- a gaseous working medium such as hydrogen and helium filling space 168;
- a heater 170 integral to 472 with a duct 154 therethrough one side;
- a hot metal vapor 171 inside 170 wherein 171 condenses to liquid metal on the inner conducting walls of 170 thus surrendering its thermal energy of vaporization to said conducting walls, with said thermal energy being conducted through said conducting walls to the gaseous working medium in 168, and with said condensed liquid metal flowing gravitationally to the lowermost space within 170;

a heat pipe 123 attached to an opening on the side of 170, with metal vapor entering 170 via 123, and with 123 usable as described previously herein to recuperator 122 of the internal-combustion unit shown in FIG. 4;

a porous wick 489 lining 123 and providing a means for capillary flow of condensed liquid metal through 123 to recuperator 122;

a second primary connecting rod 162'' which is similar to 162', which is connected rotatably about 146 via a hole in one end of 162'', and with 162'' either driving or being driven by crankshaft 311;

a second pin 106'' similar to 106';

a second guide member 164'' similar to 164';

a second guide cylinder 165'' similar to 165' and wherein 164'' moves to and fro when drivem from below by 162'' or when driven from above by another member;

a second secondary connecting rod 166' fixed rigidly to the top center of 164'' and with 166'' alternately driven from below by 164'' and from above by another member;

a portion 473 of a second engine head mounted on the left top of 110;

a second cylindrical plate 471'' similar to 471' but mounted inside 473, with 166'' moving to and fro through a hole centered in 471'', and with said hole sealed about 166'' to prevent communication of gases above and below 471'';

a cylindrical single-acting piston 167'' whose central bottom face is attached rigidly to 166'', and thus 167'' alternately driving and being driven by 166'';

a cylindrical cool compression space 152 (shown closed in FIG. 13) above piston 167'', and with 152 made expansible by reciprocative movement of 167'', within 152;

a cooler 188' integral to 473 and surrounding the walls of 152, and with ports for liquid coolant to flow to and from the interior of 188' thereby conductively cooling the gaseous working medium inside 152;

a liquid coolant 139 flowing in hollow convection ways within the walls of 188'', 473, 472, and 110;

a regenerator 115 with a duct 154 therethrough, with one end of 115 attached to 170 with duct 154 continuing therethrough to space 168, with the other end of 115 attached to 188' with duct 154 continuing therethrough to space 152, and with the gaseous working medium communicating regeneratively between spaces 168 and 152 via duct 154;

a second cooler 188' integral to the end of 115 which is attached to 188'', and with 139 also flowing within hollow walls of 188';

a fine granualr metal matrix filling duct 154 within 115 so as to thermally communicate with the gaseous working medium and thereby alternately transfer thermal energy to and from the working medium; and an oil reservoir 119 attached to the bottom of 110.

FIG. 19 is a block diagram of a compound engine according to the fifth preferred embodiment. Block unit pair AB represents a hot-gas unit of the type shown in FIG. 13. The hot-gas means is thus comprised of one hot-gas unit of the type shown in FIG. 13. Block unit pair CD represents an internal-combustion unit of the type shown in FIG. 11. The internal-combustion means is thus comprised of one internal-combustion unit of the type shown in FIG. 11. Means previously described herein are represented in FIG. 19 as follows:

block unit 115 represents the regenerator;

block unit 122 represents the recuperator;

block unit 110 represents the engine casting; and block 124 represents the radiator. The notations 472, 473, 308', and 408' in FIG. 19 relate to members so designated in FIGS. 11 and 13. The four circles in FIG. 19 each represent a cylinder; two (A,B) for the hot-gas means and two (C,D) for the internal-combustion means. The two arrows between 110 and 124 represent the flow of liquid coolant 139 to and from the compound engine and its radiator 124. The other arrows in FIG. 27 represent the flow of thermal energy from exhaust gases issuing from the internal-combustion means (C,D) to recuperator 122, and then via heat pipes or conduction thermal energy flows from 122 to the hot side (B) of the hot-gas means.

Figure 20:
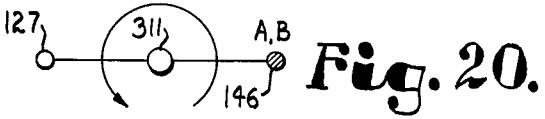
FIG. 20 relates to FIGS. 11, 13, and 19 and is an end-on schematic diagram of the configuration and corresponding direction of rotation of the crankshaft of an embodiment of a four cylinder vee compound engine.

FIG. 20 is an end-on schematic diagram of the relative placement of connecting-rod journals on a crankshaft 311 usable to the fifth embodiment of a compound engine. Notations A, B in FIG. 20 relate to similar notations in FIG. 19. The unshaded circle 311 central to FIG. 20 relates to the axis of rotation of crankshaft 311. The unshaded circle 127 relates to the connecting-rod journal 127 of the internal-combustion unit shown in FIG. 11. The shaded circle 146 relates to the connecting-rod journal 146 of the hot-gas unit shown in FIG. 13. The circular arrow in FIG. 20 coincides with similar shorter arrows adjacent to countermasses 126 of FIG. 11 and 146 of FIG. 13, and designates the counter clockwise rotation of 311 when the compound engine is viewed from the rear.

The hot-gas cycle of the hot-gas means of FIG. 13 for a compound engine according to the fifth preferred embodiment is similar to those previously described herein. In the hot-gas means cyclical variations of the volume $V_e$ of the expansion space 168 lead those of the volume $V_c$ in the compression space 152 by $\pi/2$ radians. $V_e$ and $V_c$ also refer to Eq. 3. Utilizing Eq. 1 and the nomenclature thereafter we note that $\alpha_e = \alpha_c + \pi/2$, wherein subscripts e and c refer to pistons 167' and 167'' (FIG. 13) which are within block units B and A of FIG. 19, respectively. Minimum and maximum total volumes $V_t$ of the working medium occur when $\sin \alpha_e = -\sin \alpha_c$: minimum when $\alpha_e = 7\pi/4$ and $\alpha_c = \pi/4$, and maximum when $\alpha_e = 3\pi/4$ and $\alpha_c = 5\pi/4$, wherein $\alpha_n = 0$ when the $n^{th}$ piston is at TDC. Net positive torque is delivered by the hot-gas means to the crankshaft 311 when the torque is averaged over an entire cycle of $\alpha$ varying continuously by $2\pi$ radians.

When the crankshaft is made to rotate clockwise by proper timing of the internal-combustion means, then variations in $V_e$ lag those in $V_c$ by $\pi/2$ radians and the hot-gas means operates as a refrigerator.

SIXTH PREFERRED EMBODIMENT

Figure 21:
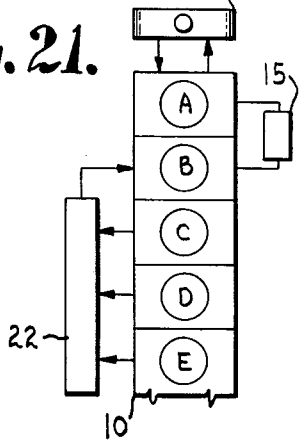
FIG. 21 relates to FIGS. 4, 5, 6, 22, and 23 and is a block diagram of an embodiment of a five cylinder linear compound engine.
Figure 22:
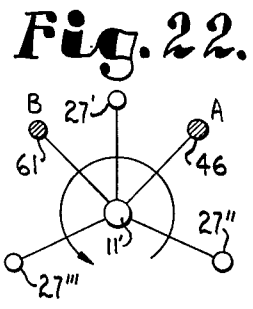
FIG. 22 relates to FIGS. 4, 5, 6, and 21 and is an end-on schematic diagram of the configuration and corresponding direction of rotation of the crankshaft for an embodiment of a five cylinder linear compound engine. This configuration of the crankshaft is an alternative to that shown in FIG. 23.
Figure 23:
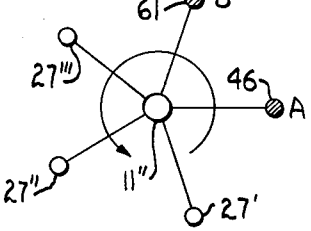
FIG. 23 relates to FIGS. 4, 5, 6, and 21 and is an end-on schematic diagram of another possible configuration and corresponding direction of rotation of the crankshaft for an embodiment of a five cylinder linear compond engine. This configuration of the crankshaft is an alternative to that shown in FIG. 22.

Reference is made to a sixth preferred embodiment comprising a five cylinder linear compound internal-combustion hot-gas engine according to the present invention as shown in FIGS. 4, 5, 6, 21, 22, and 23; wherein FIG. 4 shows in cross section an internal-combustion unit, FIGS. 5 and 6 respectively show in cross section a cool-space hot-gas unit and a hot-space hot-gas unit, with the internal-combustion unit usable three times and said hot-gas units usable once each to the block diagram of FIG. 21 and to the schematic diagrams of FIGS. 22 and 23.

The sixth preferred embodiment is similar in all respects to the fourth preferred embodiment of a compound engine, except in the sixth preferred embodiment the internal-combustion means comprises three internal-combustio units of the type shown in FIG. 4. Hot exhaust gases issuing from the internal-combustion means are received by a single recuperator 22. A heat pipe 23 integral to 22 for transport of thermal energy is usable to the heater 70 of the hot-space hot-gas unit (FIG. 6). The internal-combustion means operates in the two-stroke or four-stroke cycle. The hot-gas cycle for the hot-gas means is similar to those described previously.

FIG. 21 is a block diagram of the compound engine according to the sixth preferred embodiment. Block unit A represents a cool-space hot-gas unit of the type shown in FIG. 5. Block unit B represents a hot-space hot-gas unit of the type shown in FIG. 6. Block units C, D, and E each represent an internal-combustion unit of the type shown in FIG. 4. The five circles shown in FIG. 21 each represent a cylinder within the compound engine. Block 22 represents the recuperator. Block 15 represents the regenerator. Block 24 represents the radiator, and 10 represents the single engine casting housing the internal-combustion means (C, D, E) and the hot-gas means (A, B). The two arrows between 10 and 24 in FIG. 21 represent the flow of liquid coolant 39 to and from the compound engine and its radiator 24. The other four arrows in FIG. 21 represent the flow of thermal energy from exhaust gases issuing from the internal-combustion means (C, C, E) to the recuperator 22, and then said thermal energy is transported via heat pipe 23 or by conduction to the heater 70 of the hot-space hot-gas unit (B).

FIG. 22 is an end-on schematic diagram of the relative placement of the five connecting-rod journals on a first crankshaft 11' usable to the sixth preferred embodiment of a compound engine. Notations A and B in FIG. 22 relate to A and B in FIG. 21. The unshaded circle 11 central to FIG. 22 represents the central rotational axis of the single crankshaft 11'. The shaded circles 46 and 61 relate to connecting-rod journals 46 and 61 of FIGS. 5 and 6, respectively. The three unshaded circles 27', 27'', 27''' each relate to a separate connecting-rod journal 27 of three internal-combustion units of the type shown in FIG. 4. The placement of connecting-rod journals 46 and 61 on 11' provides that cyclical variations in the volume $V_e$ of the hot expansion space 73 lead those in the volume $V_c$ of the cool compression space 52 by $\pi/2$ radians; $V_e$ and $V_c$ also refer to Eq. 3. Utilizing the nomenclature following Eq. 1, the placement of connecting-rod journals 46 and 61 on 11' thus provide $\alpha_e = \alpha_c + \pi/2$, wherein subscripts *c* and *e* refer respectively to connecting-rod journals 46 and 61 associated with single-acting pistons 51 (FIG. 5) and 67 (FIG. 6) which are respectively within block units A and B of FIG 21. Minimum and maximum total volumes $V_t$ of the hot-gas working medium occur when $\sin \alpha_c = -\sin \alpha_e$; minimum when $\alpha_c = 7\pi/4$ and $\pi_e = \pi/4$, and maximum when $\alpha_c = 3\pi/4$ and $\alpha_e = 5\pi/4$, wherein $\alpha_n = 0$ when the piston associated with the $n^{th}$ connecting-rod journal is at TDC. The counter clockwise direction of rotation of crankshaft 11' shown by the circular arrow in FIG. 22 coincides with similar arrows shown adjacent to countermasses 26 of FIG. 4, 45 of FIG. 5, and 60 of FIG. 6.

FIG. 23 is an end-on schematic diagram of the relative placement of the five connecting-rod journals on a second crankshaft 11'' also usable to the sixth preferred embodiment of a compound engine. Only one crankshaft 11' or 11'' is needed for the sixth preferred embodiment of a compound engine. Notations A and B in FIG. 23 relate to A and B in FIG. 21. The unshaded circle 11'' central to FIG. 23 represents the central rotational axis of crankshaft 11''. The shaded circles 46 and 61 respectively relate to connecting-rod journals 46 of FIG. 5 and 61 of FIG. 6. The three unshaded circles 27', 27'', 27''' each relate to a separate connecting-rod journal 27 of three internal-combustion units of the type shown in FIG. 4. The placement of connecting-rod journals 46 and 61 on 11'' provides that cyclical variations in the volume $V_e$ of the hot expansion space 73 lead those in the volume $V_c$ of the cool compression space by $2\pi/5$ radians. Utilizing the nomenclature following Eq. 1 the placement of connecting-rod journals thus provides that $\alpha_e = \alpha_c + 2\pi/5$, wherein subscripts c and e are defined in the preceding paragraph. Minimum and maximum total volumes $V_t$ of the hot-gas working medium occur when $\sin \alpha_c = -\sin \alpha_e$; minimum when $\alpha_e = \pi/5$ and $\alpha_c = 9\pi/5$, and maximum when $\alpha_e = 6\pi/5$ and $\alpha_c = 4\pi/5$; wherein $\alpha_n = 0$ when the piston associated with the $n^{th}$ connecting-rod journal is at TDC. The counter clockwise direction of rotation of crankshaft 11'' shown by the circular arrow in FIG. 23 coincides with similar arrows shown adjacent to countermasses 26 of FIG. 4, 45 of FIG. 5, and 60 of FIG. 6.

The transfer of thermal energy, by the recuperator 22 and heat pipe 23, from the exhaust gases of the internal-combustion means to the heater 70 of the hot-gas means is similar to that described in the first preferred embodiment of a compound engine.

When the crankshaft rotates clockwise the hot-gas means operates as a refrigerator: variations in $V_e$ lag those in $V_c$ by $\pi/2$ radians when 11' rotates clockwise; and variations in $V_e$ lag those in $V_c$ by $2\pi/5$ radians when 11'' rotates clockwise. The internal-combustion means can be constructed so that it drives 11' or 11'' either clockwise or counter clockwise.

SEVENTH PREFERRED EMBODIMENT

Reference is made to a seventh preferred embodiment comprising a six cylinder linear compound internal-combustion hot-gas engine according to the present invention as shown in FIGS. 4, 5, 6, 24, 25, and 26; wherein FIG. 4 shows in cross section an internal-combustion unit, FIGS. 5 and 6 show in cross section a cool-space hot-gas unit and a hot-space hot-gas unit, respectively, with the internal combustion unit usable four times and said hot-gas units usable once each to the block diagram of FIG. 24 and to the schematic diagrams of FIGS. 25 and 26.

The seventh and sixth preferred embodiments of a compound engine are similar, except that in the seventh embodiment the internal-combustion means comprises four internal-combustion units of the typw shown in FIG. 4. Hot exhaust gases issuing from the internal-combustion means are received by a single recuperator 22. Integral to 22 is a heat pipe 23 which is usable to heater 70 of the hot-space hot-gas unit of FIG. 6. Hot metal vapor in 22 convectively transports thermal energy from the recuperator 22 to heater 70 as previously described herein. The thermodynamic and mechanical cycle of the hot-gas means is also similar to those previously described herein.

FIG. 24 is a block diagram of a compound engine according to the seventh preferred embodiment, wherein are shown blocks representing the engine casting 10, regenerator 15, recuperator 22, and radiator 24. Block units A and B represent the hot-gas units shown in FIGS. 5 and 6, respectively. Block units C, D, E, and F each represent an internal-combustion unit of the type shown in FIG. 4; these four units comprise the internal-combustion means. Arrows in FIG. 24 represent the flow of thermal energy from the exhaust gases of the internal-combustion means C, D, E, and F and then through recuperator 22 to heater 70 of the hot-gas unit B of FIG. 24. Other arrows represent the flow of liquid coolant between the engine casting 10 and the radiator 24. The six circles in FIG. 24 each relate to a cylinder within the compound engine.

FIG. 25 is an end-on schematic diagram of the relative placement of the six connecting-rod journals on a crankshaft 11' usable to the seventh preferred embodiment of a compound engine. Notations A and B in FIG. 25 relate to A and B in FIG. 24. The unshaded circle 11' central to FIG. 25 represents the central rotational axis of crankshaft 11'. The shaded circles 46 and 61 relate to connecting-rod journals 46 of FIG. 5 and 61 of FIG. 6, respectively. The four unshaded circles 27', 27'', 27''', and 27'''' each relate to separate connecting-rod journals 27 of four internal-combustion units of the type shown in FIG. 4. The placement of connecting-rod journals 46 and 61 in FIG. 25 provides that cyclical variations in the volume $V_e$ of the expansion space 73 lead those in the volume $V_c$ of the compression space 52 by $\pi/2$ radians; $V_e$ and $V_c$ also refer to Eq. 3. Thus $\alpha_e = \alpha_c + \pi/2$, wherein subscripts c and e refer respectively to single-acting pistons 51 of FIG. 5 and 67 of FIG. 6, which are respectively within block units A and B of FIG. 24. Minimum and maximum total volumes $V_t$ of the hot-gas working medium occur when the trigonometric relation $\sin\alpha_e = -\sin\alpha_c$ is satisfied; minimum when $\alpha_e = \pi/4$ and $\alpha_c = 7\pi/4$, and maximum when $\alpha_e = 5\pi/4$ and $\alpha_c = 3\pi/4$; wherein $\alpha_n = 0$ when the $n^{th}$ piston is at TDC. The direction of rotation of the crankshaft shown by the circular arrow in FIG. 25 coincides with similar arrows shown adjacent to countermasses 26 of FIG. 4, 45 of FIG. 5, and 60 of FIG. 6.

FIG. 26 is an end-on schematic diagram of the relative placement of the six connecting-rod journals on an alternate crankshaft 11' usable to the seventh preferred embodiment of a compound engine. Only one crankshaft 11' or 11'' is needed for a compound engine. Notations A and B in FIG. 26 relate to A and B in FIG. 24. The unshaded circle 11'' central to FIG. 26 relates to the central rotational axis of crankshaft 11''. The shaded circles 46 and 61 respectively relate to connecting-rod journals 46 of FIG. 5 and 61 of FIG. 6. The four unshaded circles 27', 27'', 27''', and 27'''' each relate to separate connecting-rod journals 27 of four internal-combustion units of the type shown in FIG. 4. The placement of connecting-rod journals 46 and 61 in FIG. 22 provides that cyclical variations in the volume $V_e$ of expansion space 73 lead those in the volume $V_c$ of the compression space by $\pi/3$ radians. Thus $\alpha_e = \alpha_c + \pi/3$, where the subscripts *e* and *c* are defined in the preceding paragraph. Minimum and maximum total volumes $V_t$ of the hot-gas working medium occur when the trigonometric relation $\sin\alpha_e = -\sin\alpha_c$; maximum when $\alpha_e = 7\pi/6$ and $\alpha_c = 5\pi/6$; and minimum when $\alpha_e = \pi/6$ and $\alpha_c = 11\pi/6$; wherein $\alpha_n = 0$ when the $n^{th}$ piston is at TDC. The counter clockwise direction of rotation of the crankshaft shown by the circular arrow in FIG. 26 coincides with similar arrows shown adjacent to crankshaft lobes 26 of FIG. 4, 45 of FIG. 5, and 60 of FIG. 6.

When the internal-combustion means is constructed so that it drives the crankshafts 11' or 11'' clockwise, then the hot-gas means operates as a refrigerator. Variations in $V_e$ then lag those in $V_c$ by $\pi/2$ radians for 11' and by $\pi/3$ radians for 11''.

EIGHTH PREFERRED EMBODIMENT

Refernce is made to an eighth preferred embodiment comprising a six cylinder ($\pi/2$)-radian-vee compound internal-combustion hot-gas engine according to the present invention as shown in FIGS. 11, 13, 28, and 29; wherein FIG. 11 shows in cross section an internal-combustion unit, and FIG. 13 shows in cross section a hot-gas unit, with the internal-combustion unit usable twice and the hot-gas unit usable once to the block diagram of FIG. 28 and the schematic diagram of FIG. 29.

The eighth and fifth preferred embodiments of a compound engine are similar, except in the eighth embodiment the internal-combustion means comprises one more of the internal-combustion units of the type shown in FIG. 11. Hot exhaust gases issuing from the internal-combustion means are received by a single recuperator 122 which is similar to the recuperator described in the fifth preferred embodiment. Integral to 122 there is a heat pipe 123 which is usable to heater 170 of the hot-gas unit shown in FIG. 13. Hot metal vapor inside 123 convectively transports thermal energy from recuperator 122 to heater 170 as previously described herein. The mechanical and thermodynamical cycles of the internal-combustion means and the hot-gas means are also similar to those previously described herein.

FIG. 28 is a block diagram of a compound engine according to the eighth preferred embodiment, wherein are shown blocks representing the engine casting 110, regenerator 115, recuperator 122, and radiator 124. Block unit AB represents the hot-gas unit shown in FIG. 13. Block units CD and EF each represent an internal-combustion unit of the type shown in FIG. 11. Arrows in FIG. 28 represent the direction of flow for thermal energy and liquid coolant as previously described here in the description of the fifth preferred embodiment of a compound engine. The six circles in FIG. 28 each represent a cylinder within the compound engine.

FIG. 29 is an end-on schematic diagram of the relative placement of the three connecting-rod journals on a crankshaft 311 usable to the eighth preferred embodiment of a compound engine. Notations A and B in FIG. 29 relate to A and B in FIG. 28. The unshaded circle 311 central to FIG. 30 represents the central rotational axis of crankshaft 311. The shaded circle 146 relates to the connecting-rod journal 146 of the hot-gas unit of FIG. 13. The two shaded circles 127' and 127'' each relate to separate connecting-rod journals 127 of two internal-combustion units of the type shown in FIG. 11. The circular arrow in FIG. 29 relates to similar arrows adjacent to countermasses 126 of FIG. 11 and 145 of FIG. 13, and designates the counter clockwise direction of rotation of the crankshaft. The connecting-rod journal 146 in FIG. 29 for a ($\pi/2$)-vee hot-gas means requires that cyclical variations in the volume $V_e$ of the expansion space 168 lead those in the volume $V_c$ of the compression space 152 by $\pi/2$ radians. Thus $\alpha_e = \alpha_c + \pi/2$, wherein subscripts $c$ and $e$ refer respectively to single-acting pistons 167'' and 167' of FIG. 13, which are within block unit AB of FIG. 28. Minimum and maximum total volumes $V_t$ of the hot-gas working medium occur when the trigonometric relation $\sin \alpha_e = -\sin \alpha_c$ is satisfied: minimum when $\alpha_e = \pi/4$ and $\alpha_c = 7\pi/4$, and maximum when $\alpha_e = 5\pi/4$ and $\alpha_c = 3\pi/4$; wherein $\alpha_n = 0$ when the $n^{th}$ piston is at TDC.

When the internal-combustion means drives crankshaft 311 clockwise then the hot-gas means operates as a refrigerator. Variations in the volume $V_e$ then lag those in the volume $V_c$ by $\pi/2$ radians.

NINTH PREFERRED EMBODIMENT

Reference is made to a ninth basic preferred embodiment comprising a six cylinder arbitrary-vee compound internal-combustion hot-gas engine according to the present invention as shown in FIGS. 11, 14, 30, and 31. Three cylinders function in the internal-combustion mode. The other three cylinders function in the double-acting hot-gas mode. The vee angle for this compound engine may be chosen arbitrarily within the range from 0° to 180°. In this manner the first and ninth preferred embodiments of a compound engine are similar when the vee angle in the ninth embodiment is chosen as zero degrees.

The internal-combustion means for the ninth preferred embodiment of a compound engine comprises three left-hand-side members of the internal-combustion unit shown in FIG. 11. The hot-gas means comprises three right-hand-side members of the double-acting hot-gas unit shown in FIG. 14. The internal-combustion unit of FIG. 11 and the hot-gas unit of FIG. 14 were described in the second preferred embodiment of a compound engine. Their functions in the ninth preferred embodiment are similar to those previously described herein.

FIG. 30 is a block diagram of a compound engine according to the ninth preferred embodiment, wherein are shown blocks representing an engine casting 110, three regenerators 115', 115'', and 115''', a recuperator 122, and a radiator 124. Block units A, C, and E each represent a left-hand-side member of the internal-combustion unit shown in FIG. 11. Block units B, D, and F each represent a right-hand-side member of the double-acting hot-gas unit shown in FIG. 13. Each of the six circles in FIG. 30 represent a cylinder within the compound engine. Arrows in FIG. 30 represent the flow of thermal energy from exhaust gas of the internal-combustion units A, C, and E to a single recuperator 122, and then from 122 through heat pipes 123', 123'', and 123''' or by conduction to heaters 116', 116'', and 116''' of the hot-gas units. Two of the arrows demonstrate the flow of liquid coolant between engine casting 110 and radiator 124.

Referring to FIGS. 14 and 30, each of the three cool compression spaces 185 below the three double-acting pistons 184 is interconnected via a duct 187 through a regenerator 115 to another of the three hot expansion spaces 186 above another piston 184. Referring to FIG. 30 the interconnections are:

- Cool space 185' of B interconnected via 115' to hot space 186'' of D,
- Cool space 185'' of D interconnected via 115'' to hot space 186''' of F, and
- Cool space 185''' of F interconnected via 115''' to hot space 186' of B.

FIG. 31 is an end-on schematic diagram of the relative placement of the connecting-rod journals on a crankshaft 11 usable to the ninth embodiment of a compound engine. The unshaded circle 11 central to FIG. 31 represents the central rotational axis of crankshaft 11. Each of the three connecting-rod journals is common to a hot-gas and an internal-combustion unit. Journals denoted by circles AB, CD, and EF of FIG. 31 each represent the left-hand-side of 127 in FIG. 11 and the right-hand-side of 178 in FIG. 14. Notations A, B, C, D, E, and F of FIG. 31 relate to similar notations in FIG. 30. The circular arrow in FIG. 31 relates to similar arrows adjacent to countermasses 126 of FIG. 11 and 177 of FIG. 14; they denote counter clockwise rotation of crankshaft 11.

The hot-gas cycle of the hot-gas means according to the ninth preferred embodiment of a compound engine is similar to that previously described herein. The relative placement of connecting-rod journals on 11 requires that cyclical variations in the volume $V_e$ of expansion spaces 186 lead those in the volume $V_c$ of interconnected compression spaces 185 by $2\pi/3$ radians, wherein $V_e$ and $V_c$ also refer to Eq. 3. In addition to the phase difference of $2\pi/3$ radians due to placement of connecting-rod journals on the crankshaft there is an intrinsic phase difference of $\pi$ radians between an expansion space 186 and its interconnected compression space 185, because spaces 186 and 185 are respectively above and below double-acting pistons 184. Minimum and maximum total volumes $V_t$ of the working medium inside an interconnection of spaces 185 and 186 occur when the trigonometric relation $\sin \alpha_e = \sin \alpha_c$ is satisfied, wherein the subscripts $e$ and $c$ refer to the interconnected expansion space 186 and compression space 185, respectively. Minimum volume $V_t$ occurs when $\alpha_c = \pi/3$ and $\alpha_e = 5\pi/3$, and maximum $V_t$ occurs when $\alpha_c = 4\pi/3$ and $\alpha_e = 2\pi/3$; wherein $\alpha = 0$ for each of the three pistons 184 when that piston is at TDC in its cylinder, and the repetitive cyclic range of $\alpha$ is from 0 to $2\pi$ radians. The triad of double-acting hot-gas units; B, D, and F of FIG. 30; provides a net positive output torque to the crankshaft thorughout the cycle.

With some modification of the internal-combustion means shown in FIG. 11 the pistons 113 can be converted to double-acting internal-combustion pistons, which also would provide a net positive output torque to the crankshaft throughout either a two-stroke or four-stroke cycle. In this manner a relatively compact six cylinder compound engine according to the ninth preferred embodiment would provide an output torque comparable in magnitude to that for a prior art twelve cylinder internal-combustion engine.

When the internal-combustion means is constructed so that it drives crankshaft 11 in a clockwise direction, then the hot-gas means operates as a refrigerator. Variations in volumes $V_e$ then lag those in interconnected volumes $V_c$ by $2\pi/3$ radians.

TENTH PREFERRED EMBODIMENT

Figure 33:
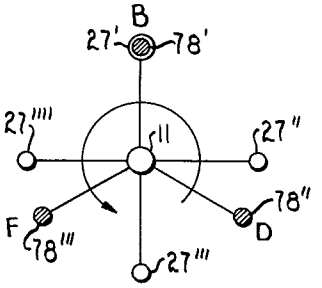
FIG. 33 relates to FIGS. 4, 7, and 32 and is an end-on schematic diagram of the configuration and corresponding direction of rotation of the crankshaft for an embodiment of a seven cylinder linear compound engine.

Reference is made to a tenth basic preferred embodiment comprising a seven cylinder linear compound internal-combustion hot-gas engine according to the present invention as shown in FIGS. 4, 7, 32, and 33; wherein FIG. 4 shows in cross section an internal-combustion unit, and FIG. 7 shows in cross section a double-acting hot-gas unit, with the internal-combustion unit usable four times and the hot-gas unit usable three times to the block diagram of FIG. 32 and the schematic diagram of FIG. 33.

The tenth and first preferred embodiments of a compound internal-combustion hot-gas engine are similar, except the internal-combustion means for the tenth embodiment comprises four of the internal-combustion units of the type shown in FIG. 4. The mechanical and thermal interconnections of the internal-combustion means and the hot-gas means for the tenth embodiment are similar to those described for the first embodiment.

FIG. 32 is a block diagram of a compound engine according to the tenth preferred embodiment, wherein are shown blocks representing the engine casting 10, regenerators 15', 15'', and 15''', recuperator 22, and radiator 24. Block units A, C, E, and G each represent an internal-combustion unit of the type shown in FIG. 4. Block units B, D, and F each represent a double-acting hot-gas unit of the type shown in FIG. 7. Each of the seven circles in FIG. 32 represent a cylinder within the compound engine. Arrows in FIG. 32 represent the direction of flow of thermal energy from exhaust gases of the internal-combustion units A, C, E, and G to the recuperator 22 and then through heat pipes or by conduction to the heaters 16 of the hot-gas units B, D, and F. Two of the arrows represent the flow of liquid coolant 39 between the engine casting 10 and the radiator 24.

Referring to FIGS. 7 and 32, each of the three cool compression spaces 85 below the three double-acting pistons 84 is interconnected via a duct 87 through a regenerator 15 to another of the three hot expansion spaces 86 above another piston 84. Referring to FIG. 32 the interconnections are:

Cool space 85'' of B interconnected via 15'' to hot space 86' of D,

Cool space 85' of D interconnected via 15' to hot space 86''' of F, and Cool space 85''' of F interconnected via 15''' to hot space 86'' of B.

FIG. 33 is an end-on schematic diagram of the relative placement of connecting-rod journals on a crankshaft 11 usable to the tenth embodiment of a compound engine. Notations B, D, and F in FIG. 33 relate to similar notations in FIG. 32. The unshaded circle 11 central to FIG. 33 represents the central rotational axis of crankshaft 11. The shaded circles 78', 78'', and 78''' each relate to separate connecting-rod journals 78 of three hot-gas units of the type shown in FIG. 7. The unshaded circles 27', 27'', 27''', and 27'''' each relate to separate connecting-rod journals 27 of four internal-combustion units of the type shown in FIG. 4. The circular arrow in FIG. 33 relates to similar arrows adjacent to countermasses 26 of FIG. 4 and 77 of FIG. 7 and denote the counter clockwise direction of rotation of crankshaft 11. The relative placement of connecting-rod journals requires that $\alpha_c = \alpha_e + 2\pi/3$, wherein subscripts *e* and *c* refer to cyclic angular positions of pistons in interconnected expansion 86 and compression 85 spaces, respectively. In addition to the phase difference of $2\pi/3$ radians between $\alpha_c$ and $\alpha_e$ due to placement of the connecting-rod journals on the crankshaft there is an intrinsic phase difference of $\pi$ radians between an expansion space 86 and its interconnected compression space 85, because spaces 86 and 85 are respectively above and below the double-acting piston 84. Cyclic variations in the volume $V_e$ of the expansion space 86 thus lead those in the volume $V_c$ of the compression space 85 by $\pi/3$ radians. Minimum and maximum total volumes $V_t$ of the working medium inside interconnected spaces 86 and 85 occur when the trigonometric relation $\sin \alpha_e = \sin \alpha_c$ is satisfied. Minimum volume $V_t$ occurs when $\alpha_e = \pi/6$ and $\alpha_c = 5\pi/6$, and maximum $V_t$ occurs when $\alpha_e = 7\pi/6$ and $\alpha_c = 11\pi/6$; wherein $\alpha = 0$ for each of the three connecting-rod journals 78', 78'', and 78''' when the piston associated with that connecting-rod journal is at TDC in its cylinder. The repetitive cyclic range of $\alpha$ is from 0 to $2\pi$ radians. The triad of double-acting hot-gas units; B, D, and F of FIG. 32; provides a net positive output torque to the crankshaft throughout the cycle.

When the internal-combustion means is constructed so that it drives crankshaft 11 in the clockwise direction, then the hot-gas means operates as a refrigerator. Variations in the volumes $V_e$ then lag those in the interconnected volumes $V_c$ by $\pi/3$ radians.

ELEVENTH PREFERRED EMBODIMENT

Figure 34:
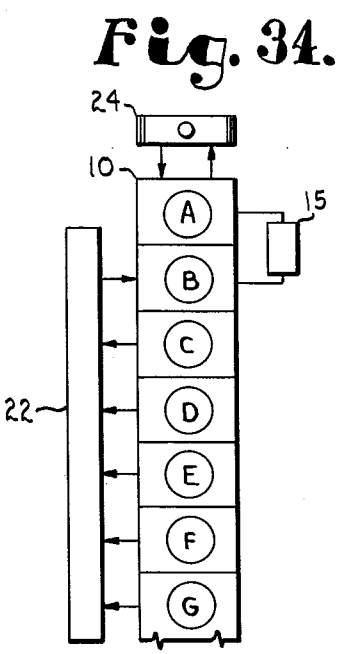
FIG. 34 relates to FIGS. 4, 5, 6, and 35 and is a block diagram of an embodiment of a seven cylinder linear compound engine.
Figure 35:
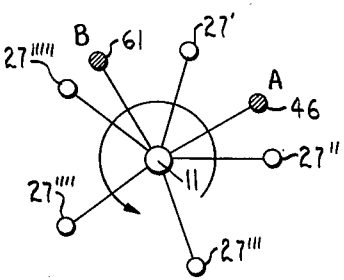
FIG. 35 relates to FIGS. 4, 5, 6, and 34 and is an end-on schematic diagram of the configuration and corresponding direction of rotation of the crankshaft for an embodiment of a seven cylinder linear compound engine.

Reference is made to an eleventh preferred embodiment comprising a seven cylinder linear compound internal-combustion hot-gas engine according to the present invention as shown in FIGS. 4, 5, 6, 24, and 35; wherein FIG. 4 shows in cross section an internal-combustion unit, and FIGS. 5 and 6 show in cross section a cool-space hot-gas unit and a hot-space hot-gas unit, respectively, with the internal-combustion unit usable five times and said hot-gas units usable once each to the block diagram of FIG. 34 and the schematic diagram of FIG. 35.

The eleventh and sixth preferred embodiments of a compound engine are similar, except that in the eleventh embodiment the internal-combustion means comprises five of the internal-combustion units of the type shown in FIG. 4. The mechanical and thermal interconnections and the functions of the internal-combustion means and the hot-gas means for the eleventh preferred embodiment are similar to those described for the sixth preferred embodiment.

FIG. 34 is a block diagram of a compound engine according to the eleventh embodiment of a compound engine, wherein are shown blocks representing the engine casing 10, regenerator 115, recuperator 22, and radiator 24. Block A represents a cool-space hot-gas unit of the type shown in FIG. 5. Block unit B represents a hot-space hot-gas unit of the type shown in FIG. 6. Block units C, D, E, F, and G each represent an internal-combustion unit of the type shown in FIG. 4. The seven circles in FIG. 34 each represent a cylinder within the compound engine. Arrows in FIG. 34 represent the direction of flow of thermal energy from exhaust gases of internal-combustion units C, D, E, F, and G to the recupertor 22 and then through the heat pipes or by conduction to the heater 70 (FIG.6) of hot-gas unit B. Two other arrows represent the flow of liquid coolant 39 between engine casting 10 and radiator 24. Referring to FIGS. 5, 6, and 34, the cool compression space 52 is interconnected via duct 54 through regenerator 15 to the hot expansion space 73.

FIG. 35 is an end-on schematic diagram of the relative placement of connecting-rod journals on a crankshaft 11 usable to the eleventh embodiment of a compound engine. Notations A and B in FIG. 35 relate to similar notations in FIG. 34. The unshaded circle 11 central to FIG. 35 represents the central rotational axis of crankshaft 11. The shaded circles 46 and 61 relate to connecting-rod journals 46 of FIG. 5 and 61 of FIG. 6, respectively. The five unshaded circles 27', 27'', 27''', 27'''', and 27''''' each relate to separate connecting-rod journals 27 of five internal-combustion units of the type shown in FIG. 4. The circular arrow in FIG. 35 relates to similar arrows adjacent to countermasses 26 of FIG. 4, 45 of FIG. 5, and 60 of FIG. 6 and denote counter clockwise rotation of crankshaft 11. The relative placement of connecting-rod journals 46 and 61 on crankshaft 11 requires that $\alpha_e = \alpha_c + \pi/2$; wherein $\alpha$ is an angular position of a connecting-rod journal which ranges from 0 to 2 $\pi$radians, $\alpha_n = 0$ when the piston associated with the $n^{th}$ connecting-rod journal is at TDC. Subscripts $e$ and $c$ represent hot expansion and cool compression spaces, respectively. Thus cyclic variations in the volume $V_e$ of the expansion space 73 lead those in the volume $V_c$ of the compression space 52 by $\pi/2$ radians. Minimum and maximum total volumes $V_t$ occur when the trigonometric relation $\sin \alpha_e = -\sin \alpha_c$ is satisfied. Minimum volume $V_t$ occurs when $\alpha_e = \pi/4$ and $\alpha_c = 7\pi/4$, and maximum $V_t$ occurs when $\alpha_e = 5\pi/4$ and $\alpha_c = 3\pi/4$.

The internal-combustion means operates in either the two-stroke or four-stroke cycle.

When the internal-combustion means is constructed so that crankshaft 11 rotates clockwise, then the hot-gas means functions as a refrigerator. Variations in the volume $V_e$ lag those in the volume $V_c$ by $\pi/2$ radians.

TWELFTH PREFERRED EMBODIMENT

Figure 36:
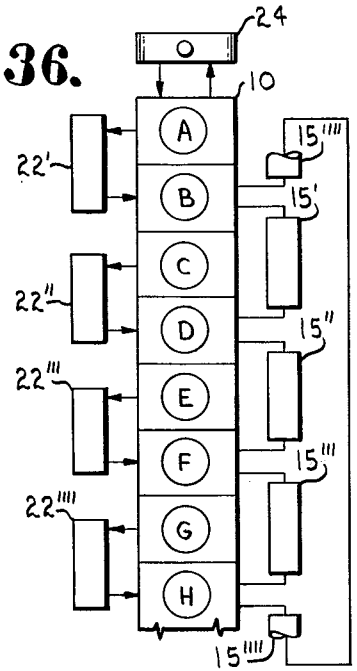
FIG. 36 relates to FIGS. 4, 7, and 37 and is a block diagram of an embodiment of an eight cylinder linear compound engine.
Figure 37:
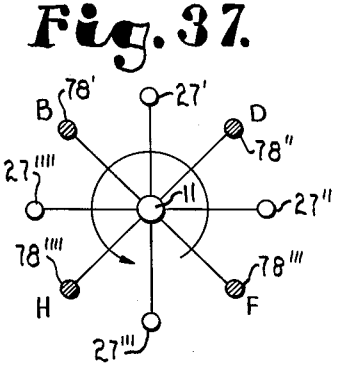
FIG. 37 relates to FIGS. 4, 7, and 36 and is an end-on schematic diagram of the configuration and corresponding direction of rotation of the crankshaft for an embodiment of an eight cylinder linar compound engine.

Reference is made to a twelfth preferred embodiment comprising an eight cylinder linear compound internal-combustion hot-gas engine according to the present invention as shown in FIGS. 4, 7, 36, and 37; wherein FIG. 4 shows in cross section an internal-combustion unit, the FIG. 7 shows in cross section a hot-gas unit, with the internal-combustion unit and the hot-gas unit usable four times each to the block diagram of FIG. 36 and the schematic diagram of FIG. 37.

The twelfth and first preferred embodiments of a compound internal-combustion hot-gas engine are similar, except that in the twelfth preferred embodiment the internal-combustion means comprises four of the internal-combustion units of the type shown in FIG. 4, and the hot-gas means comprises four of the hot-gas units of the type shown in FIG. 7. The mechanical and thermal interconnections and the functions of the internal-combustion means and the hot-gas means for the twelfth preferred embodiment are similar to those described for the first preferred embodiment.

FIG. 36 is a block diagram of a compound engine according to the twelfth preferred embodiment, wherein are shown blocks representing an engine casting 10, regenerators 15', 15'', 15''', and 15'''', recuperators 22', 22'', 22''', and 22'''', and radiator 24. Block units A, C, E, and G each represent an internal-combustion unit of the type shown in FIG. 4. Block units B, D, F, and H each represent a double-acting hot-gas unit of the type shown in FIG. 7. Arrows in FIG. 36 represent the direction of flow of thermal energy from exhaust gases of the internal-combustion units A, C, E, and G to the recuperator 22 and then through heat pipes or by conduction to heaters 16 of hot-gas units B, D, F, and H. Two other arrows represent the flow of liquid coolant 39 between the engine casting 10 and radiator 24. The eight circles in FIG. 36 each represent a cylinder within the compound engine.

Referring to FIGS. 7 and 36, each cool compression space 85 below a double-acting piston 84 is interconnected via a duct 87 through a regenerator 15 to a hot expansion space 86 above another double-acting piston 84. Referring to FIG. 36 the interconnections are:

- Cool space 85' of B interconnected via 15' to hot space 86'' of D,
- Cool space 85'' of D interconnected via 15'' to hot space 86''' of F,
- Cool space 85''' of F interconnected via 15''' to hot space 86'''' of H.
- Cool space 85'''' of H interconnected via 15'''' to hot space 86' of B.

FIG. 37 is an end-on schematic diagram of the relative placement of eight connecting-rod journals on a crankshaft 11 usable to the twelfth embodiment of a compound engine. Notations B, D, F, and H of FIG. 37 relate to B, D, F, and H of FIG. 36. The unshaded circle 11 central to FIG. 37 represents the central rotational axis of crankshaft 11. The shaded circles 78', 78'', 78''', and 78'''' each relate to a separate connecting-rod journal 78 of four double-acting hot-gas units of the type shown in FIG. 7. The unshaded circles 27', 27'', 27''', and 27'''' each relate to a separate connecting-rod journal 27 of four internal-combustion units of the type shown in FIG. 4. The circular arrow in FIG. 37 relates to similar arrows adjacent to countermasses 26 of FIG. 4 and 77 of FIG. 7, and denotes the counter clockwise direction of rotation of crankshaft 11.

The relative placement of connecting-rod journals 78 requires that $\alpha_{c=\alpha e} + \pi/2$; where $\alpha_n$ is an angular position of connecting-rod journals 78', 78'', 78''', or 78''''; wherein subscripts $c$ and $e$ refer respectively to interconnected compression 85 and expansion 86 spaces; and wherein $\alpha_n = 0$ when the piston associated with the $n^{th}$ connecting-rod journal is at TDC in its cylinder. In addition to the phase difference of $\pi/2$ radians between $\alpha_c$ and $\alpha_e$ due to placement of the connecting-rod journals on the crankshaft, there is an intrinsic phase difference of $\pi$ radians between expansion 86 and compression 85 spaces, because these spaces are on opposite sides of the double-acting pistons 84. Cyclic variations in the volume $V_e$ of the expansion space 86 thus lead those in the volume $V_c$ of the interconnected compression space 85 by $\pi/2$ radians. Minimum and maximum total volumes $V_t$ of the working medium in interconnected spaces 86 and 85 occur when the trigonometric relation $\sin \alpha_c = \sin \alpha_e$ is satisfied. Minimum volume $V_t$ occurs when $\alpha_e = \pi/4$ and $\alpha_c = 3\pi/4$, and maximum $V_t$ when $\alpha_e = 5\pi/4$ and $\alpha_c = 7\pi/4$. The quartet of double-acting hot-gas units; B, D, F, and G of FIG. 36; provides positive output torque to crankshaft 11 throughout the repetitive cycle.

The internal-combustion means operates in either the two-stroke or four-stroke cycle.

When the internal-combustion means is constructed so that crankshaft 11 is driven in the clockwise direction, then the hot-gas means operates as a refrigerator. Variations in the volumes $V_e$ then lag those in the interconnected volumes $V_c$ by $\pi/2$ radians.

THIRTEENTH PREFERRED EMBODIMENT

Figure 40:
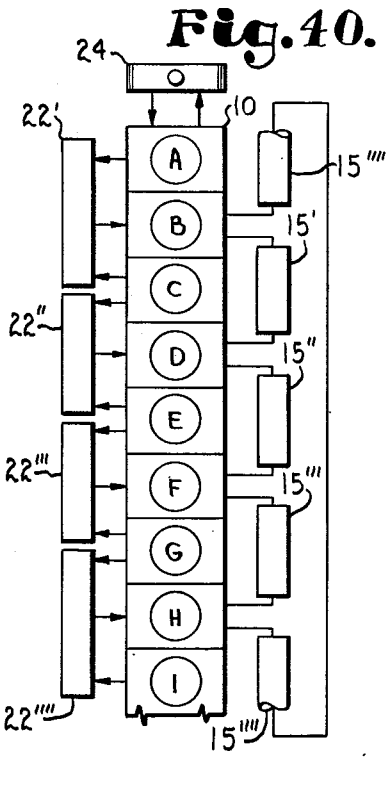
FIG. 40 relates to FIGS. 4, 7, and 41 and is a block diagram of an embodiment of a nine cylinder linear compound engine.
Figure 41:
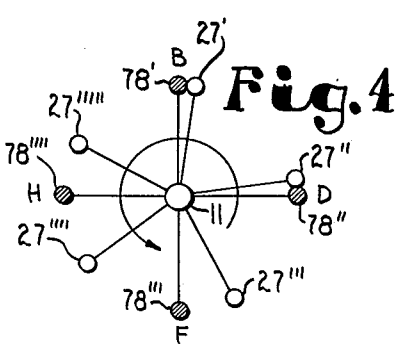
FIG. 41 relates to FIGS. 4, 7, and 40 and is an end-on schematic diagram of the configuration and corresponding direction of rotation of the crankshaft for an embodiment of a nine cylinder linear compound engine.

Reference is made to a thirteenth preferred embodiment comprising a nine cylinder linear compound internal-combustion hot-gas engine according to the present invention as shown in FIGS. 4, 7, 40, and 41; wherein FIG. 4 shows in cross section an internal-combustion unit, and FIG. 7 shows in cross section a hot-gas unit, with the internal-combustion unit usable five times and the hot-gas unit usable four times to the block diagram of FIG. 40 and the schematic diagram of FIG. 41.

The thirteenth and first preferred embodiments of a compound engine are similar, except that in the thirteenth embodiment the inter-combustion means comprises five of the internal-combustion units of the type shown in FIG. 4, and the hot-gas means comprises four of the hot-gas units of the type shown in FIG. 7. The mechanical and thermal interconnections and the functions of the internal-combustion means and the hot-gas means for the thirteenth preferred embodiment are similar to those described for the first preferred embodiment.

FIG. 40 is a block diagram of a compound engine according to the thirteenth preferred embodiment, wherein are shown blocks representing an engine casting 10, regenerators 15', 15'', 15''', and 15'''', recuperators 22', 22'', 22''', and 22'''', and radiator 24. Block units A, C, E, G, and I each represent an internal-combustion unit of the type shown in FIG. 4. Block units B, D, F, and H each represent a double-acting hot-gas unit of the type shown in FIG. 7. The nine circles in FIG. 40 each represent a cylinder within the compound engine. Arrows in FIG. 40 represent the direction of flow of thermal energy from exhaust gases of internal-combustion units A, C, E, G, and I to the recuperators 22', 22'', 22''', and 22'''' and then through heat pipes or by conduction to heaters 16', 16'', and 16''' of hot-gas units B, D, F, and H, respectively. Other arrows represent the flow of liquid coolant between the engine casting 10 and radiator 24.

Referring to FIGS. 7 and 40, each cool compression space 85 below a double-acting piston 84 is interconnected via a duct 87 through a regenerator 15 to a hot expansion space 86 above another double-acting piston 84. Referring to FIG. 36 the interconnections are:

- Cool space 85' of B interconnected via 15' to hot space 86'' of D,
- Cool space 85'' of D interconnected via 15'' to hot space 86''' of F,
- Cool space 85''' of F interconnected via 15''' to hot space 86'''' of H, and
- Cool space 85'''' of H interconnected via 15'''' to hot space 86' of B.

FIG. 41 is an end-on schematic diagram of the relative placement of nine connecting-rod journals on a crankshaft 11 usable to the thirteenth embodiment of a compound engine. Notations B, D, F, and H of FIG. 41 relate to B, D, F, and H of FIG. 40. The unshaded circle 11 central to FIG. 41 represents the central rotational axis of crankshaft 11. The four shaded circles 78', 78'', 78''', and 78'''' each relate to a separate connecting-rod journal 78 of four double-acting hot-gas units of the type shown in FIG. 7. The five unshaded circles 27', 27'', 27''', 27'''', and 27''''' each relate to a separate connecting-rod journal 27 of five internal-combustion units of the type shown in FIG. 4. The circular arrow in FIG. 41 relates to similar arrows adjacent to countermasses 26 of FIG. 4 and 77 of FIG. 7, and designate the counter clockwise rotation of crankshaft 11. The relative placement of connecting-rod journals 78 on crankshaft 11 requires that $\alpha_c = \alpha_e + \pi/2$; where $\alpha_n$ is an angular position of connecting-rod journals 78', 78'', 78''', and 78'''' which ranges from 0 to $2\pi$ radians; wherein subscripts c and e refer respectively to interconnected compression 85 and expansion 86 spaces; and wherein $\alpha_n = 0$ when the piston associated with the $n^{th}$ connecting-rod journal is at TDC in its cylinder. In addition to the phase difference of $\pi/2$ radians between $\alpha_c$ and $\alpha_e$ due to placement of connecting-rod hournals on the crankshaft 11 there is an intrinsic phase difference of $\pi$ radians between compression 85 and expansion 86 spaces, because these spaces are on opposite sides of the double-acting pistons 84. Thus cyclic variations in the volume $V_e$ of an expansion space 86 lead those in the volume $V_c$ of an interconnected compression space 85 by $\pi/2$ radians. Minimum and maximum total volumes $V_t$ of the working medium in two interconnected spaces 86 and 85 occur when the trigonometric relation $\sin \alpha_c = \sin \alpha_e$ is satisfied; that is minimum when $\alpha_e = \pi/4$ and $\alpha_c = 3\pi/4$, and maximum when $\alpha_e = 5\pi/4$ and $\alpha_c = 3\pi/4$. The quartet of double-acting hot-gas units; B, D, F, and H of FIG. 40; provides a positive torque to the crankshaft throughout the repetitive cycle.

The internal-combustion means operates in either the two-stroke or four-stroke cycle.

When the internal-combustion means is constructed so that it drives crankshaft 11 in the clockwise direction, then variations in volumes $V_e$ lag those in interconnected volumes $V_c$ by $\pi/2$ radians, and the hot-gas means operates as a refrigerator.

FOURTEENTH PREFERRED EMBODIMENT

Figure 42:
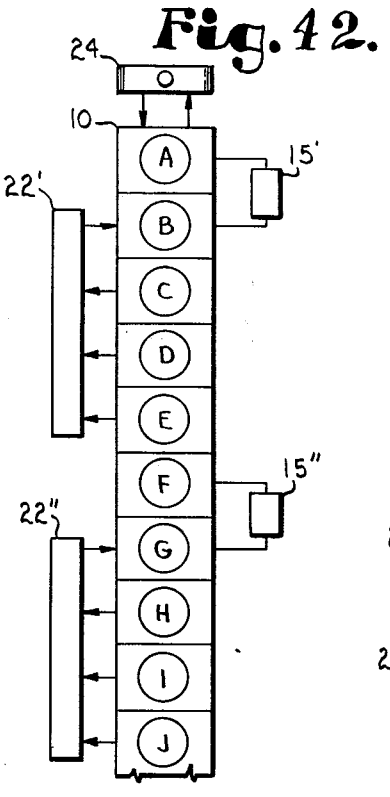
FIG. 42 relates to FIGS. 4, 5, 6, and 43 and is a block diagram of an embodiment of a ten cylinder linear compound engine.
Figure 43:
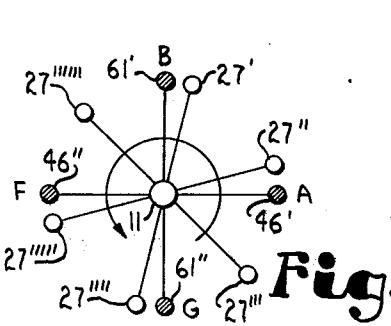
FIG. 43 relates to FIGS. 4, 5, 6, and 42 and is an end-on schematic diagram of the configuration and corresponding direction of rotation of the crankshaft for an embodiment of a ten cylinder linear compound engine.

Reference is made to a fourteenth preferred embodiment comprising a first ten cylinder linear compound internal-combustion hot-gas engine according to the present invention as shown in FIGS. 4, 5, 6, 42, and 43; wherein FIG. 4 shows in cross section an internal-combustion unit, and FIGS. 5 and 6 show in cross section a cool-space hot-gas unit and a hot-space hot-gas unit, respectively, with the internal-combustion unit usable six times and said hot-gas units usable two times each to the block diagram of FIG. 42 and to the schematic diagram of FIG. 43. Each preferred embodiment of a compound engine described herein can be repeated adinfinitum, thus providing other compound engines having $2x$, $3x$, $4x$, etc. as many cylinders as contained in the original basic compound engine. In that manner the ten cylinder compound engine according to the fourteenth embodiment is a $2x$ repetition of the five cylinder compound engine described herein as the sixth preferred embodiment. The mechanical and thermal interconnections and the functions of the internal-combustion means and the hot-gas means are thus similar to those described in the preferred embodiment. The internal-combustion means comprises six of the internal combustion units of the type shown in FIG. 4. The hot-gas means comprises two each of the cool-space hot-gas units and the hot-space hot-gas units of the type shown in FIGS. 5 and 6, respectively.

FIG. 42 is a block diagram of a compound engine according to the fourteenth preferred embodiment, wherein are shown blocks representing an engine casting 10, regenerators 15' and 15'', recuperators 22' and 22'' and radiator 24. Block units A and F each represent a cool-space hot-gas unit of the type shown in FIG. 5. Block units B and G each represent a hot-space hot-gas unit of the type shown in FIG. 6. Block units C, D, E, H, I, and J each represent an internal-combustion unit of the type shown in FIG. 4. The ten circles in FIG. 42 each represent a cylinder within the compound engine. The arrows in FIG. 42 represent the flow of thermal energy and the flow of liquid coolant 39 as previously described in the sixth preferred embodiment.

Referring to FIGS. 5, 6, and 42, each cool compression space 52 is interconnected via a duct 54 through a regenerator 15 to a hot expansion space 73. Referring to FIG. 42 the interconnections are:

Cool space 52' of A interconnected via 15' to hot space 73' of B, and Cool space 52'' of F interconnected via 15'' to hot space 73'' of G.

FIG. 43 is an end-on schematic diagram of the relative placement of connecting-rod journals on a crankshaft 11 usable to the fourteenth preferred embodiment of a compound engine. Notations A, B, F, and G in FIG. 43 relate to A, B, F, and G of FIG. 42. The unshaded circle 11 central to FIG. 43 represents the central rotational axis of crankshaft 11. The shaded circles 46' and 46'' each relate to a separate connecting-rod journal 46 of two hot-gas units of the type shown in FIG. 5. Shaded circles 61' and 61'' each relate to a separate connecting-rod journal 61 of two hot-gas units of the type shown in FIG. 6. The six unshaded circles 27', 27'', 27''', 27'''' 27''''', and 27'''''' each relate to a separate connecting-rod journal 27 of six internal-combustion units of the typw shown in FIG. 4. The circular arrow in FIG. 43 relates to similar arrows adjacent to countermasses 26 of FIG. 4, 45 of FIG. 5, and 60 of FIG. 6, and donotes the counter clockwise direction of rotation of crankshaft 11.

The relative placement of connecting-rod journals 61 and 46 require that $\alpha_e = \alpha_c + \pi/2$; wherein $\alpha$ is an angular position of connecting-rod journals 46', 61', 46'', and 61'' which ranges from 0 to $2\pi$ radians; wherein subscripts $e$ and $c$ refer respectively to interconnected expansion 73 and compression 52 spaces; and wherein $\alpha_n = 0$ when the piston associated with the $n^{th}$ connecting-rod journal is at TDC in its cylinder. Cyclic variations in volume $V_e$ of the expansion space 73 lead those in volume $V_c$ in the interconnected compression space 52 by $\pi/2$ radians. Minimum and maximum total volumes $V_t$ of the working medium in interconnected spaces 73 and 52 occur when the trigonometric relation $\sin \alpha_e = -\sin \alpha_c$ is satisfied; that is minimum when $\alpha_e = \pi/4$ and $\alpha_c = 7\pi/4$, and maximum when $\alpha_e = 5\pi/4$ and $\alpha_c = 3\pi/4$.

The internal-combustion means operates in either the two-stroke or four-stroke cycle.

When the internal-combustion means is constructed so that it drives crankshaft 11 clockwise, then variations in volumes $V_e$ lag those in interconnected volumes $V_c$ by $\pi/2$ radians and the hot-gas means operates as a refrigerator.

FIFTEENTH PREFERRED EMBODIMENT

Figure 44:
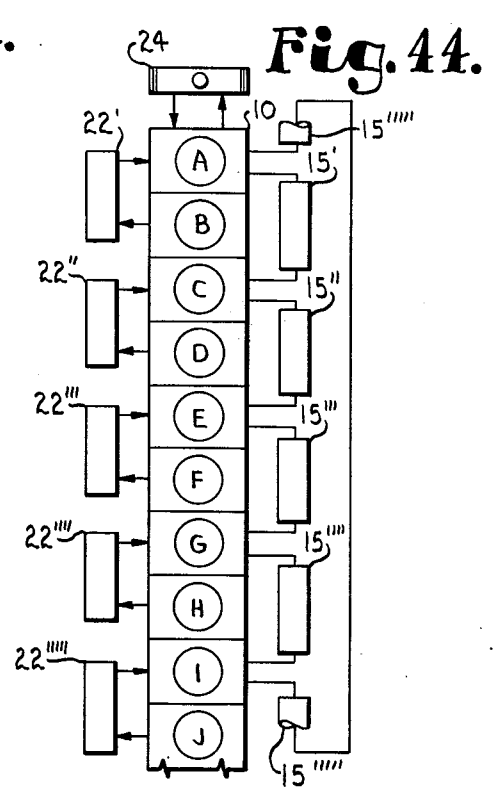
FIG. 44 relates to FIGS. 4, 7, and 45 and is a block diagram of an embodiment of a ten cylinder compound engine.
Figure 45:
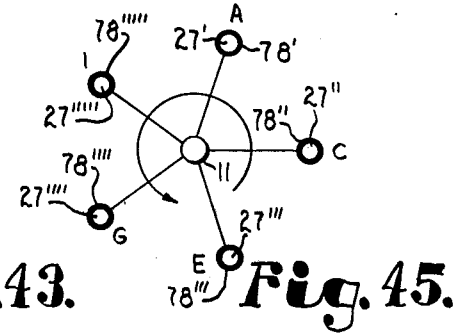
FIG. 45 relates to FIGS. 4, 7, and 44 and is an end-on schematic diagram of the direction of rotation and corresponding configuration of the crankshaft for an embodiment of a ten cylinder linear compound engine.

Reference is made to a fifteenth preferred embodiment comprising a second ten cylinder linear compound internal-combustion hot-gas engine according to the present invention as shown in FIGS. 4, 7, 44, and 45; where FIG. 4 shows in cross section an internal-combustion unit, and FIG. 7 shows in cross section a hot-gas unit, with the internal-combustion unit and the hot-gas unit usable five times each to the block diagram of FIG. 44 and the schematic diagram of FIG. 45.

The fifteenth and first preferred embodiments of a compound internal-combustion hot-gas engine are similar, except that in the fifteenth embodiment the internal-combustion means comprises five of the internal-combustion units of the type shown in FIG. 4, and the hot-gas means comprises five of the hot-gas units of the type shown in FIG. 7. The mechanical and thermal interconnections and the functions of the internal-combustion means and the hot-gas means for the fifteenth embodiment are similar to those described for the first embodiment.

FIG. 44 is a block diagram of a compound engine according to the fifteenth embodiment, wherein are shown blocks representing an engine casting 10, regenerators 15', 15'', 15''', 15'''', and 15''''', recuperators 22', 22'', 22''', 22'''', and 22''''', and radiator 24. Block units A, C, E, G, and I each represent a double-acting hot-gas unit of the type shown in FIG. 7. Block units B, D, F, H, and J each represent an internal-combustion unit of the type shown in FIG. 4. Arrows in FIG. 44 represent the direction of flow of thermal energy from the exhaust gases of internal-combustion units B, D, F, H, and J to the recuperator 22 and then through heat pipes 23 or by conduction to the heaters 16 of hot-gas units, A, C, E, G, and I. Two other arrows represent the flow of liquid coolant 39 between engine casting 10 and radiator 24. The ten circles in FIG. 44 each represent a cylinder within the compound engine.

Referring to FIGS. 7 and 44, each cool compression space 85 below a double-acting piston 84 is interconnected via a duct 87 through a regenerator 15 to a hot expansion space 86 above another double-acting piston 84. Referring to FIG. 44 the interconnections are:

Cool space 85' of A interconnected via 15' to the hot space 86'' of C, Cool space 85'' of C interconnected via 15'' to the hot space 86''' of E, Cool space 85''' of E interconnected via 15''' to the hot space 86 '''' of G, Cool space 85'''' of G interconnected via 15'''' to the hot space 86''''' of I, Cool space 85''''' of I interconnected via 15''''' to the hot space 86' of A.

FIG. 45 is an end-on schematic diagram of the relative placement of connecting-rod journals on a crankshaft 11 usable to the fifteenth embodiment of a compound engine. Notations A, C, E, G, and I of FIG. 45 relate to A, C, E, G, and I of FIG. 44. The unshaded circle 11 central to FIG. 45 represents the central rotational axis of crankshaft 11. The five shaded circles 78', 78'', 78''', 78'''', and 78''''' each relate to a separate connecting-rod journal 78 of five double-acting hot-gas units of the type shown in FIG. 7. The five unshaded circles 27', 27'', 27''', 27'''', and 27''''' each relate to a separate connecting-rod journal 27 of five internal-combustion units of the type shown in FIG. 4. The circular arrow in FIG. 45 relates to similar arrows adjacent to countermasses 26 of FIG. 4 and 77 of FIG. 7, and denotes the counter clockwise rotation of crankshaft 11.

The relative placement of connecting-rod journals 78 requires that $\alpha_c = \alpha_e + 2\pi/5$; wherein $\alpha_c$ is an angular position of connecting-rod journals 78', . . . , 78''''' which ranges from 0 to $2\pi$ radians; wherein subscripts $c$ and $e$ refer respectively to interconnected compression 85 and expansion 86 spaces; wherein $\alpha_c = 0$ when the piston associated with the $n^{th}$ connecting-rod journal is at TDC in its cylinder. In addition to the phase difference of $2\pi/5$ radians between $\alpha_c$ and $\alpha_e$ due to placement of connecting-rod journals on the crankshaft 11, there is an intrinsic phase difference of $\pi$ radians between compression 85 and expansion 86 spaces because these spaces are on opposite sides of the double-acting pistons 84. Cyclic variations in the volume $V_e$ of an expansion space 86 thus lead those in the volume $V_c$ of an interconnected compression space 85 by $3\pi/5$ radians. Minimum and maximum total volume $V_t$ of the working medium in two interconnected spaces 86 and 85 occur when the trigonometric relation $\sin \alpha_e = \sin \alpha_c$ is satisfied; that is minimum when $\alpha_c = 3\pi/10$ and $\alpha_c = 7\pi/10$ and maximum when $\alpha_e = 13\pi/10$ and $\alpha_c = 17\pi/10$. The pentad of double-acting hot-gas units; A, C, E, G, and I of FIG. 44, provides a positive torque to the crankshaft throughout the repetitive cycle.

When the internal-combustion means is constructed so that it drives crankshaft 11 in the clockwise direction, then variations in volumes $V_e$ lag those in interconnected volumes $V_c$ by $3\pi/5$ radians and the hot gas means operates as a refrigerator.

SIXTEENTH PREFERRED EMBODIMENT

Figure 46:
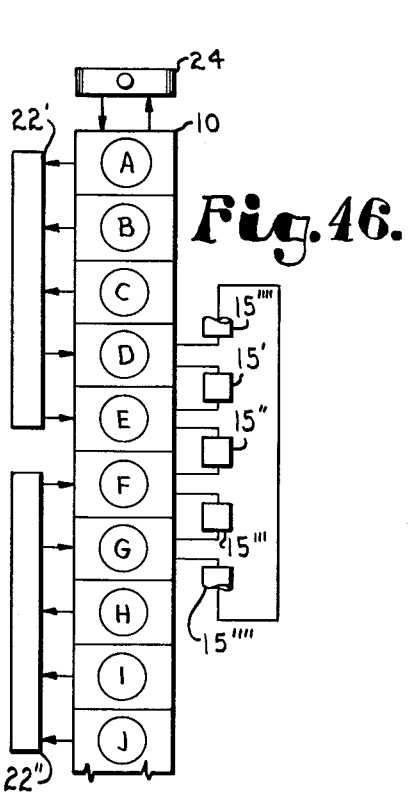
FIG. 46 relates to FIGS. 4, 7, and 47 and is a block diagram of an embodiment of a ten cylinder linear compound engine.
Figure 47:
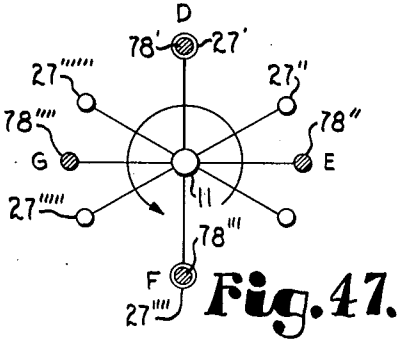
FIG. 47 relates to FIGS. 4, 7, and 46 and is an end-on schematic diagram of the configuration and corresponding direction of rotation of the crankshaft for an embodiment of a ten cylinder linear compound engine.

Reference is made to a sixteenth preferred embodiment comprising a third ten cylinder linear compound internal-combustion hot-gas engine according to the present invention as shown in FIGS. 4, 7, 46, and 47; wherein FIG. 4 shows in cross section an internal-combustion unit, and FIG. 7 shows in cross section a hot-gas unit, with the internal-combustion unit usable six times and the hot-gas unitusable four times to the block diagram shown in FIG. 46 and the schematic diagram shown in FIG. 47. The internal-combustion means for the sixteenth preferred embodiment comprises six internal-combustion units of the type shown in FIG. 4. The internal-combustion means operates in either the two-stroke or four-stroke cycle. The hot-gas means for the sixteenth embodiment comprises four double-acting hot-gas units of the type shown in FIG. 7. The units in FIGS. 4 and 7 were described previously in the first preferred embodiment of a compound engine. The functions and interconnections of these units in the sixteenth embodiment are similar to those previously described herein.

FIG. 46 is a block diagram of a compound engine according to the sixteenth embodiment, wherein are shown blocks representing an engine casting 10, regenerators 15', 15'', 15''', and 15'''', recuperators 22', 22'', 22''', and 22'''', and radiator 24. Block units A, B, C, H, I, and J each represent an internal-combustion unit of the type shown in FIG. 4. Block units D, E, F, and G each represent a double-acting hot-gas unit of the type shown in FIG. 7. Arrows in FIG. 46 represent the direction of flow of thermal energy from exhaust gases of internal-combustion units A, B, C, D, F, G, H, and I to the recuperators 22 and then through heat pipes 23 or by conduction to the heaters 16 of hot-gas units D, E, F, and G. Other arrows represent the flow of liquid coolant between engine casting 10 and radiator 24. The ten circles in FIG. 46 each represent a cylinder within the compound engine.

Referring to FIGS. 7 and 46, each cool compression space 85 below a double-acting piston 84 is interconnected via a duct 87 through a regenerator 15 to a hot expansion space 86 above another double-acting piston 84. Referring to FIG. 47 the interconnections are:

- Cool space 85' of D interconnected via 15' to hot space 86'' of E,
- Cool space 85'' of E interconnected via 15'' to hot space 86''' of F,
- Cool space 85''' of F interconnected via 15''' to hot space 86'''' of G, and
- Cool space 85'''' of G interconnected via 15'''' to hot space 86' of D.

FIG. 47 is an end-on schematic diagram of the relative placement of connecting-rod journals on a crankshaft 11 usable to the sixteenth embodiment of a compound engine. Notations D, E, F, and G of FIG. 47 relate to D, E, F, and G of FIG. 46. The four shaded circles 78', 78'', 78''', and 78'''' each relate to a separate connecting-rod journal 78 of four double-acting hot-gas units of the type shown in FIG. 7. The six unshaded circles 27', 27'', 27''', 27'''', 27''''', and 27'''''' each relate to a separate connecting-rod journal 27 of six internal-combustion units of the type shown in FIG. 4. The circular arrow in FIG. 47 relates to similar arrows adjacent to countermasses 26 of FIG. 4 and 45 of FIG. 7, and denotes counter clockwise rotation of crankshaft 11.

The relative placement of connecting-rod journals 78 requires that $\alpha_c = \alpha_e + \pi/2$: wherein $\alpha_n$ is an angular position of connecting-rod journals 78', 78'', 78''', or 78'''' which ranges from 0 to $2\pi$ radians: wherein subscripts *c* and *e* refer respectively to interconnected compression 85 and expansion 86 spaces; wherein $\alpha_n = 0$ when the piston associated with the $n^{th}$ connecting-rod journals is at TDC in its cylinder. The additional intrinsic $\pi$ radians phase difference characteristic of double-acting pistons 84 provides that cyclic variations in the volume $V_e$ of an expansion space 86 lead those in the volume $V_c$ of an interconnected compression space 85 by $\pi/2$ radians. Minimum and maximum total volumes $V_t$ of the working medium in two interconnected spaces 86 and 85 occur when the trigonometric relation $\sin \alpha_e = \sin \alpha_c$ is satisfied; that is minimum when $\alpha_e = \pi/4$ and $\alpha_c = 3\pi/4$, and maximum when $\alpha_e = 5\pi/4$ and $\alpha_c = 7\pi/4$. The quartet of double-acting hot-gas units; D, E, F, and G of FIG. 46; provides a positive output torque to the crankshaft throughout the repetitive cycle.

When the internal-combustion means is constructed so that it drives crankshaft 11 clockwise, then variations in volumes $V_e$ lag those in interconnected volumes $V_c$ and the hot-gas means operates as a refrigerator.

SEVENTEENTH PREFERRED EMBODIMENT

Reference is made to a seventeenth preferred embodiment comprising a ten cylinder arbitrary-vee compound internal-combustion hot-gas engine according to the present invention as shown in FIG. 11, 14, 48, and 49. The internal-combustion means for the seventeenth preferred embodiment comprises five each right-hand halves of the internal-combustion unit of the type shown in FIG. 11. The internal-combustion means operates in either the two-stroke or four-stroke cycle. The hot-gas means for the seventeenth preferred embodiment comprises five each left-hand halves of the double-acting hot-gas unit of the type shown in FIG. 14. Said units shown in FIGS. 11 and 14 were described previously in the second preferred embodiment of a compound engine. The functions and methods of interconncting said units in the seventeenth embodiment are similar to those described previously herein. The vee-angle may be chosen arbitrarily within the range from 0° to 180°.

Figure 48:
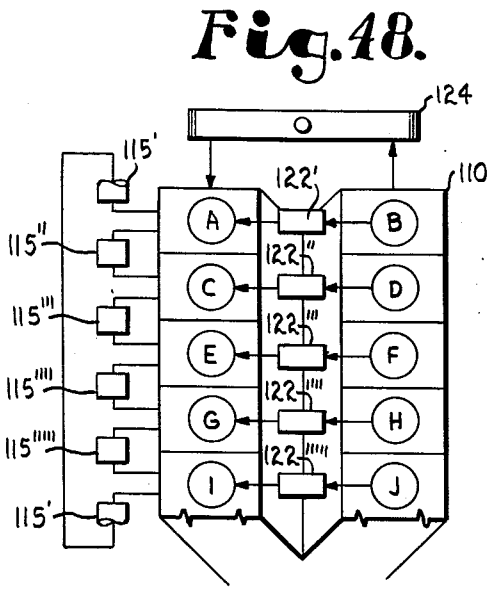
FIG. 48 relates in part to FIGS. 11 and 14, and relates to FIG. 49, and is a block diagram of an embodiment of a ten cylinder vee compound engine.

FIG. 48 is a block diagram of a compound engine according to the seventeenth embodiment, wherein are shown blocks representing an engine casting 110; five regenerators 115', 115'',115''', 115'''', and 155'''' ; five recuperators 122', 122'', 122''', 122'''', and 122''''; and a radiator 124. Block units A, C, E, G, and I each represent a left-hand half of the double-acting hot-gas unit of the type shown in FIG. 14. Block units B, D, F, H, and J each represent a right-hand half of the internal-combustion unit of the type shown in FIG. 11. Arrows in FIG. 48 represent the direction of flow of thermal energy from exhaust gases of internal-combustion units B, D, F, H, and J to the recuperators 122', 122'', 122''', 122'''', and 122''' and then through heat pipes 123 or by conduction to the heaters 116'' of hot-gas units A, C, E, G, and I. The other two arrows in FIG. 48 represent the flow of liquid coolant between engine casting 110 and radiator 124. The ten circles in FIG. 48 each represent a cylinder within the compound engine.

Referring to the left-hand portion of FIG. 14 and to FIG. 48, each of the five cool compression spaces 185 below a double-acting piston 184 is interconnected via duct 187 through a regenerator 115 to one of the five hot expansion spaces 185 above another double-acting piston 184. Referring to FIG. 48 the interconnections are:

- Cool space 185'' of A interconnected via 115'' hot space 186''' of C,
- Cool space 185''' of C interconnected via 115''' to hot space 186'''' of E,
- Cool space 185'''' of E interconnected via 115'''' to hot space 186''''' of G,
- Cool space 185''''' of G interconnected via 115''''' to hot space 186' of I and
- Cool space 185' of I interconnected via 115' to hot space 186'' of A.

Figure 49:
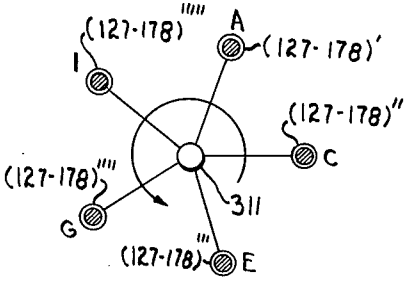
FIG. 49 relates to FIG. 48, and in part relates to FIGS. 11 and 14, and is an end-on schematic diagram of the configuration and corresponding direction of rotation of the crankshaft for an embodiment of a ten cylinder vee compound engine.

FIG. 49 is an end-on schematic diagram of the relative placement of connecting-rod journals on a crankshaft 311 usable to the seventeenth embodiment of a compound engine. Notations A, C, E, G, and I of FIG. 49 relate to A, C, E, G, and I of FIG. 48. The unshaded circle 311 central to FIG. 49 represents the central rotational axis of crankshaft 311. In FIG. 49 each of the five pairs of unshaded circles (127–178)', (127–178)'', (127–178)''', (127–178)'''', and (127–178)''''' relates to a common connecting-rod journal (127–178) for the respective right-hand and left-hand halves of the units shown in FIGS. 11 and 14. The relative placement of the five connecting-rod journals on the crankshaft requires that $\alpha_c = \alpha_e + 2\pi/5$; wherein $\alpha$'s are individual angular positions of connecting-rod journals (127–178)', (127–178)'', (127–178)''', (127–178)'''', and (127–178)''''' which range from 0 to $2\pi$radians; wherein subscripts $c$ and $e$ refer respectively to interconnected compression 185 and expansion 186 spaces; and wherein $\alpha_n = 0$ when the double-acting hot-gas piston 184 associated with the $n^{th}$ connecting-rod journals is at TDC in its cylinder. The additional phase difference of $\pi$ radians intrinsic to double-acting pistons provides that cyclic variations in the volume $V_e$ of an expansion space 186 lead those in the volume $V_c$ of an interconnected compression space 185 by $3\pi/5$ radians. Minimum and maximum total volumes $V_t$ of the working medium in two interconnected spaces 186 and 185 occur when the trigonometric relation $\sin \alpha_e = \sin \alpha_c$ is satisfied; that is minimum when $\alpha_e = 3\pi/10$ and $\alpha_c = 7\pi/10$, and maximum volume when $\alpha_e = 13\pi/10$ and $\alpha_c = 17\pi/10$. The pentad of double-acting hot-gas units; A, C, E, G, and I of FIG. 49; provides a positive output torque to the crankshaft throughout the repetitive cycle.

When the internal-combustion means is constructed so that it drives crankshaft 311 clockwise, then variations in volume $V_e$ lag those in interconnected volumes $V_c$ by $3\pi/5$ radians and hot-gas means operates as a refrigerator.

EIGHTEENTH PREFERRED EMBODIMENT

Reference is made to an eighteenth basic preferred embodiment comprising a ten cylinder 60° vee-compound internal-combustion hot-gas engine according to the present invention as shown in FIGS. 11, 13, 50, and 51. The internal-combustion means for the eighteenth preferred embodiment comprises three of the internal-combusion units as shown in FIG. 11, except the vee-angle is 60° rather than 90° as shown in FIG. 11. The internal-combustion means operates in either the two-stroke or four-stroke cycle. The hot-gas means for the eighteenth preferred embodiment comprises two of the single-acting hot-gas units of the type shown in FIG. 13, except the vee-angle is 0° rather than 90° as shown in FIG. 13, and where the two cylinders shown in FIG. 13 are also displaced so that they are side-by-side. Said units in FIGS. 11 and 13 were described previously herein; the functions of said units in the eighteenth preferred embodiment are similar to those previously described herein.

Figure 50:
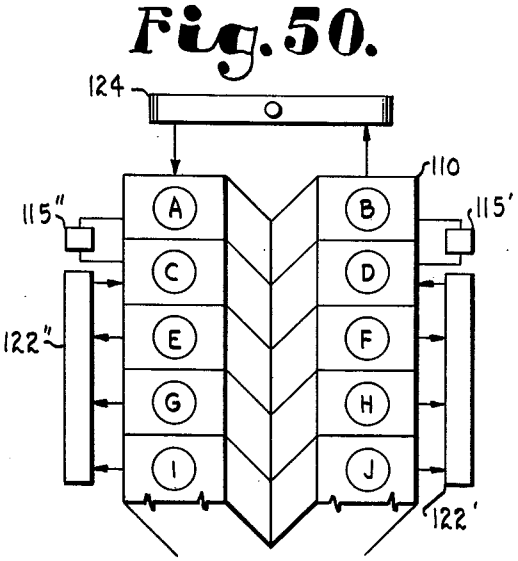
FIG. 50 relates to FIGS. 11 and 51, and in part relates to FIG. 13, and is a block diagram of an embodiment of a ten cylinder vee compound engine.

FIG. 50 is a block diagram of a compound engine according to the eighteenth preferred embodiment, wherein are shown blocks representing an engine casting 110, two regenerators 115' and 115'', two recuperators 122' and 122'', and a radiator 124. Block units EF, GH, and IJ each represent an internal-combustion unit of the type shown in FIG. 11 but with the vee-angle at $\pi/3$ radians. Block units AC and BD each represent a single-acting hot-gas unit of the type shown in FIG. 13 but modified as described in the preceding paragraph. Furthermore, block units C and D each contain the members in the right-hand half of FIG. 13, and block units A and B each contain the members in the left-hand half of FIG. 13. Arrows in FIG. 50 represent the direction of flow of thermal energy from exhaust gases of internal-combustion parts F, H, J, and E, G, I to the recuperators 122', and 122'' and then through heat pipes or by conduction to the heaters 170' and 170'' (FIG. 13) of hot-gas parts C and D. The two other arrows represent the flow of liquid coolant between engine casting 110 and radiator 124. The ten circles in FIG. 50 each represent a cylinder within the compound engine.

Referring to FIGS. 13 and 50, each of the cool compression spaces 152 in Blocks A and B above a single-acting piston 167'' is interconnected via a duct 154 through a regenerator 115 to the hot expansion spaces 168 in Blocks C and D above a single-acting piston 167'. Referring to FIG. 50 the interconnections are:

- Cool space 152'' of A interconnected via 115'' of hot space 168'' of C, and
- Cool space 152' of B interconnected via 115'to hot space 168' of D.

Figure 51:
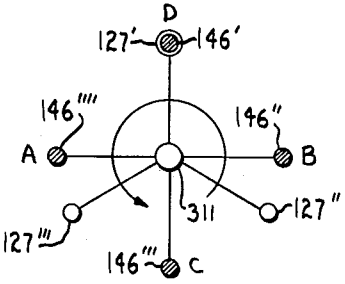
FIG. 51 relates to FIGS. 11 and 50, and relates in part to FIG. 13, and is an end-on schematic diagram of the configuration and corresponding direction of rotation of the crankshaft for an embodiment of a ten cylinder vee compound engine.

FIG. 51 is an end-on schematic diagram of the relative placement of connecting-rod journals on a crankshaft 311 usable to the eighteenth engine. of a compound engine. Notations A, B, C, and D of FIG. 51 relate to A, B, C, and D of FIG. 50. The unshaded circle 311 central to FIG. 51 represents the central rotational axis of crankshaft 311. The four shaded circles 146', 146'', 146''', and 146'''' each relate to a separate connecting-rod journal 146 of a hot-gas unit of the type shown in FIG. 13, except there is only one connecting rod of a hot-gas unit common to a single connecting-rod journal as shown in FIG. 13. The unshaded circles 127', 127'', and 127''' each relate to a separate connecting-rod journal 127 of an internal-combustion unit of the type shown in FIG. 11. The circular arrow in FIG. 31 relates to similar circular arrows adjacent to countermasses 126 of FIG. 11 and 145 of FIG. 13 and denotes the counter clockwise rotation of crankshaft 311.

The relative placement of connecting-rod journals 146 on the crankshaft requires that $\alpha_e = \alpha_c + \pi/2$; wherein the $\alpha$'s are angular positions of the connecting-rod journals 146', 146'', 146''', and 146''''; wherein the subscripts *e* and *c* refer respectively to interconnected expansion 168 and compression 152 spaces; and wherein $\alpha_n = 0$ when the piston associated with the $n^{th}$ connecting-rod journal is at TDC in its cylinder. The relative placement of connecting-rod journals provides that cyclic variations in the volume $V_e$ of an expansion space 168 lead those in the volume $V_c$ of an interconnected compression space 152 by $\pi/2$ radians. Minimum and maximum total volumes $V_t$ of working medium in two interconnected spaces 168 and 152 occur when the trigonometric relation $\sin \alpha_e = -\sin \alpha_c$ is satisfied; that is minimum when $\alpha_e = \pi/4$ and $\alpha_c = 7\pi/4$ and maximum when $\alpha_e = 5\pi/4$ and $\alpha_c = 3\pi/4$.

The hot-gas means operates as a refrigerator when the internal-combustion means drive crankshaft 311 clockwise. Then variations in volumes $V_e$ lag those in interconnected volumes $V_c$ by $\pi/2$ radians.

NINETEENTH PREFERRED EMBODIMENT

Figure 52:
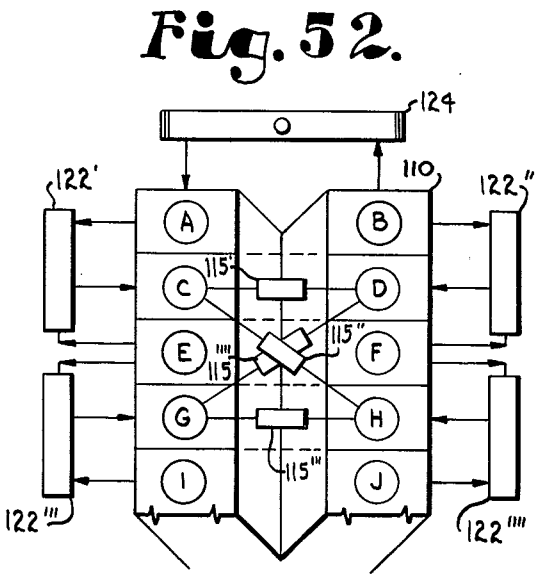
FIG. 52 relates to FIGS. 11, 14, and 53 and is a block diagram of an embodiment of a ten cylinder vee compound engine.
Figure 53:
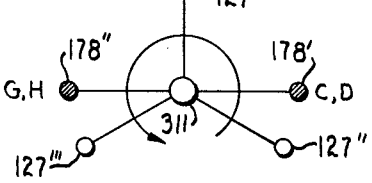
FIG. 53 relates to FIGS. 11, 14, and 52 and is an end-on schematic diagram of the configuration and corresponding direction of rotation of the crankshaft for an embodiment of a ten cylinder vee compound engine.

Reference is made to a nineteenth preferred embodiment comprising a ten cylinder $\pi/3$-vee-internal-combustion $\pi/2$-vee-hot-gas compound internal-combustion hot-gas engine according to the present invention as shown in FIGS. 11, 14, 52, and 53; wherein FIG. 11 shows in cross section an internal-combustion unit, and FIG. 14 shows in cross section a hot-gas unit, with the internal-combustion unit usable three times and the hot-gas unit usable four times to the block diagram shown in FIG. 52 and the schematic diagram shown in FIG. 53. The internal-combustion means for the nineteenth preferred embodiment comprises three internal-combustion units of the type shown in FIG. 11, except the vee-angle is $\pi/3$ radians rather than $\pi/2$ radians as shown in FIG. 11. The internal-combustion means operates in either the two-stroke or four-stroke cycle. The hot-gas means for the nineteenth preferred embodiment comprises two of the $\pi/2$-radian-vee double-acting hot-gas units of the type shown in FIG. 14. Said units in FIGS. 11 and 14 were described previously in the second preferred embodiment. The mechanical and thermal interconnections and functions of said units in the nineteenth embodiment are similar to those previously described in the second embodiment.

FIG. 52 is a block diagram of a compound engine according to the nineteenth preferred embodiment, wherein are shown blocks representing an engine casting 110; four regenerators 115', 115'', 115''', and 115'''', four recuperators 122', 122'', 122''', and 122'''', and a radiator 124. Block units AB, EF, and IJ each represent an internal-combustion unit of the type shown in FIG. 11 but with a vee-angle of $\pi/3$ radians. Block units CD and GH each represent a double-acting hot-gas unit of the type shown in FIG. 14. Arrows in FIG. 52 represent the direction of flow of thermal energy from exhaust gases of internal-combustion units AB, EF, and IJ to recuperators 122', 122'', 122''', 122'''' and then through heat pipes or by conduction to heaters 116 (FIG. 14) of hot-gas units CD and GH. The other two arrows in FIG. 52 represent the flow of liquid coolant between engine casting 110 and radiator 124. The ten circles in FIG. 52 each represent a cylinder within the compound engine.

Referring to FIGS. 14 and 52, each of the cool compression spaces 185 below a double-acting piston 184 in Blocks C, D, G, and H is interconnected via a duct 187 through a regenerator 115 to a hot expansion space 186 above another double-acting piston 184 in Blocks D, G, H and C. Referring to FIG. 52 the interconnections are:

- Cool space 185' of D interconnected via 115' to hot space 186'' of C,
- Cool space 185'' of C interconnected via 115'' to hot space 186''' of H,
- Cool space 185''' of H interconnected via 115''' to hot space 186'''' of G, and
- Cool space 185'''' of G interconnected via 115'''' to hot space 186' of D.

FIG. 53 is an end-on schematic diagram of the relative placement of connecting-rod journals on a crankshaft 311 usable to the nineteenth embodiment of a compound engine. Notations C, D, G, and H in FIG. 53 relate to C, D, G, and H of FIG. 52. The unshaded circle 311 central to FIG. 53 represents the central rotational axis of crankshaft 311. The two shaded circles 178' and 178'' each relate to a separate connecting-rod journal 178 of a double-acting hot-gas unit of the type shown in FIG. 14. The three unshaded circles 127', 127'', and 127''' each relate to a separate connecting-rod journal 127 of an internal-combustion unit shown in FIG. 11 but modified to a 60° vee angle. The circular arrow in FIG. 53 relates to similar arrows adjacent to countermasses 126 of FIG. 11 and 177 of FIG. 13, and denotes counter clockwise rotation of crankshaft 311.

The relative placement of connecting-rod journals on the crankshaft requires that $\alpha_c = \alpha_e + \pi/2$; wherein $\alpha$'s are individual angular positions of pistons 184 associated with connecting-rod journals 178' and 178'' which range from 0 to $2\pi$ radians; wherein subscripts *c* and *e* refer respectively to interconnected compression 185 and expansion 186 spaces; and wherein $\alpha_n = 0$ when the $n^{th}$ piston is at TDC in its cylinder. The additional phase difference of $\pi$ radians intrinsic to double-acting pistions and the 90° vee angle further provide that cyclic variations in the volume $V_e$ of an expansion space 186 lead those in the volume $V_c$ of an interconnected compression space 185 by $\pi/2$ radians. Minimum and maximum total volumes $V_t$ of the working medium in two interconnected spaces 185 and 186 occur when the trigonometric relation $\sin \pi_3 = \sin \alpha_c$ is satisfied; that is minimum when $\alpha_e = \pi/4$ and $\alpha_c = 3\pi/4$, and maximum when $\alpha_e = 5\pi/4$ and $\alpha_c = 7\pi/4$. The quartet of double-acting hot-gas pistons; in block units C, D, G, and H of FIG. 52; delivers a positive torque via their connecting rods to the crankshaft throughout the repetitive hot-gas cycle.

When the internal-combustion unit is constructed so that it drives crankshaft 311 clockwise, then variations in the volumes $V_e$ lag those in interconnected volumes $V_c$ by $\pi/2$ radians and the hot-gas means operates as a refrigerator.

TWENTIETH PREFERRED EMBODIMENT

Figures 54, 55, 56, 57, 58, 59, 60, 61:
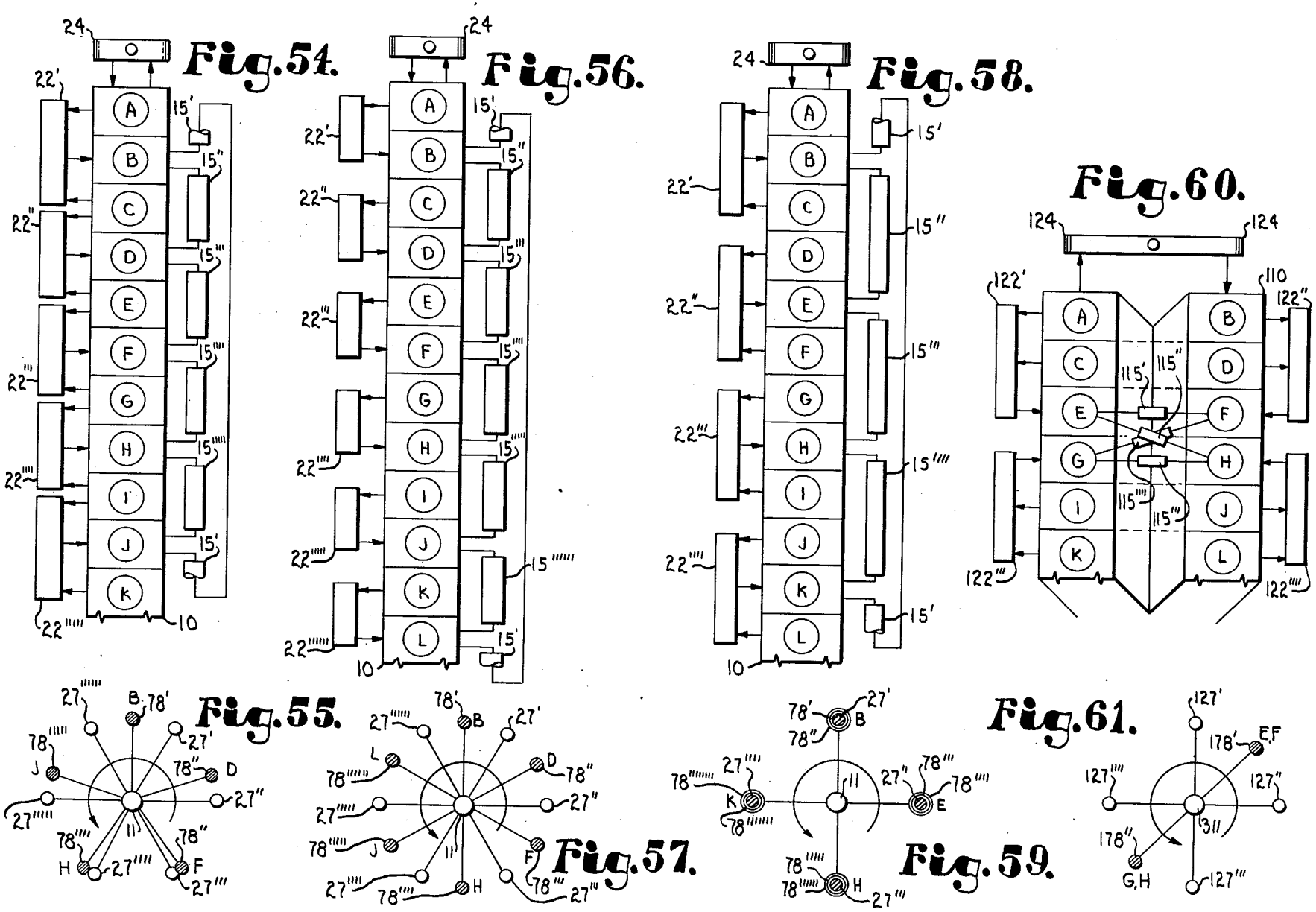
FIG. 54 relates to FIGS. 4, 7, and 55 and is a block diagram of an embodiment of an eleven cylinder linear compound engine, FIG. 55 relates to FIGS. 4, 7, and 54 and is an end-on schematic diagram of the configuration and corresponding direction of rotation of the crankshaft for an embodiment of an eleven cylinder linear compound engine.
FIG. 56 relates to FIGS. 4, 7, and 57 and is a block diagram of an embodiment of a twelve cylinder linear compound engine.
FIG. 57 relates to FIGS. 4, 7, and 56 and is an end-on schematic diagram of the configuration and corresponding direction of rotation of the crankshaft for an embodiment of a twelve cylinder linear compound engine.
FIG. 58 relates to FIGS. 4, 7, and 59 and is a block diagram of an embodiment of a twelve cylinder linear compound engine.
FIG. 59 relates to FIGS. 4, 7, and 58 and is an end-on schematic diagram of the configuration and corresponding direction of rotation for the crankshaft for an embodiment of a twelve cylinder linear compound engine.
FIG. 60 relates to FIGS. 11, 14, an 61 and is a block diagram of an embodiment of a twelve cylinder vee compound engine.
FIG. 61 relates to FIGS. 11, 14, and 60 and is an end-on schematic diagram of the configuration and corresponding direction of rotation of the crankshaft for an embodiment of a twelve cylinder vee compound engine.

Reference is made to a twentieth preferred embodiment comprising an eleven cylinder linear compound internal-combustion hot-gas engine according to the present invention as shown in FIGS. 4, 7, 54, and 55; wherein FIG. 4 shows in cross section an internal-combustion unit, and FIG. 7 shows in cross section a hot-gas unit, with the internal combustion unit usable six times and the hot-gas unit usable five times to the block diagram shown in FIG. 54 and the schematic diagram shown in FIG. 55. The twentieth and first preferred embodiments of a compound internal-combustion hot-gas engine are similar, except that in the twentieth embodiment the internal-combustion means comprises six of the internal-combustion units of the type shown in FIG. 4, and the hot-gas means comprises five of the hot-gas units of the type shown in FIG. 7. The mechanical and thermal interconnections and the functions of the internal combustion means and the hot-gas means in the twentieth embodiment are similar to those described in the first embodiment.

FIG. 54 is a block diagram of a compound engine according to the twentieth preferred embodiment; wherein are shown blocks representing an engine casting 10; five regenerators 15', 15'', 15''', 15'''', and 15'''''; five recuperators 22', 22'', 22''', 22'''', and 22'''''; and a radiator 24. Block units A, C, E, G, I and K each represent an internal-combustion unit of the type shown in FIG. 4. Block units B, D, F, H, and J each represent a double-acting hot-gas unit of the type shown in FIG. 7. Arrows in FIG. 54 represent the direction of flow of thermal energy from exhaust gases of internal-combustion units A, C, E, G, I, and K to recuperators 22',22'', 22''', and 22''''' and then through heat pipes 23 or by conduction to five heaters 16 (FIG. 7) of double-acting hot-gas units B, D, F, H, and J. The other two arrows in FIG. 54 represent the flow of liquid coolant 39 between engine casting 10 and radiator 24. The eleven circles in FIG. 54 each represent a cylinder within the compound engine.

Referring to FIGS. 7 and 54, each cool compression space 85 below a double-acting piston 84 in blocks B, D, F, H, and J is interconnected via a duct 87 through a regenerator 15 to a hot expansion space 86 above another double-acting piston 84. Referring to FIG. 54 the interconnections are:

- Cool space 84'' of B interconnected via 15'' to hot space 86''' of D,
- Cool space 85''' of D interconnected via 15''' to hot space 86'''' of F,
- Cool space 85'''' of F interconnected via 15'''' to hot space 86''''' of H,
- Cool space 85''''' of H interconnected via 15''''' to hot space 86' of J, and
- Cool space 85' of J interconnected via 15' to hot space 86'' of B.

FIG. 55 is an end-on schematic diagram of the relative placement of connecting-rod journals on a crankshaft 11 usable to the twentieth embodiment of a compound engine. Notations B, D, F, H, and J of FIG. 55 relate to B, D, F, H, and J of FIG. 54. The unshaded circle 11 central to FIG. 55 represents the central rotational axis of crankshaft 11. The five shaded circles 78', 78'', 78''', 78'''', and 78''''' each relate to a separate connecting-rod journal 78 of a double-acting hot-gas unit shown in FIG. 7. The six unshaded circles 27', 27'', 27''', 27'''', 27''''', and 27'''''' each relate to a separate connecting-rod journal 27 of an internal-combustion unit shown in FIG. 4. The circular arrow in FIG. 55 relates to similar arrows adjacent to countermasses 26 of FIG. 6 and 77 of FIG. 7, and denotes counter clockwise rotation of crankshaft 11.

The relative placement of connecting-rod journals 78', 78'', 78''', 78'''', and 78''''' on crankshaft 11 requires that $\alpha_e = \alpha_c \pm 2\pi/5$: wherein $\alpha$'s are individual angular positions of connecting-rod journals 78', 78'', 78''', 78''', and 78''''' which individually range from 0 to $2\pi$ radians; wherein subscripts e and c refer respectively to interconnected expansion 86 and compression 85 spaces; and wherein $\alpha_n = 0$ when the piston associated with the $n^{th}$ connecting-rod journal is at TDC in its cylinder. The additional phase difference of $\pi$ radians intrinsic to double-acting pistons provides that cyclic variations in the volume $V_e$ of an expansion space 86 lead those in the volume $V_c$ of an interconnected compression space 85 by $3\pi/5$ radians. Minimum and maximum total volumes $V_t$ of the working medium in two interconnected spaces 85 and 86 occur when the trigonometric relation $\sin \alpha_e = \sin \alpha_c$ is satisfied; that is minimum when $\alpha_e = 3\pi/10$ and $\alpha_c = 7\pi/10$, and maximum when $\alpha_e = 13\pi/10$ and $\alpha_c = 17\pi/10$. The pentad of double-acting hot-gas units delivers a positive torque to the crankshaft throughout the repetitive hot-gas cycle.

When the internal-combustion means drives crankshaft 11 clockwise, the hot-gas means operates as a refrigerator.

TWENTY-FIRST PREFERRED EMBODIMENT

Reference is made to a twenty-first preferred embodiment comprising a twelve cylinder linear compound internal-combustion hot-gas engine according to the present invention as shown in FIGS. 4, 7, 56 and 57; wherein FIG. 4 shows in cross section an internal-combustion unit, and FIG. 7 shows in cross section a hot-gas unit, with the internal-combustion unit usable six times and the hot-gas unit usable six times to the block diagram shown in FIG. 56 and the schematic diagram shown in FIG. 57. The twenty-first and first embodiments of a compound internal-combustion hot-gas engine are similar, except the twenty-first embodiment is a 2x repetition of the first embodiment. The internal-combustion means for the twenty-first preferred embodiment comprises six of the internal-combustion units of the type shown in FIG. 4. The internal-combustion means operates in either the two-stroke or four-stroke cycle. The hot-gas means for the twenty-first embodiment comprises six of the double-acting hot-gas units of the type shown in FIG. 7. The mechanical and thermal interconnections and the functions of the internal-combustion means and hot-gas means for the twenty-first embodiment are similar to those for the first embodiment.

FIG. 56 is a block diagram of a compound engine according to the twenty-first preferred embodiment; wherein are shown blocks representing an engine casting 10; six regenerators 15', 15'', 15''', 15'''', 15''''', and 15'''''; six recuperators 22', 22'', 22''', 22'''', 22''''', and 22''''''; and a radiator 24. Block units A, C, E, G, I, and K each represent an internal-combustion unit of the type shown in FIG. 4. Block units B, D, F, H, J, and L each represent a double-acting hot-gas unit of the type shown in FIG. 7. Arrows in FIG. 56 represent the direction of flow of thermal energy from exhaust gases of internal-combustion units A, C, E, G, I, and K to recuperators 22', 22'', 22''', 22'''', 22''''', and 22'''''' and then through heat pipes 23 or by conduction to six heaters 16 (FIG. 7) of double-acting hot-gas units B, D, F, H, J, and L. The other two arrows in FIG. 56 represent the flow of liquid coolant between engine casting 10 and radiator 24. The twelve arrows in FIG. 56 each represent a cylinder within the compound engine.

Referring to FIGS. 7 and 56, each cool compression space 85 below a double-acting piston 84 in blocks B, D, F, H, J, and L is interconnected via a duct 87 through a regenerator 15 to a hot expansion space 86 above another double-acting piston 84. Referring to FIG. 56 the interconnections are:

Cool space 85'' of B interconnected via 15'' to hot space 86''' of D,

Cool space 85', '' of D interconnected via 15''' to hot space 86'''' of F,

Cool space 85'''' of F interconnected via 15'''' to hot space 86''''' of H,

Cool space 85''''' of H interconnected via 15''''' to hot space 86'''''' of J,

Cool space 85'''''' of J interconnected via 15'''''' to hot space 86' of L, and

Cool space 85' of L interconnected via 15' to hot space 86'' of B.

FIG. 57 is an end-on schematic diagram of the relative placement of connecting-rod journals on a crankshaft 11 usable to the twenty-first embodiment of a compound engine. Notations B, D, F, H, J and L of FIG. 57 relate to B, D, F, H, J, and L of FIG. 56. The unshaded circle 11 central to FIG. 57 represents the central rotational axis of crankshaft 11. The six shaded circles 78', 78'', 78''', 78'''', 78''''', and 78'''''' each relate to a separate connecting-rod journal 78 of a double-acting hot-gas unit shown in FIG. 7. The six unshaded circles 27', 27'', 27''', 27'''', 27''''', and 27'''''' each relate to a separate connecting-rod journal 27 of an internal-combustion unit shown in FIG. 4. The circular arrow in FIG. 57 relates to similar arrows adjacent to countermasses 26 of FIG. 4 and 77 of FIG. 7, and denotes counter clockwise rotation of crankshaft 11.

The relative placement of connecting-rod journals on the crankshaft requires that $\alpha_e = \alpha_c + \pi/3$; wherein $\alpha$'s are individual angular positions of connecting-rod journals 78', 78'', 78''', 78'''', 78''''', and 78'''''' which individually range from 0 to $2\pi$ radians; wherein subscripts $e$ and $c$ refer respectively to interconnected expansion 86 and compression 85 spaces; and wherein $\alpha_n = 0$ when the piston associated with the $n^{th}$ connecting-rod journal is at TDC in its cylinder. The additional phase difference of $\pi$ radians intrinsic to double-acting pistons further provides that cyclic variations in the volume $V_e$ of an expansion space 86 lead those in the volume $V_c$ of an interconnected compression space 85 by $2\pi/3$ radians. Minimum and maximum total volumes $V_t$ of the working medium in two interconnected spaces 85 and 86 occur when the trigonometric relation $\sin \alpha_e = \sin \alpha_c$ is satisfied; that is minimum when $\alpha_e = \pi/3$ and $\alpha_c = 2\pi/3$, and maximum when $\alpha_e = 4\pi/3$ and $\alpha_c = 5\pi/3$. The sextet of double-acting hot-gas units delivers a positive torque to the crankshaft throughout the repetitive hot-gas cycle.

When the internal-combustion means drives crankshaft 11 clockwise, then the hot-gas means operates as a refrigerator.

TWENTY-SECOND PREFERRED EMBODIMENT

Reference is made to a twenty-second preferred embodiment comprising a twelve cylinder linear compound internal-combustion hot-gas engine according to the present invention as shown in FIGS. 4, 7, 58, and 59; wherein FIG. 4 shows in cross section an internal-combustion unit, and FIG. 7 shows in cross section a hot-gas unit, with the internal-combustion unit usable eight times and the hot-gas unit usable four times to the block diagram shown in FIG. 58 and the schematic diagram shown in FIG. 59. The twenty-second and first preferred embodiments of a compound internal-combustion hot-gas engine are similar, except in the twenty-second embodiment the internal-combustion means comprises eight of the internal-combustion units of the type shown in FIG. 4, and the hot-gas means comprises four of the hot-gas units of the type shown in FIG. 7. The mechanical and thermal interconnections and the functions of the internal-combustion means and the hot-gas means are similar to those described for the first embodiment.

FIG. 58 is a block diagram of a compound engine according to the twenty-second preferred embodiment; wherein are shown blocks representing an engine casting 10; four regenerators 15', 15'', 15''', and 15''''; four recuperators 22', 22'', 22''', and 22''''; and a radiator 24. Block units A, C, D, F, G, I, J, and L each represent an internal-combustion unit of the type shown in FIG. 4. Block units B, E, H, and K each represent a double-acting hot-gas unit of the type shown in FIG. 7. Arrows in FIG. 58 represent the direction of flow of thermal energy from exhaust gases of internal-combustion units A, C, D, F, G, I, J, and L to recuperator 22', 22'', 22''', and 22'''' and then through heat pipes 23 or by conduction to six heaters 16 (FIG. 7) of double-acting hot-gas units B, E, H, and K. The other two arrows of FIG. 58 represent the flow of liquid coolant between engine casting 10 and radiator 24. The twelve circles in FIG. 58 each represent a cylinder within the compound engine.

Referring to FIGS. 7 and 58, each cool compression space 85 below a double-acting piston 84 in block units B, E, H, and K is interconnected via a duct 87 through a regenerator 15 to a hot expansion space 86 above another double-acting piston 84. Referring to FIG. 58 the interconnections are:

Cool space 85'' of B interconnected via 15'' to hot space 86''' of E,

Cool space 85''' of E interconnected via 15''' to hot space 86'''' of H,

Cool space 85'''' of H interconnected via 15'''' to hot space 86' of K, and

Cool space 85' of K interconnected via 15' to hot space 86'' of B.

FIG. 59 is an end-on schematic diagram of the relative placement of connecting-rod journals on a crankshaft 11 usable to the twenty-second embodiment of a compound engine. Notations B, E, H, and K of FIG. 59 relate to B, E, H, and K of FIG. 58. The unshaded circle 11 central to FIG. 59 represents the central rotational axis of crankshaft 11. The four shaded circles 78', 78'', 78''', and 78'''' each relate to a separate connecting-rod journal 78 of a double-acting hot-gas unit shown in FIG. 7. The eight unshaded circles 27', 27'', 27''', 27'''', 27''''', 27'''''', 27''''''', and 27'''''''' each relate to a separate connecting-rod journal 27 of an internal-combustion unit shown in FIG. 4. The circular arrow in FIG. 59 relates to similar arrows adjacent to countermasses 26 of FIG. 4 and 77 of FIG. 7, and denotes counter clockwise rotation of the crankshaft 11.

The relative placement of connecting-rod journals on the crankshaft requires that $\alpha_e = \alpha_c + \pi/2$; wherein $\alpha$'s are individual angular positions of connecting-rod journals 78', 78'', 78''', and 78'''' which individually range from 0 to $2\pi$ radians; wherein subscripts e and c refer respectively to interconnected expansion 86 and compression 85 spaces; and wherein $\alpha_n = 0$ when the piston associated with the $n^{th}$ connecting-rod journal is at TDC in its cylinder. The additional phase difference of $\pi$ radians intrinsic to double-acting pistons further provides that cyclic variations in the volume $V_e$ of an expansion space 86 lead those in the volume $V_c$ of an interconnected compression space 85 by $\pi/2$ radians. Minimum and maximum total volumes $V_t$ of the working medium in two interconnected spaces 85 and 86 occur when the trigonometric relation $\sin \alpha_e = \sin \alpha_c$ is satisfied; that is minimum when $\alpha_e = \pi/4$ and $\alpha_c = 3\pi/4$, and maximum when $\alpha_e = 5\pi/4$ and $\alpha_c = 7\pi/4$. The quartet of double-acting hot-gas units delivers a positive torque to the crankshaft throughout the repetitive hot-gas cycle.

When the internal-combustion means drives crankshaft 11 clockwise, then the hot-gas means operates as a refrigerator.

TWENTY-THIRD PREFERRED EMBODIMENT

Reference is made to a twenty-third preferred embodiment comprising a twelve cylinder ($\pi/2$)-radian-vee compound internal-combustion hot-gas engine according to the present invention as shown in FIGS. 11, 14, 60, and 61; wherein FIG. 11 shows in cross section an internal-combustion unit, and FIG. 14 shows in cross section a hot-gas unit, with the internal-combustion unit usable four times and the hot-gas unit usable two times to the block diagram shown in FIG. 11 and the schematic diagram shown in FIG. 14. The twenty-third and the second preferred embodiments of a compound internal-combustion hot-gas engine are similar, except that in the twenty-third embodiment the internal-combustion means comprises four of the internal-combustion units of the type shown in FIG. 11. The mechanical and thermal interconnections and the functions of the internal-combustion means and the hot-gas means for the twenty-third embodiment are similar to those previously described for the second embodiment.

FIG. 60 is a block diagram of a compound engine according to the twenty-third preferred embodiment; wherein are shown blocks representing an engine casting 110; four regenerators 115', 115'', 115''', and 115''''; four recuperators 122', 122'', 122''', and 122''''; and a radiator 124. Block units AB, CD, IJ, and KL each represent an internal-combustion unit of the type shown in FIG. 11. Block units EF and GH each represent a double-acting hot-gas unit of the type shown in FIG. 14. Arrows in FIG. 60 represent the direction of flow of thermal energy from exhaust gases of internal-combustion units AB, CD, IJ, and KL, to recuperators 122', 122'', 122''', and 122'''' and then through heat pipes 23 or by conduction to eight heaters 16 (FIG. 14) of double-acting hot-gas units EF and GH. The other two arrows in FIG. 60 repesent the flow of liquid coolant between engine casting 110 and radiator 124. The twelve circles in FIG. 60 each represent a cylinder within the compound engine.

Referring to FIGS. 14 and 60, each cool compression space 185 below a double-acting piston 184 in blocks E, F, G, and H is inerconnected via a duct 187 through a regenerator 115 to a hot expansion space 186 above another double-acting piston 84. Referring to FIG. 60 the interconnections are:

- Cool space 185' of F interconnected via 115' to hot space 186'' of E,
- Cool space 185'' of E interconnected via 115'' to hot space 186''' of H,
- Cool space 185''' of H interconnected via 115''' to hot space 186'''' of G, and
- Cool space 185'''' of G interconnected via 115'''' to hot space 186' of F.

FIG. 61 is an end-on schematic diagram of the relative placement of connecting-rod journals on a crankshaft 311 usable to the twenty-third embodiment of a compound engine. Notations E, F, G, and H of FIG. 61 relate to E, F, G, and H of FIG. 60. The unshaded circle 311 central to FIG. 61 represents the central rotational axis of crankshaft 11. The two shaded circles 178' and 178'' each relate to a separate connecting-rod journal 178 of a double-acting hot-gas unit shown in FIG. 14. The four unshaded circles 27', 27'', 27''', and 27'''' each relate to a separate connecting-rod journal 27 of an internal-combustion unit shown in FIG. 4. The circular arrow in FIG. 61 relates to similar arrows adjacent to countermasses 126 of FIG. 11 and 177 of FIG. 14, and denotes counter clockwise rotation of crankshaft 311.

The relative placement of connecting-rod journals on the crankshaft requires that $\alpha_c = \alpha_e + \pi/2$; wherein $\alpha$'s are individual angular positions of connecting-rod journals 178' and 178'' which individually range from 0 to $2\pi$ radians; wherein subscripts $e$ and $c$ refer respectively to interconnected expansion 186 and compression 185 spaces; and wherein $\alpha_n = 0$ when the $n^{th}$ piston is at TDC in its cylinder. The additional phase difference of $\pi$ radians intrinsic to a double-acting piston provides that cyclic variations in the volume $V_e$ of an expansion space 186 lead those in the volume $V_c$ of an interconnected compression space 185 by $\pi/2$ radians. Minimum and maximum total volumes $V_t$ of the working medium in two interconnected spaces 185 and 186 occur when the trigonometric relation $\sin \alpha_e = \sin \alpha_c$ is satisfied; that is minimum when $\alpha_e = \pi/4$ and $\alpha_c = 3\pi/4$, and maximum when $\alpha_e = 5\pi/4$ and $\alpha_c = 7\pi/4$. The quartet of double-acting hot-gas units delivers a positive torque to the crankshaft throughout the repetitive hot-gas cycle.

When the internal-combustion means drives crankshaft 311 clockwise, then the hot-gas means operates as a refrigerator.

TWENTY-FOURTH PREFERRED EMBODIMENT

Figure 62:
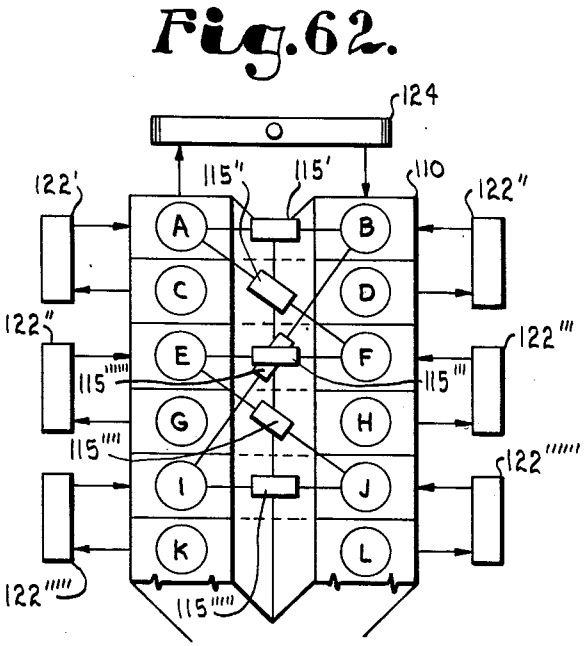
FIG. 62 relates to FIGS. 11, 14, and 63 and is a block diagram of an embodiment of a twelve cylinder vee compound engine.
Figure 63:
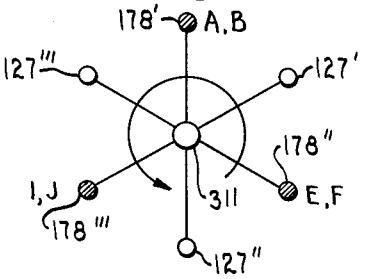
FIG. 63 relates to FIGS. 11, 14, and 62 and is an end-on schematic diagam of the configuration and corresponding direction of rotation of the crankshaft for an embodiment of a twelve cylinder vee compound engine.

Reference is made to a twenty-fourth preferred embodiment comprising a twelve cylinder ($\pi/3$)-radian-vee compound internal-combustion hot-gas engine according to the present invention as shown in FIGS. 11, 14, 62, and 63; wherein FIG. 11 shows in cross section an internal-combustion unit, and FIG. 14 shows in cross-section a hot-gas unit, with the internal-combustion unit usable three times and the hot-gas unit usable three times to the block diagram shown in FIG. 62 and the schematic diagram shown in FIG. 63. The internal-combustion means for the twenty-fourth preferred embodiment comprises three of the internal-combustion units of the type shown in FIG. 11. The internal-combustion means operates in either the two-stroke or four-stroke cycle. The hot-gas means for the twenty-fourth embodiment comprises three of the double-acting hot-gas units of the type shown in FIG. 14. Said units shown in FIGS. 11 and 14 were described previously in the second preferred embodiment of a compound engine. The mechanical and thermal interconnections and functions of said means in the twenty-fourth embodiment are similar to those described previously in the second embodiment, except that in the twenty-fourth preferred embodiment the vee angle of both the hot-gas and the internal-combustion units is $\pi/3$ radians rather than $\pi/2$ radians as shown in FIGS. 11 and 14.

FIG. 62 is a block diagram of a compound engine according to the twenty-fourth preferred embodiment; wherein are shown blocks representing an engine casting 110; six regenerators 115', 115'', 115''', 115'''', 115''''', and 115''''''; six recuperators 122', 122'', 122''', 122'''', 122''''', and 122''''''; and a radiator 124. Block units CD, GH, and KL each represent an internal-combustion unit of the type shown in FIG. 11. Block units AB, EF, and IJ each represent a double-acting hot-acting hot-gas unit of the type shown in FIG. 14. Arrows in FIG. 62 represent the directional flow of thermal energy from exhaust gases of internal-combustion units CD, GH, and KL to recuperators 122', 122'', 122''', 122'''', 122''''', and 122'''''' and then through heat pipes 123 or by conduction to six heaters 116 (FIG. 14) of double-acting hot-gas units AB, EF, and IJ. The other two arrows in FIG. 62 represent the flow of liquid coolant between engine casting 110 and radiator 124. The twelve circles in FIG. 62 each represent a cylinder within the compound engine.

Referring to FIGS. 14 and 62, each cool compression space 185 below a double-acting piston 184 in blocks A, B, E, F, I and J is interconnected via a duct 187 through a regenerator 115 to a hot expansion space 186 above another double-acting piston 184. Referring to FIG. 62 the interconnections are:

- Cool space 185' of B interconnected via 115' to hot space 186'' of A,
- Cool space 185'' of A interconnected via 115'' to hot space 186''' of F,
- Cool space 185''' of F interconnected via 115''' to hot space 186'''' of E,
- Cool space 185'''' of E interconnected via 115'''' to hot space 186''''' of J,
- Cool space 185''''' of J interconnected via 15''''' to hot space 186'''''' of I, and
- Cool space 185'''''' of I interconnected via 115'''''' to hot space 186' of B.

FIG. 63 is an end-on schematic diagram of the relative placement of connecting-rod journals on a crankshaft usable to the twenty-fourth embodiment of a compound engine. Notations A, B, E, F, I, and J of FIG. 63 relate to A, B, E, F, I, and J of FIG. 62. The unshaded circle 311 central to FIG. 63 represents the central rotational axis of crankshaft 311. The three shaded circles 178', 178'', and 178''' each relate to a separate connecting-rod journal 178 of a double-acting hot-gas unit shown in FIG. 14. The three unshaded circles 127', 127'', and 127''' each related to a separate connecting-rod journal 127 of an internal-combustion unit shown in FIG. 11. The circular arrow in FIG. 63 relates to similar arrows n adjacent to countermasses 126 of FIG. 11 and 177 of FIG. 14, and denotes counter clockwise rotation of crankshaft 311.

The relative placement of connecting-rod journals on the crankshaft requires the $\alpha_c = \alpha_e + \pi/3$; wherein $\alpha$'s are individual angular positions of six pistons of the type 184 which individually range from 0 to $2\pi$ radians; wherein subscripts e and c refer respectively to interconnected expansion 186 and compression 185 spaces; and wherein $\alpha_n = 0$ when the $n^{th}$ piston is at TDC in its cylinder. The additional phase difference of $\pi$ radians intrinsic to double-acting pistons further provides that cyclic variations in the volume $V_e$ of an expansion space 186 lead those in the volume $V_c$ of an interconnected compression space 185 by $2\pi/3$ radians. Minimum and maximum total volumes $V_t$ of the working medium in two interconnected spaces 185 and 186 occur when the trigonometric relation $\sin \alpha_e = \sin \alpha_c$ is satisfied; that is minimum when $\alpha_e = \pi/3$ and $\alpha_c = 2\pi/3$, and maximum when $\alpha_e = 4\pi/3$ and $\alpha_c = 5\pi/3$. The sextet of double-acting hot-gas units delivers a positive torque to the crankshaft throughout the repetitive hot-gas cycle.

When the internal-combustion means drives crankshaft 311 clockwise, then the hot-gas means operates as a refrigerator.

TWENTY-FIFTH PREFERRED EMBODIMENT

Figure 65:
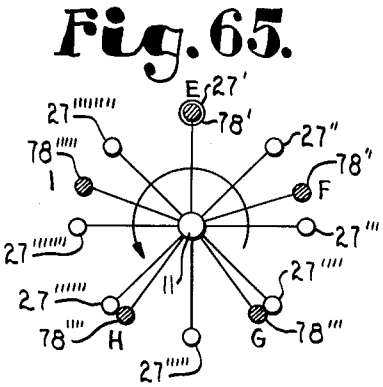
FIG. 65 relates to FIGS. 4, 7, and 64 and is an end-on schematic diagram of the configuration and corresponding direction of rotation of the crankshaft for an embodiment of a thirteen cylinder compound engine.
Figure 64:
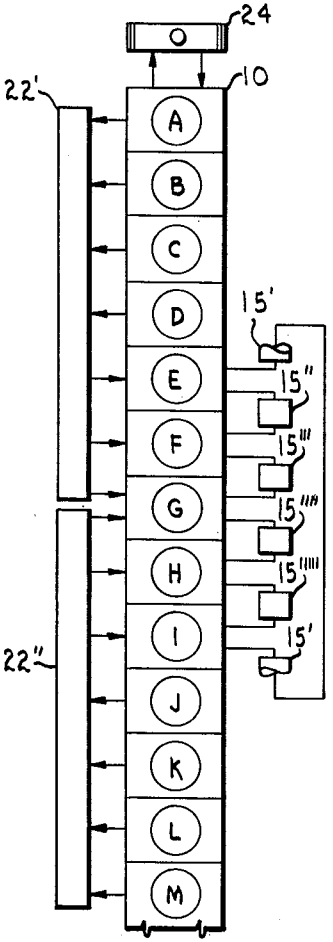
FIG. 64 relates to FIGS. 4, 7, and 65 and is a block diagram of an embodiment of a thirteen cylinder linear compound engine.

Reference is made to a twenty-fifth preferree embodiment comprising a thirteen cylinder linear compound internal-combustion hot-gas engine according to the present invention as shown in FIGS. 4, 7, 64, and 65; wherein FIG. 4 shows in cross section an internal-combustion unit, and FIG. 7 shows in cross section a hot-gas unit, with the internal-combustion unit usable eight times and the hot-gas unit usable five times to the block diagram shown in FIG. 64 and the schematic diagram shown in FIG. 65. The internal-combustion means for the twenty-fifth preferred embodiment comprises eight of the internal-combustion units of the type shown in FIG. 4. The internal-combustion means operates in either the two-stroke of four-stroke cycle. The hot-gas means for the twenty-fifth embodiment comprises five of the double-acting hot-gas units of the type shown in FIG. 7. Said units shown in FIGS. 4 and 7 were described previously in the first preferred embodiment of a compound engine. The mechanical and thermal interconnections and the functions of said means in the twenty-fifth embodiment are similar to those previously described herein.

FIG. 64 is a block diagram of a compound engine according to the twenty-fifth preferred embodiment; wherein are shown blocks representing an engine casting 10; five regenerators 15',15'',15''', 15'''', and 15'''''; two recuperators 22' and 22''; and one radiator 24. Block units A, B, C, D, J, K, L, and M each represent an internal-combustion unit of the type shown in FIG. 4. Block units, E, F, G, H, and I each represent a double-acting hot-gas unit of the type shown in FIG. 7. Arrows in FIG. 64 represent the directional flow of thermal energy from exhaust gases of the internal-combustion units A, B, C, D, J, K, L, and M to recuperators 22' and 22'' and through heat pipes 23 or by conduction to five heaters 16 (FIG. 7) of double-acting hot-gas units E, F, G, H, and I. The other two arrows in FIG. 64 represent the flow of liquid coolant between engine casting 10 and radiator 24.

Referring to FIGS. 7 and 64, each cool compression space 85 below a double-acting piston 84 in blocks E, F, G, H, and I is interconnected via a duct 87 through a regenerator 15 to a hot expansion space 86 above another double-acting piston 84. Referring to FIG. 64 the interconnections are:

- Cool space 85'' of E interconnected via 15'' to hot space 86''' of F,
- Cool space 85''' off F interconnected via 15''' to hot space 86'''' of G,
- Cool space 85'''' of G interconnected via 15'''' to hot space 86''''' of H,
- Cool space 85''''' of H interconnected via 15''''' to hot space 86' of I, and
- Cool space 85' of I interconnected via 15' to hot space 86'' of E.

FIG. 65 is an end-on schematic diagram of the relative placement of connecting-rod journals on a crankshaft usable to the twenty-fifth embodiment of a compound engine. Notations E, F, G, H, and I in FIG. 65 relate to E, F, G, H, and I of FIG. 64. The unshaded circle 11 central to FIG. 65 represents the central rotational axis of crankshaft 11. The five shaded circles 78', 78'', 78''', 78'''', and 78''''' each represent a separate connecting-rod journal 78 of a double-acting hot-gas unit shown in FIG. 7. THe eight unshaded circles 27', 27'', 27''', 27'''', 27''''', 27'''''', 27''''''', and 27'''''''' each relate to a separate connecting-rod journal 27 of an internal-combustion unit shown in FIG. 4. The circular arrow in FIG. 65 relates to similar arrows adjacent to countermasses 26 of FIG. 4 and 77 of FIG. 7, and denotes counter clockwise rotation of crankshaft 11.

The relative placement of connecting-rod journals on the crankshaft requires that $\alpha_c = \alpha_e + 2\pi/5$; wherein $\alpha$'s are individual angular positions of double-acting pistons of the type 84 which individually range from 0 to $2\pi$ radians; wherein subscripts $e$ and $c$ refer respectively to interconnected expansion 86 and compression 85 spaces; and wherein $\alpha_n$ = when the $n^{th}$ piston is at TDC in its cylinder. The additional phase difference of $\pi$ radians intrinsic to double-acting pistons further provides that cyclic variations in the volume $V_e$ of an expansion space 86 lead those in the volume $V_c$ of an interconnected compression space 85 by $3\pi/5$ radians. Minimum and maximum total volumes $V_t$ of the working medium in two interconnected spaces 85 and 86 occur when the trigonometric relation $\sin \alpha_e = \sin \alpha_c$ is satisfied; that is minimum when $\alpha_e = 3\pi/10$ and $\alpha_c = 7\pi/10$, and maximum when $\alpha_e = 13\pi/10$ and $\alpha_c = 17\pi/10$. The pentad of double-acting hot-gas units delivers a positive torque to the crankshaft throughout the repetitive hot gas cycle.

When the internal-combustion means drives crankshaft 11 clockwise, then the hot-gas means operates as a refrigerator.

TWENTY-SIXTH PREFERRED EMBODIMENT

Figure 66:
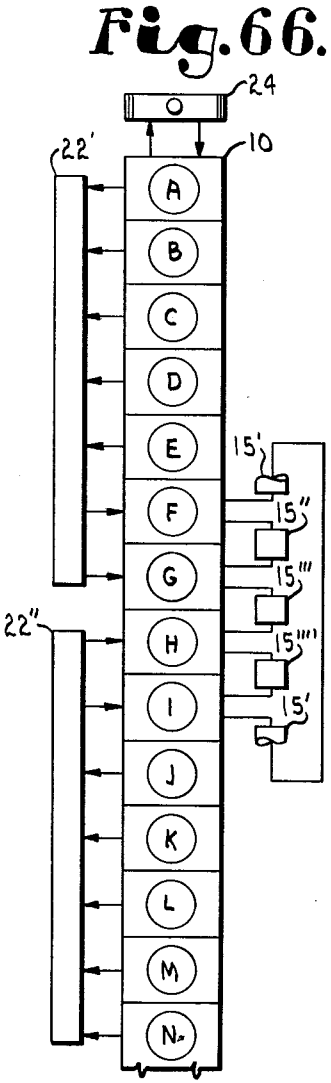
FIG. 66 relates to FIGS. 4, 7, and 67 and is a block diagram of an embodiment of a fourteen cylinder linear compound engine.
Figure 67:
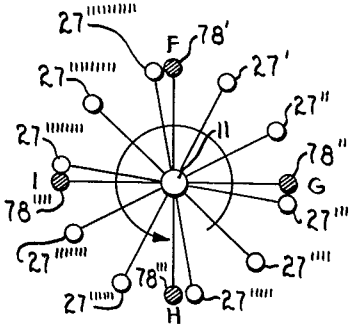
FIG. 67 relates to FIGS. 4, 7, and 66 and is an end-on schematic diagram of the configuration and corresponding direction of rotation of the crankshaft for an embodiment of a fourteen cylinder linear compound engine.

Reference is made to a twenty-sixth preferred embodiment comprising a fourteen cylinder linear compound internal-combustion hot-gas engine according to the present invention as shown in FIGS. 4, 7, 66, and 67; wherein FIG. 4 shows in cross section an internal-combustion unit, and FIG. 7 shows in cross section a hot-gas unit, with the internal-combustion unit usable ten times and the hot-gas unit usable four times to the block diagram shown in FIG. 66 and the schematic diagram shown in FIG. 67. The internal-combustion means for the twenty-sixth preferred embodiment comprises ten of the internal-combustion units of the type shown in FIG. 4. The internal-combustion means operates in either the two-stroke or four-stroke cycle. The hot-gas means for the twenty-sixth embodiment comprises four of the double-acting hot-gas units of the type shown in FIG. 7. Said units shown in FIGS. 4 and 7 were described previously in the first preferred embodiment of a compound engine. The mechanical and thermal interconnections and the functions of said means in the twenty-sixth embodiment are similar to those previously described in the first preferred embodiment.

FIG. 66 is a block diagram of a compound engine according to the twenty-sixth preferred embodiment; wherein are shown blocks representing an engine casting 10; four regenerators 15', 15'', 15''', and 15''''; two recuperators 22' and 22''; and a radiator 24. Block units A, B, C, D, E, J, K, L, M, and N each represent an internal-combustion unit of the type shown in FIG. 4. Block units F, G, H, and I each represent a double-acting hot-gas unit of the type shown in FIG. 7. Arrows in FIG. 66 represent the direction of flow of thermal energy from exhaust gases of internal-combustion units A, B, C, D, E, J. K, L, M, and N to two recuperators 22° and 22'' and then through heat pipes 23 or by conduction to four heaters 16 (FIG. 7) of double-acting hot-gas units F, G, H, and I. The other two arrows in FIG. 66 represent the flow of liquid coolant between engine casting 10 and radiator 24. The fourteen circles in FIG. 66 each represent a cylinder within the compound engine.

Referring to FIGS. 7 and 66, each cool compression space 85 below a double-acting piston 84 in blocks F, G, H, and I is interconnected via a duct 87 through a regenerator 15 to a hot expansion space 86 above another double-acting piston 84. Referring to FIG. 66 the interconnections are:

- Cool space 85'' of F interconnected via 15'' to hot space 86''' of G,
- Cool space 85''' of G interconnected via 15''' to hot space 86'''' of H,
- Cool space 85'''' of H interconnected via 15'''' to hot space 86' of I, and
- Cool space 85' of I interconnected via 15' to hot space 86'' of F.

FIG. 67 is an end-on schematic diagram of the relative placement of connecting-rod journals on a crankshaft usable to the twenty-sixth embodiment of a compound engine. Notations F, G, H, and I of FIG. 67 relate to F, G, H, and I of FIG. 66. The unshaded circle 11 central to FIG. 67 represents the central rotational axis of crankshaft 11. The four shaded circles 78', 78'', 78''', and 78'''' each relate to a separate connecting-rod journal 78 of a double-acting hot-gas unit shown in FIG. 7. The ten unshaded circles 27', 27'', 27''', 27'''', 27''''', 27'''''', 27''''''', 27'''''''', 27''''''''', and 27'''''''''' each relate to a separate connecting-rod journal 27 of an internal-combustion unit shown in FIG. 4. The circular arrow in FIG. 67 relates to similar arrows adjacent to countermasses 26 of FIG. 4 and 77 of FIG. 7, and denotes counter clockwise rotation of crankshaft 11.

The relative placement of connecting-rod journals on the crankshaft requires that $\alpha_c = \alpha_e + \pi/2$; wherein $\alpha$'s are individual angular positions of connecting-rod journals 78', 78'', 78''', and 78'''' which individually range from 0 to $2\pi$ radians; wherein subscripts $e$ and $c$ refer respectively to interconnected expansion 86 and compression 85 spaces; and wherein $\alpha_n = 0$ when the piston associated with the $n^{th}$ connecting-rod journal is at TCD in its cylinder. The additional phase difference of $\pi$ radians intrinsic to double-acting pistons further provides that cyclic variations in the volume $V_e$ of an expansion space 86 lead those in the volume $V_c$ of an interconnected compression space 85 by $\pi/2$ radians. Minimum and maximum total volumes $V_t$ of the working medium in two interconnected spaces 85 and 86 occur when the trigonometric relation $\sin \alpha_e = \sin \alpha_c$ is satisfied; that is minimum when $\alpha_e = \pi/4$ and $\alpha_c = 3\pi/4$, and maximum when $\alpha_e = 5\pi/4$ and $\alpha_c = 7\pi/4$. The quartet of double-acting hot-gas units delivers a positive torque to the crankshaft throughout the repetitive hot-gas cycle.

When the internal-combustion means drives crankshaft 11 clockwise, then the hot-gas means operates as a refrigerator.

TWENTY-SEVENTH PREFERRED EMBODIMENT

Figure 68:
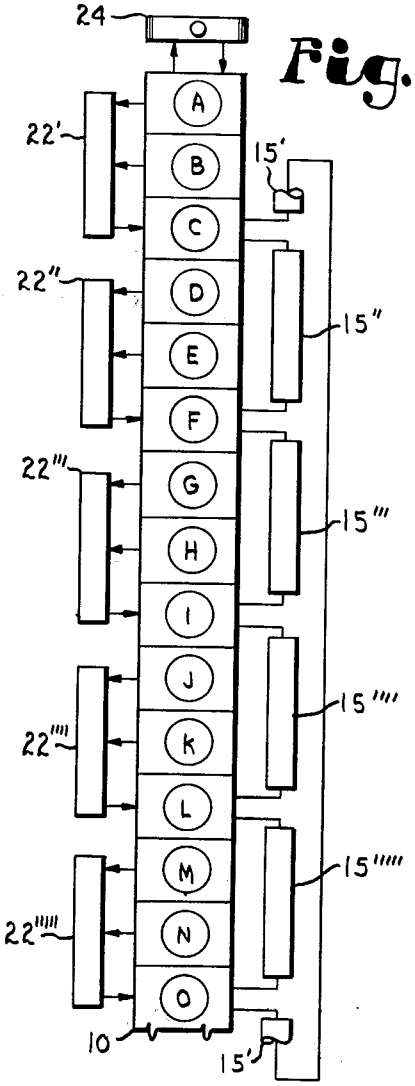
FIG. 68 relates to FIGS. 4, 7, and 69 and is a block diagram of an embodiment of a fifteen cylinder linear compound engine.
Figure 69:
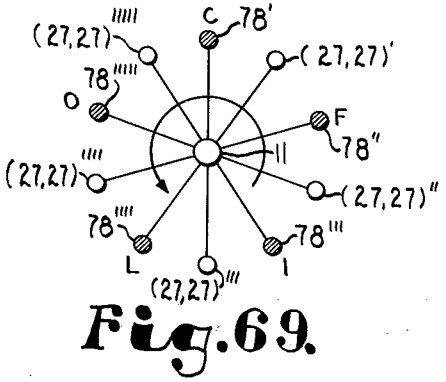
FIG. 69 relates to FIGS. 4, 7, and 68 and is an end-on schematic diagram of the configuration and corresponding direction of rotation of the crankshaft for an embodiment of a fifteen cylinder linear compound engine.

Reference is made to a twenty-seventh preferred embodiment comprising a fifteen cylinder linear compound internal-combustion hot-gas engine according to the present invention as shown in FIGS. 4, 7, 68, and 69 wherein FIG. 4 shows in cross section an internal-combustion unit, and FIG. 7 shows in cross section a hot-gas unit, with the internal-combustion unit usable ten times and the hot-gas unit usable five times to the block diagram shown in FIG. 68 and the schematic diagram shown in FIG. 69. The internal-combustion means for the twenty-seventh preferred emodiment comprises ten of the internal-combustion units of the type shown in FIG. 4. The internal-combustion means operates in either the two-stroke or four-stroke cycle. The hot-gas means for the twenty-seventh embodiment comprises five of the double-acting hot-gas units of the type shown in FIG. 7. Said units shown in FIGS. 4 and 7 were described in the first preferred embodiment of a compound engine. The mechanical and thermal interconnections and the functions of said means in the twenty-seventh embodiment are similar to those previously described in the first embodiment.

FIG. 68 is a block diagram of a compound engine according to the twenty-seventh preferred embodiment; wherein are shown blocks representing an engine casting 10, five regenerators 15′, 15″, 15‴, 15⁗, and 15′′′′′; five regenerators 15′, 22″, 22‴, 22⁗ and 22′′′′′; and a radiator 24. Block units A, B, D, E, G, H, J, K, M, and N each represent an internalcombustion unit of the type shown in FIG. 4. Block units C, F, I, L, and O each represent a double-acting hot-gas unit of the type in FIG. 7. Arrows in FIG. 68 represent the direction of flow of thermal energy from exhaust gases of internal-combustion units A, B, D, E, G, H, J, K, M, and N to recuperators 22′, 22″, 22‴, 22⁗, and 22′′′′′ and then through heat units C, F, I, L, and O. The other two arrows of FIG. 68 represent the flow of liquid coolant between engine casting 10 and radiator 24. The fifteen circles in FIG. 68 each represent a cylinder within the compound engine.

Referring to FIGS. 7 and 68, each cool compression space 85 below a double-acting piston 84 in blocks C, F, I, L, and O is interconnected via a duct 87 through a regenerator 15 to a hot expansion space 86 above another double-acting piston 84. Referring to FIG. 68 the interconnections are:

- Cool space 85″ of C interconnected via 15″ to hot space 86‴ of F,
- Cool space 85‴ of F interconnected via 15‴ to hot space 86⁗ of I,
- Cool space 85⁗of I interconnected via 15 ⁗ to hot space 86′′′′′ of L,
- Cool space 85′′′′′ of L interconnected via 15′′′′′ to hot space 86′of O, and
- Cool space 85′ of O interconnected via 15′ to hot space 86′ of C.

FIG. 69 is an end-on schematic diagram of the relative placement of connecting-rod journals on a crankshaft usable to the twenty-seventh embodiment of a compound engine. Notations C, F, I, L, and O of FIG. 69 relate to C, F, I, L, and O of FIG. 68. The unshaded circle 11 central to FIG. 69 represents the central rotational axis of crankshaft 11. The five shaded circles 78′, 78″, 78‴, 78⁗, and 78′′′′′ each relate to a separate connecting-rod journal 78 of a double-acting hot-gas unit shown in FIG. 7. The five unshaded circles (27, 27)′, (27, 27)″, (27, 27)‴, (27, 27)⁗, and (27, 27)′′′′′ each relate to two connecting-rod journals of the type 27 of an internal-combustion unit shown in FIG. 4. The circular arrow in FIG. 69 relates to similar arrows adjacent to countermasses 26 of FIG. 4 and 77 of FIG. 7, and denotes counter clockwise rotation of crankshaft 11.

The relative placement of connecting-rod journals on the crankshaft requires that $\alpha_c = \alpha_e + 2\pi/5$; wherein $\alpha$'s are individual angular positions of connecting-rod journals 78′, 78″, 78‴, 78⁗, and 78′′′′′ which individually range from 0 to $2\pi$ radians; wherein subscripts e and c refer respectively to interconnected expansion 86 and compression 85 spaces; and wherein $\alpha_n = 0$ when the piston associated with the $n^{th}$ connecting-rod journal is at TDC in its cylinder. The additional phase difference of $\pi$ radians intrinsic to double-acting pistons further provides that cyclic variations in the volume $V_e$ of an expansion space 86 lead those in the volume $V_c$ of an interconnected compression space 85 by $3\pi/5$ radians. Minimum and maximum total volume $V_t$ of the working medium in two interconnected spaces 85 and 86 occur when the trigonometric relation $\sin \alpha_e = \sin \alpha_c$ is satisfied; that is minimum when $\alpha_e = 3\pi/10$ and $\alpha_c = 7\pi/10$, and maximum when $\alpha_e = 13\pi/10$ and $\alpha_c = 17\pi/10$. The pentad of double-acting hot-gas units delivers a positive torque to the crank shaft throughout the repetitive hot-gas cycle.

When the internal-combustion means drives crankshaft 11 clockwise, then the hot-gas means operates as a refrigerator.

TWENTY-EIGHTH PREFERRED EMBODIMENT

Figure 70:
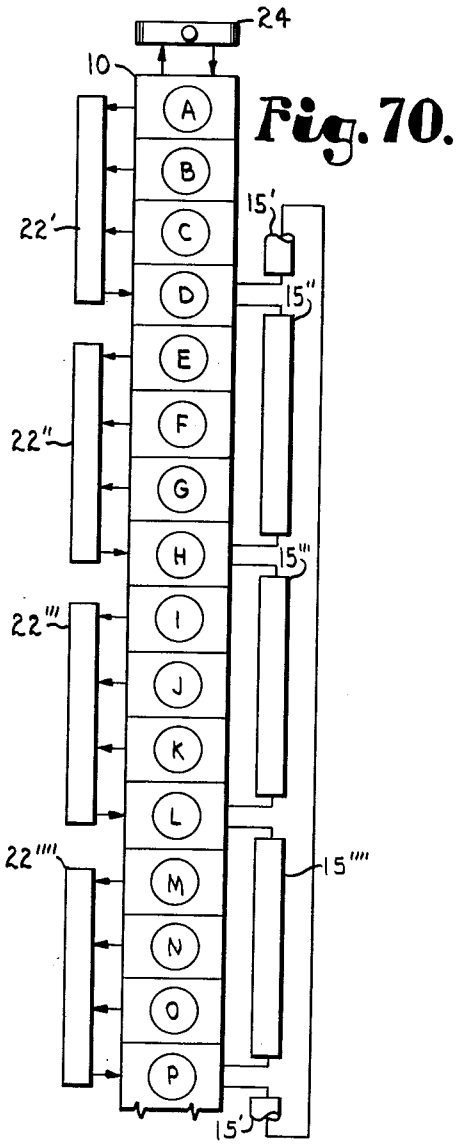
FIG. 70 relates to FIGS. 4, 7, and 71 and is a block diagram of an embodiment of a sixteen cylinder linear compound engine.
Figure 71:
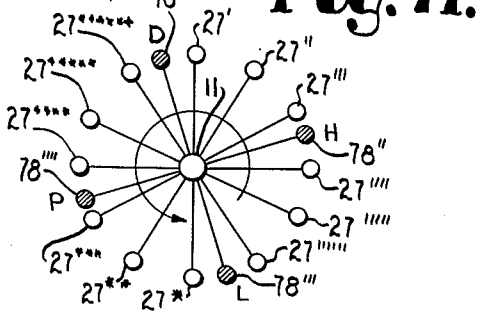
FIG. 71 relates to FIGS. 4, 7, and 70 and is an end-on schematic diagram of the configuration and corresponding direction of rotation of the crankshaft for an embodiment of a sixteen cylinder compound engine.

Reference is made to a twenty-eighth preferred embodiment comprising a sixteen cylinder linear compound internal-combustion hot-gas engine according to the present invention as shown in FIGS. 4, 7, 70, and 71; wherein FIG. 4 shows in cross section an internal-combustion unit, and FIG. 7 shows in cross section a hot-gas unit, with the internal-combustion unit usable twelve times and the hot-gas unit usable four times to the block diagram shown in FIG. 70 and the schematic diagram shown in FIG. 71. The internal-combustion means for the twenty-eighth preferred embodiment comprises twelve of the internal-combustion units of the type shown in FIG. 4. The internal-combustion means operates in either the two-stroke or four-stroke cycle. The hot-gas means for the twenty-eighth embodiment comprises four of the double-acting hot-gas units of the type shown in FIG. 7. Said units shown in FIGS. 4 and 7. were described previously in the first preferred embodiment of a compound engine. The mechanical and thermal interconnections and the functions of said means in the twenty-eighth embodiment are similar to those previously described in the first embodiment.

FIG. 70 is a block diagram of a compound engine according to the twenty-eighth preferred embodiment; wherein are shown blocks representing an engine casting 10; four regenerators 15′, 15″, 15‴, and 15⁗; four recuperators 22′, 22″, 22‴, and 22⁗; and a radiator 24. Block units A, B, C, E, F, G, I, J, K, M, N, and O each represent an internalcombustion unit of the type shown in FIG. 4. Block units D, H, L, and P each represent a double-acting hot-gas unit of the type shown in FIG. 7. Arrows in FIG, 70 represent the direction of flow of thermal energy from exhaust gases of internal-combustion units A, B, C, E, F, G, I, J, K, M, N, and O to recuperators 22′, 22″, 22‴, and 22⁗ and then through heat pipes 23 or by conduction to four heaters 16 (FIG. 7) of double-acting hot-gas units D, H, L, and P. The other two arrows in FIG. 70 represent the flow of liquid coolant between engine casting 10 and radiator 24. The sixteen circles in FIG. 70 each represent a cylinder within the compound engine.

Referring to FIGS. 7 and 70, each cool compression space 85 below a double-acting piston 84 in blocks D, H, L, and P is interconnected via a duct 87 through a regenerator 15 to a hot expansion space 86 above another double-acting piston 84. Referring to FIG. 70 the interconnections are:

Cool space 85'' of D interconnected via 15'' to hot space 86''' of H,

Cool space 85''' of H interconnected via 15''' to hot space 86'''' of L, .

Cool space 85'''' of L interconnected via 15'''' to hot space 86' of P, and

Cool space 85' of P interconnected via 15' to hot space 86'' of D.

FIG. 71 is an end-on schematic diagram of the relative placement of connecting-rod journals on a crankshaft usable to the twenty-eighth embodiment of a compound engine. Notations D, H, L, and P of FIG. 71 relate to D, H, L, and P of FIG. 70. The unshaded circle 11 central to FIG. 71 represents the central rotational axis of crankshaft 11. The four shaded circles 78',78'',78''', and 78'''' each relate to a separate connecting-rod journal 78 of a double-acting hot-gas unit shown in FIG. 7. The twelve unshaded circles 27',27'',27''', 27'''',27''''',27'''''', 27*,27, 27*, 27**, 27*, and 27**** each relate to a separate connecting-rod journal 27 of an internal-combustion unit shown in FIG. 4. The circular arrow in FIG. 71 relates to similar arrow adjacent to countermasses 26 of FIG. 4 and 77 of FIG. 7, and denotes counter clockwise rotation of crankshaft 11.

The relative placement of connecting-rod journals on the crankshaft requires that $\alpha_c = \alpha_e + \pi/2$; wherein $\alpha$'s are individual angular positions of connecting-rod journals 78', 78'', 78''', and 78'''' which individually range from 0 to $2\pi$ radians; wherein subscripts e and c refer respectively to interconnected expansion 86 and compression 85 spaces; and wherein $\alpha_n = 0$ when the piston associated with the $n^{th}$ connecting-rod journal is at TDC in its cylinder. The additional phase difference of $\pi$ radians intrinsic to double-acting pistons further provides that cyclic variations in the volume $V_e$ of an expansion space 86 lead those in the volume $V_c$ of an interconnected compression space 85 by $\pi/2$ radians. Minimum and maximum total volumes $V_t$ of the working medium in two interconnected spaces 85 and 86 occur when the trigonometric relation $\sin \alpha_e = \sin \alpha_c$ is satisfied; that is minimum when $\alpha_e = \pi/4$ and $\alpha_c = 3\pi/4$, and maximum when $\alpha_e = 5\pi/4$ and $\alpha_c = 7\pi/4$. The quartet of double-acting hot-gas units delivers a positive torque to the crankshat throughout the repetitive hot-gas cycle.

When the internal-combustion means is constructed so that it drives crankshaft 11 clockwise, then variations in volumes $V_e$ lag those in interconnected volumes $V_c$ by $\pi/2$ radians and the hot-gas means operates as a refrigerator.

Throughout the remainder of this patent application "a housing" shall refer to "an engine casting and attached engine heads"; for example in the first preferred embodiment engine casting 10 and engine head comprised of 8', 8'', 8''', 281', 281'', and 218''' as shown in FIGS. 1 and 3.

Understand that the foregoing descriptions of the preferred embodiments do not limit the scope of the invention. Modifications of the disclosed embodiments will occur to persons possessing ordinary skill in the art. The scope of the invention is therefore limited only by the following claims.

We claim:

1. An improved compound internal-combustion hot-gas engine having a housing; a crankshaft mounted so as to rotate about its central rotational axis within said housing thus providing an output shaft; an internal-combustion means for combustion of a fuel-air mixture as a source of motivating thermal energy in an open thermodynamic cycle, for delivering a net positive torque to said crankshaft, and for expelling hot exhaust gases as a product of said combustion; the internal-combustion means possessing a set of hollow cylinders, totaling $N_{ic}$ in number, fixed in said housing, where $N_{ic}$ is any one of the integers in the infinite progression 1, 2, 3, 4, 5, 6, 7, 8, 9, 10, 11, 12, etc.; a set of reciprocating pistons, totaling $N_{ic}$ in number, with one each of said set of $N_{ic}$ pistons within each of said set of $N_{ic}$ cylinders therewith defining $N_{ic}$ cyclically variable expansible chambers wherein the fuel-air mixture undergoes combustion; a set of connecting-rod journals, totaling $N_{ic}$ in number, integral to said crankshaft with said connecting-rod journals circularly orbiting the central rotational axis of said crankshaft as said crankshaft rotates; a set of connecting-rod means for mechanically coupling one each of said $N_{ic}$ pistons to one each of said $N_{ic}$ connecting-rod journals, for cyclically and nonlinearly synchronizing the reciprocative positions of said $N_{ic}$ pistons to the orbital angular positions of said $N_{ic}$ connecting-rod journals, for driving said crankshaft about its central rotational axis when each of said $N_{ic}$ pistons moves downward in said $N_{ic}$ cylinders, and for driving each of said $N_{ic}$ pistons upward in said $N_{ic}$ cylinders; at least one recuperator means for receiving the hot exhaust gases expelled from said internal-combustion means, for extracting thermal energy from the hot gases as they flow therethrough, and for conductively and convectively transporting said extracted thermal energy; a hot-gas means for receiving said extracted thermal energy transported by said recuperator means, for utilizing said extracted thermal energy as a source of motivating thermal energy in a closed thermodynamic cycle, and for delivering additional net positive torque to said crankshaft; a liquid coolant for circulating in hollow convection ways within said housing thus removing temperature degraded thermal energy from said internal-combustion means and said hot-gas means; and a radiator for receiving said liquid coolant and wherein said temperature degraded thermal energy is removed from said liquid coolant and is then transported by thermal processes of conduction, convection, and radiation to the ambient atmosphere; wherein said hot gas means further comprising:

at least one set of hollow cylinders totaling $N_{hg}$ in number fixed in said housing, wheren $N_{hg}$ is any one of the integers 3, 4, 5, 6, 7, 8, 9, 10, etc.;

at least one set of reciprocating double-acting pistons totaling $N_{hg}$ in number, with said double-acting pistons within said $N_{hg}$ cylinders therewith defining an expansible hot expansion space of cyclically variable volume $V_e$ above each of said $N_{hg}$ double-acting pistons and an expansible cool compression space of cyclically variable volume $V_c$ below each of said $N_{hg}$ double-action pistons;

at least one set of connecting-rod journals totaling $N_{hg}$ in number and integral to said crankshaft, and with said set of $N_{hg}$ connecting-rod journals circularly orbiting the central rotational axis of said crankshaft as said crankshaft rotates:

at least one set of connecting-rod means totaling $N_{hg}$ in number for mechanically coupling one each of said $N_{hg}$ double-acting pistons to one each of said $N_{hg}$ connecting-rod journals, for cyclically and nonlinearly synchronizing the reciprocative positions of said $N_{hg}$ double-acting pistons to the orbital angular positions of said $N_{hg}$ connecting-rod journals, and for driving said crankshaft about its central rotational axis as said $N_{hg}$ double-acting pistons move in said $N_{hg}$ cylinders;

at least one set of regenerator means totaling $N_{hg}$ in numbers, with a duct through each of said regenerator means for interconnecting one each of said expansible cool compression spaces of cyclically variable volume $V_c$ below said double-acting pistons to one each of said expansible hot expansion spaces of cyclically variable volume $V_e$ above said double-acting pistons; and a gaseous working medium enclosed in said expansible cool compression spaces of cyclically variable volume $V_c$ and said expansible hot expansion spaces of cyclically variable volume $V_e$ and communicating therebetween via said ducts through said regenerator means.

2. An improved cmpound internal-combustion hot-gas engine as recited in claim 1, in which the relative placement of said set of $N_{hg}$ connecting-rod journals on said crankshaft comprises:

a means for phasing sequential occurrences of minimum and maximum values of cyclically variable total volume $V_t$ of said gaseous working medium to orbital angular positions $\alpha_n$ when the trigonometric relation $$\sin \alpha_c = \sin \alpha_e$$

is satisfied, where $V_t$ is defined by the equation $$V_t = V_c + V_e + V_d,$$

where $V_c$ and $V_e$ respectively relate to one said expansible cool compression space of cylically variable volume $V_c$ that is interconnected via one of said $N_{hg}$ regenerator means to one said expansible hot expansion space of cyclically variable volume $V_e$, where $V_d$ relates to a constant deadspace volume within one said regenerator means, where $\alpha_n$ denotes the orbital angular position of the $n^{th}$ of said $N_{hg}$ connecting-rod journals, where each of the $N_{hg}$ orbital angular positions $\alpha_n$ vary continuously through $2\pi$ radiants during one complete revolution of said crankshaft, where $\alpha_n$ is arbitrarily chosen equal to zero when said double-acting piston coupled to the $n^{th}$ of said $N_{hg}$ connecting-rod journal is at the uppermost reciprocative position, and where the subscripts c and e on $\alpha$ denote said $N_{hg}$ connecting-rod journals coupled to said $N_{hg}$ double-acting pistons associated with said interconnected spaces of cyclically variable volume $V_c$ and $V_e$, respectively.

3. An improved compound internal-combustion hot-gas engine as recited in claim 2, in which the relative placement of said set of $N_{hg}$ connecting-rod journals on said crankshaft comprises:

a means for sequentially phasing the occurrence of minimum values of said cyclically variable total volume $V_t$ at angular intervals of $2\pi$ radians divided by the number $N_{hg}$, where during one complete revolution of said crankshaft there is one occurrence of minimum $V_t$ for each dyad, and where a dyad comprises one said expansible cool compression space of cylically variable volume $V_c$ interconnected via one of said regenerator means to one said expansible hot expansion space of cyclically variable volume $V_e$; and a means for phasing cyclical variations in said expansible hot expansion space of cyclically variable volume $V_e$ to lead cyclical variations in said interconnected expansible cool compression space of cyclically variable volume $V_c$ by an angular phase of $2\pi$ radians divided by the number $N_{hg}$.

4. An improved compound internal-combustion hot-gas engine as recited in claim 3, in which the relative placement of said set of $N_{ic}$ connecting-rod journals on said crankshaft comprises:

a means for sequentially phasing the reciprocative motion of said set of $N_{ic}$ pistons at angular intervals of $2\pi$ radians divided by the number $N_{ic}$.

5. An improved compound internal-combustion hot-gas engine as recited in claim 4, in which said housing comprises:

a means for holding said set of $N_{hg}$ cylinders and said set of $N_{ic}$ cylinders with the cylindrical axes of all said cylinders parallel and coplanar, and with said cylindrical axes each perpendicularly intersecting the central rotational axis of said crankshaft at separate points.

6. An improved compound internal-combustion hot-gas engine as recited in claim 4, in which said housing comprises:

a means for holding said set of $N_{hg}$ cylinders and said set of $N_{ic}$ cylinders with the cylindrical axes of one-half the total number of said cylinders parallel and coplanar in a first plane, with the cylindrical axes of the other one-half the total number of said cylinders parallel and coplanar in a second plane, with said first and second planes intersecting to form a vee, with the cylindrical axes of all said cylinders perpendiculary intersecting the line common to said first and second planes at separate points, and with the line common to said first and second planes corresponding exactly to the central rotational axis of said crankshaft, and where the sum of $N_{hg}$ and $N_{ic}$ is an even number.

7. An improved compound internal-combustion hot-gas engine as recited in claim 3, in which the relative placement of said set of $N_{ic}$ connecting-rod journals and said set of $N_{hg}$ connecting-rod journals on said crankshaft comprises:

a means for collectively phasing the reciprocative motion of said set of $N_{ic}$ pistons and said set of $N_{hg}$ double-acting pistons at sequential angular intervals of $2\pi$ radians divided by the number $N_t$, where $N_t$ is the sum of $N_{hg}$ and $N_{ic}$.

8. An improved compound internal-combustion hot-gas engine as recited in claim 7, in which said housing comprises:

a means for holding said set of $N_{hg}$ cylinders and said set of $N_{ic}$ cylinders with the cylindrical axes of all said cylinders parallel and coplanar, and with said cylindrical axes each perpendicualrly intersecting the central rotational axis of said crankshaft at separate points.

9. An improved compound internal-combustion hot-gas engine as recited in claim 7, in which said housing comprises:

a means for holding said set of $N_{ic}$ cylinders and said set of $N_{hg}$ cylinders with the cylindrical axes of one-half the total number of said cylinders parallel and coplanar in a first plane, with the cylindrical axes of the other one-half the total number of said cylinders parallel and coplanar in a second plane, with said first and second planes intersecting to form a vee, with the cylindrical axes of all said cylinders perpendicularly intersecting the line common to said first and second planes at separate points, and with the line common to said first and second planes corresponding exactly to the central rotational axis of said crankshaft, and where the sum of $N_{ic}$ and $N_{hg}$ is an even number.

* * * * *